US007397459B2

(12) United States Patent
Abe et al.

(10) Patent No.: US 7,397,459 B2
(45) Date of Patent: Jul. 8, 2008

(54) IMAGE DISPLAY APPARATUS AND IMAGE DISPLAY METHOD

(75) Inventors: Naoto Abe, Kanagawa-ken (JP); Tatsuro Yamazaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 10/629,801

(22) Filed: Jul. 30, 2003

(65) Prior Publication Data

US 2005/0078051 A1 Apr. 14, 2005

Related U.S. Application Data

(63) Continuation of application No. 09/330,153, filed on Jun. 11, 1999, now Pat. No. 6,839,054.

(30) Foreign Application Priority Data

Feb. 26, 1999 (JP) ..... 11-052050
Jun. 10, 1999 (JP) ..... 11-163745

(51) Int. Cl.
*G09G 3/36* (2006.01)

(52) U.S. Cl. ..... 345/98; 345/76; 345/100

(58) Field of Classification Search ..... 345/74.1, 345/75.1, 75.2, 74–78, 87–100, 690–693, 345/204

See application file for complete search history.

(56) References Cited

U.S. PATENT DOCUMENTS 4,021,607 A * 5/1977 Amano ..... 348/800
4,397,042 A 8/1983 Tsujii et al. ..... 359/158
4,716,403 A * 12/1987 Morozumi ..... 345/88
4,904,895 A 2/1990 Tsukamoto et al. ..... 313/336
5,066,833 A 11/1991 Zalenski ..... 178/19
5,066,883 A 11/1991 Yoshioka et al. ..... 313/309
5,122,791 A * 6/1992 Gibbons et al. ..... 345/102
5,160,871 A 11/1992 Tomii et al. ..... 315/366
5,206,631 A 4/1993 Yamamoto et al. ..... 340/781
5,309,150 A * 5/1994 Ohba et al. ..... 345/76
5,581,278 A 12/1996 Sugai et al. ..... 345/187

(Continued)

FOREIGN PATENT DOCUMENTS

JP 64-31332 2/1989

(Continued)

OTHER PUBLICATIONS

M.I. Elinson, et al., "The Emission of Hot Electrons and the Field Emission of Electrons from Tin Oxide", Radio Engineering and Electronic Physics, No. 7, pp. 1290-1296 (Jul. 1965).

(Continued)

*Primary Examiner*—Regina Liang
(74) *Attorney, Agent, or Firm*—FItzpatrick, Cella, Harper & Scinto

(57) ABSTRACT

An image display apparatus includes a plurality of display devices wired in a matrix through a plurality of scanning signal wirings and a plurality of modulated signal wirings, and a driving circuit for applying a modulated signal having a pulsewidth corresponding to an image signal to each of the plurality of modulated signal wirings. The driving circuit causes the modulated signal to fall in discrete decrements to a non-display state from a display state.

6 Claims, 41 Drawing Sheets

U.S. PATENT DOCUMENTS

| | | | | |
|---|---|---|---|---|
| 5,619,224 | A * | 4/1997 | Hoshino et al. | 345/98 |
| 5,686,936 | A * | 11/1997 | Maekawa et al. | 345/100 |
| 5,760,757 | A | 6/1998 | Tanaka et al. | 345/93 |
| 5,790,089 | A * | 8/1998 | Ono et al. | 345/94 |
| 5,995,074 | A | 11/1999 | Kusafuka et al. | 345/90 |
| 6,067,064 | A | 5/2000 | Furuhashi et al. | 345/89 |
| 6,104,136 | A | 8/2000 | Abe et al. | 313/495 |
| 6,140,985 | A | 10/2000 | Kanai et al. | 345/74 |
| 6,204,833 | B1 | 3/2001 | Hayashi et al. | 345/58 |
| 6,232,963 | B1 * | 5/2001 | Tew et al. | 345/204 |
| 6,339,414 | B1 | 1/2002 | Todokoro et al. | 345/4.1 |
| 6,531,996 | B1 * | 3/2003 | Murade | 345/98 |
| 6,603,450 | B1 | 8/2003 | Yamazaki et al. | 345/75.2 |
| 6,839,054 | B2 * | 1/2005 | Abe et al. | 345/204 |
| 6,894,671 | B2 * | 5/2005 | Yamamoto et al. | 345/89 |

FOREIGN PATENT DOCUMENTS

| | | |
|---|---|---|
| JP | 1-259324 | 10/1989 |
| JP | 2-257551 | 10/1990 |
| JP | 3-55738 | 3/1991 |
| JP | 3-67446 | 3/1991 |
| JP | 3-266341 | 11/1991 |
| JP | 4-28137 | 1/1992 |
| JP | 4-281137 | 1/1992 |
| JP | 4-308635 | 10/1992 |
| JP | 5-114372 | 5/1993 |
| JP | 9-68946 | 3/1997 |

OTHER PUBLICATIONS

G. Dittmer, "Electrical Conduction and Electron Emission of Discontinuous Thin Films", Thin Solid Films, pp. 317-328 (1972).

M. Hartwell, et al., "Strong Electron Emission from Patterned Tin-Indium Oxide Thin Films", International Electron Devices Meeting, pp. 519-521 (1975).

H. Araki, et al., "Electroforming and Electron Emission of Carbon Thin Films", Journal of the Vacuum Society of Japan, vol. 26, No. 1, pp. 22-29 (Jan. 26, 1983).

W.P. Dyke, et al., "Field Emission", Advances in Electronics and Electron Physics, vol. 8, pop. 89-185 (1956).

C.A. Spindt, et al., "Physical Properties of Thin-Film Field Emission Cathodes with Molybdenum Cones", Journal of Applied Physics, vol. 47, No. 12, pp. 5248-5263 (Dec. 1976).

C.A. Mead, "Operation of Tunnel-Emission Devices", Journal of Applied Physics, vol. 32, No. 4, pp. 646-652 (Apr. 1961).

R. Meyer, "Recent Development on "Microtips" Display at LETI" , Technical Digest of IVMC, 91, pp. 6-9 (1991).

* cited by examiner

ANALOG PROCESSOR
A/D CONVERTER
SYNC SEPARATOR
TIMING GENERATOR
HORIZONTAL SHIFT REGISTER
1-LINE MEMORY
VERTICAL SHIFT REGISTER
PWM GENERATOR
DISPLAY PANEL
Vdd
Vm
Vb
Vs
I1
10a
1
2
3
4
5
6
7
8
9
11
101
102
103
104
105
110

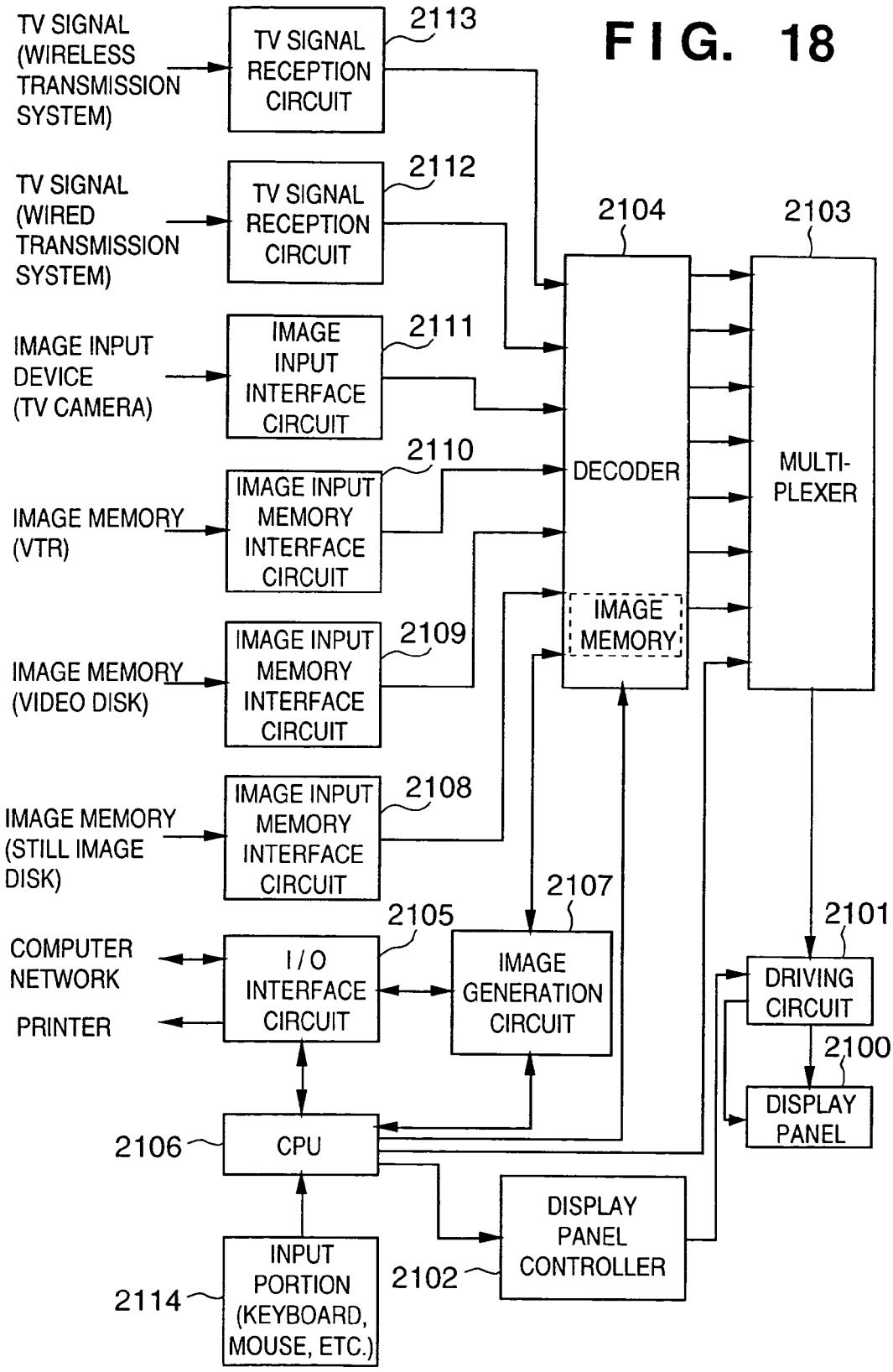
FIG. 18
TV SIGNAL (WIRELESS TRANSMISSION SYSTEM)
TV SIGNAL RECEPTION CIRCUIT
2113
TV SIGNAL (WIRED TRANSMISSION SYSTEM)
TV SIGNAL RECEPTION CIRCUIT
2112
IMAGE INPUT DEVICE (TV CAMERA)
IMAGE INPUT INTERFACE CIRCUIT
2111
IMAGE MEMORY (VTR)
IMAGE INPUT MEMORY INTERFACE CIRCUIT
2110
IMAGE MEMORY (VIDEO DISK)
IMAGE INPUT MEMORY INTERFACE CIRCUIT
2109
IMAGE MEMORY (STILL IMAGE DISK)
IMAGE INPUT MEMORY INTERFACE CIRCUIT
2108
2104
DECODER
IMAGE MEMORY
2103
MULTI-PLEXER
2107
IMAGE GENERATION CIRCUIT
2105
COMPUTER NETWORK
PRINTER
I/O INTERFACE CIRCUIT
2101
DRIVING CIRCUIT
2100
DISPLAY PANEL
2106
CPU
DISPLAY PANEL CONTROLLER
2102
2114
INPUT PORTION (KEYBOARD, MOUSE, ETC.)

IMAGE DISPLAY APPARATUS AND IMAGE DISPLAY METHOD

This is a continuation application of application Ser. No. 09/330,153, filed on Jun. 11, 1999.

BACKGROUND OF THE INVENTION

1. Field of the Invention

The present invention relates to a driving circuit for an image display apparatus, an image display apparatus using this circuit, and a driving method for them.

2. Description of the Related Art

In recent years, low-profile, large-screen display apparatuses have enthusiastically been studied and developed. The present inventor has studied a low-profile, large-screen display apparatus using a cold cathode device as an electron source.

Two types of devices, namely hot and cold cathode devices, are conventionally known as electron-emitting devices. Known examples of the cold cathode devices are surface-conduction emission type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted by a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 19 is a plan view showing the device by M. Hartwell et al. described above as a typical example of the device structures of these surface-conduction emission type electron-emitting devices. Referring to FIG. 19, reference numeral 3001 denotes a substrate; and 3004, a conductive thin film made of a metal oxide formed by sputtering. This conductive thin film 3004 has an H-shaped pattern, as shown in FIG. 19. An electron-emitting portion 3005 is formed by performing electrification processing (referred to as forming processing to be described later) with respect to the conductive thin film 3004. An interval L in FIG. 19 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction emission type electron-emitting devices by M. Hartwell et al. and the like, typically the electron-emitting portion 3005 is formed by performing electrification processing called forming processing for the conductive thin film 3004 before electron emission. In the forming processing, an electron-emitting portion is formed by electrification such that a constant DC voltage or a DC voltage which increases at a very low rate of, e.g., 1 V/min is applied across the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after the forming processing, electrons are emitted near the fissure.

These surface-conduction emission type electron-emitting devices have a simple structure and can be easily manufactured, and thus many devices can be formed on a wide area. As disclosed in Japanese Patent Laid-Open No. 64-31332 filed by the present applicant, a method of arranging and driving a lot of devices has been studied.

Known examples of the FE type electron-emitting devices are described in W. P. Dyke and W. W. Dolan, "Field emission," Advance in Electron Physics, 8, 89 (1956) and C. A. Spindt, "Physical properties of thin-film field emission cathodes with molybdenium", J. Appl. Phys., 47, 5248 (1976).

FIG. 20 is a sectional view showing the device by C. A. Spindt et al. described above as a typical example of the FE type device structure. In FIG. 20, reference numeral 3010 denotes a substrate; 3011, an emitter wiring made of a conductive material; 3012, an emitter cone; 3013, an insulating layer; and 3014, a gate electrode. In this device, an appropriate voltage is applied between the emitter cone 3012 and gate electrode 3014 to emit electrons from the distal end portion of the emitter cone 3012. As another FE type device structure, there is an example in which an emitter and gate electrode are arranged on a substrate to be almost parallel to the surface of the substrate, in addition to the multilayered structure of FIG. 20.

A known example of the MIM type electron-emitting devices is described in C. A. Mead, "Operation of Tunnel-Emission Devices", J. Appl. Phys., 32,646 (1961). FIG. 21 shows a typical example of the MIM type device structure. FIG. 21 is a sectional view of the MIM type electron-emitting device. In FIG. 21, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Since the cold cathode device can emit electrons at a lower temperature than a hot cathode device, it does not require any heater. The cold cathode is simpler in structure than the hot cathode device and can shrink in feature size. Even if a large number of devices can be arranged at a high density, they are almost free from problems such as heat fusion of the substrate. In addition, the response speed of the hot cathode device is low because it operates upon heating. To the contrary, the response speed of the cold cathode device is high. For this reason, applications of the cold cathode devices have enthusiastically been studied.

Of cold cathode devices, the above surface-conduction emission type electron-emitting devices have a simple structure and can be easily manufactured, and thus many devices can be formed on a wide area. As disclosed in Japanese Patent Laid-Open No. 64-31332 filed by the present applicant, a method of arranging and driving a lot of devices has been studied.

Regarding applications of the surface-conduction emission type electron-emitting devices to, e.g., image forming apparatuses such as an image display apparatus and an image recording apparatus, charge beam sources, and the like have been studied.

Particularly as an application to image display apparatuses, as disclosed in the U.S. Pat. No. 5,066,883 and Japanese Patent Laid-Open Nos. 2-257551 and 4-28137 filed by the present applicant, an image display apparatus using the combination of a surface-conduction emission type electron-emitting device and a fluorescent substance which emits light upon irradiation of an electron beam has been studied. This type of image display apparatus using the combination of the surface-conduction emission type electron-emitting device and the fluorescent substance is expected to exhibit more excellent characteristics than other conventional image display apparatuses. For example, compared with recent popular liquid crystal display apparatuses, the above display apparatus is superior in that it does not require any backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat display apparatus reported by R. Meyer et al. [R. Meyer: "Recent Development on Microtips Display at LETI", Tech. Digest of 4th Int. Vacuum Microelectronics Conf., Nagahama, pp. 6-9 (1991)].

An example of an application of a larger number of MIM type electron-emitting devices arranged side by side to an image display apparatus is disclosed in Japanese Patent Laid-Open No. 3-55738 filed by the present applicant.

The present inventors have examined surface-conduction emission type electron-emitting devices of various materials, various manufacturing methods, and various structures, in addition to the above-mentioned conventional surface-conduction emission type electron-emitting devices. Further, the present inventors have made extensive studies on a multi electron source having a large number of surface-conduction emission type electron-emitting devices, and an image display apparatus using this multi electron source. The present inventors have examined a multi electron source having an electrical wiring method shown in, e.g., FIG. 22. That is, a large number of surface-conduction emission type electron-emitting devices are two-dimensionally arranged in a matrix to obtain a multi electron source, as shown in FIG. 22.

Referring to FIG. 22, reference numeral 4001 denotes a surface-conduction emission type electron-emitting device; 4002, a row-direction wiring; and 4003, a column-direction wiring. The row- and column-direction wirings 4002 and 4003 actually have finite electrical resistances, which are represented as wiring resistances 4004 and 4005 in FIG. 22. This wiring method is called a simple matrix wiring method. For illustrative convenience, the multi electron source is illustrated in a 6×6 matrix, but the size of the matrix is not limited to this. For example, in a multi beam source for an image display apparatus, the number of devices enough to perform desired image display are arranged and wired.

In a multi electron source constituted by arranging surface-conduction emission type electron-emitting devices in a simple matrix, appropriate electrical signals are applied to the row- and column-direction wirings 4002 and 4003 to output a desired electron beam. For example, to drive the surface-conduction emission type electron-emitting devices on an arbitrary row in the matrix, a selection potential Vs is applied to the row-direction wiring 4002 on a selected row, and at the same time a non-selection potential Vns is applied to the row-direction wirings 4002 on an unselected row. In synchronism with this, a driving potential Ve for outputting an electron beam is applied to the column-direction wiring 4003. According to this method, when voltage drops across the wiring resistances 4004 and 4005 are neglected, a voltage (Ve−Vs) is applied to the surface-conduction emission type electron-emitting devices on the selected row, while a voltage (Ve−Vns) is applied to the surface-conduction emission type electron-emitting devices on the unselected row. When the potentials Ve, Vs, and Vns are set to appropriate magnitudes, an electron beam having a desired intensity must be output from only the surface-conduction emission type electron-emitting devices on the selected row. When different driving voltages Ve are applied to respective column-direction wirings, electron beams having different intensities must be output from the respective devices on the selected row. Since the surface-conduction emission type electron-emitting device has a high response speed, a change in length of time for which the driving voltage Ve is applied necessarily causes a change in length of time for which an electron beam is output.

The device application voltage (Ve−Vs) in selection will be called Vf.

As another method of obtaining an electron beam from a multi electron source having a simple matrix wiring, column-direction wirings are connected to not a voltage source for applying the driving potential Ve but a current source for applying a driving current. The selection potential Vs is applied to a row-direction wiring on a selected row, and at the same time the non-selection potential Vns is applied to a row-direction wiring on an unselected row. Then, an electron beam can be obtained from only the devices on the selected row owing to a strong threshold characteristic of the surface-conduction emission type electron-emitting device. The current flowing through the electron source will be called a device current If, and an emitted electron beam current will be called an emission current Ie.

The multi electron source constituted by arranging surface-conduction emission type electron-emitting devices in a simple matrix has a variety of applications. For example, when an electrical signal corresponding to image information is appropriately applied, the multi electron source can be suitably used as an electron source for an image display apparatus.

An object of the present invention is to realize an arrangement capable of more accurately displaying an image.

SUMMARY OF THE INVENTION

One aspect of an image display apparatus according to the present invention has the following arrangement.

An image display apparatus comprises a plurality of display devices, and a driving circuit for applying signals having different fall timings to the display devices, wherein the driving circuit causes the signal to fall in a plurality of steps.

Another aspect of the image display apparatus according to the present invention has the following arrangement.

An image display apparatus comprises a plurality of display devices, and a driving circuit for applying signals having different fall timings to the display devices, wherein when the signal is to fall from a predetermined level of a display state to a predetermined level of a non-display state, the driving circuit changes an operation state of a signal fall circuit between the predetermined level of the display state and the predetermined level of the non-display state.

The signal level is, e.g., the potential magnitude of a signal supplied to a device or wiring connected to the device.

Still another aspect of the image display apparatus according to the present invention has the following arrangement.

An image display apparatus comprises a plurality of display devices, and a driving circuit for applying signals having different fall timings to the display devices, wherein the display circuit has a plurality of charge paths for changing a signal level from a predetermined level of a display state to a predetermined level of a non-display state, and when the signal is to fall, changes operation states of the plurality of charge paths between the predetermined level of the display state and the predetermined level of the non-display state.

The charge paths can adopt various controllable forms. For example, if the image display apparatus uses a voltage source for applying a predetermined potential (or GND), charges can quickly move until a given potential as the signal level of the display state reaches a predetermined potential applied by the voltage source, thereby immediately bringing the signal level close to the signal level of the non-display state. Alternatively, if the image display apparatus uses a current source capable of flowing a predetermined current, charges can move at a desired speed, thereby bringing the signal level close to the signal level of the non-display state at a desired speed.

In addition, the plurality of charge paths can be variously combined. For example, the image display apparatus can use a combination of charge paths (the voltage source and current source, or the like) having different change amounts per unit time of the signal level when the signal level falls. In this case, the plurality of charge paths may exclusively operate. The image display apparatus may use a plurality of charge paths which can operate parallel, and may control the fall of the signal level by controlling the number of parallel-operating charge paths. The plurality of charge paths arranged parallel may be controlled to operate at different timings. Each of the charge paths may use a circuit having a transition threshold between the ON and OFF states, the threshold may be changed between the plurality of charge paths, and the number of parallel-operating charge paths may be automatically changed depending on the signal level.

The operation states of the plurality of charge paths can be changed so that a time required to change the signal level from the predetermined level of the display state to a first level as a threshold level at which the display device operates or a level at which a display luminance by the display device becomes substantially 0 is set to be shorter than a time required to change the signal level from the first level to a reference level as the predetermined level of the non-display state. With this arrangement, when the signal level falls, it can immediately change to the non-display state (e.g., non-emission state), and then can come close to the reference level while suppressing the influence of crosstalk.

The operation states of the plurality of charge paths are preferably changed at a boundary of a threshold level at which the display device operates or the vicinity, or a level at which a display luminance by the display device becomes substantially 0 or the vicinity.

The image display apparatus preferably further comprises a circuit for determining the operation states of the plurality of charge paths. This circuit can determine whether to perform the above-described fall control of the signal level.

It is preferable that the image display apparatus further comprise, in correspondence with the plurality of display devices, wirings for supplying signals to the plurality of display devices, and the circuit for determining the operation states of the plurality of charge paths determines the operation states of the plurality of charge paths in accordance with levels of signals supplied to wirings except for a wiring connected to a controlled charge path.

It is preferable that the image display apparatus further comprise, in correspondence with the plurality of display devices, wirings for supplying signals to the plurality of display devices, and the circuit for determining the operation states of the plurality of charge paths determines the operation states of the plurality of charge paths in accordance with levels of signals supplied to wirings adjacent to a wiring connected to a controlled charge path.

The signal can be an image signal or pulse-width-modulated signal.

The driving circuit preferably comprises a rise circuit for raising a signal level separately from a fall circuit for causing the signal level to fall. As the rise circuit, e.g., a current source or voltage source can be used.

The plurality of display devices can be connected in a matrix by a plurality of scanning signal wirings and a plurality of modulated-signal wirings perpendicular to the scanning signal wirings. In this arrangement, the driving circuit may be connected to the modulated-signal wirings.

The scanning signal wirings are preferably connected to a scanning circuit for applying a predetermined potential to a scanning signal wiring selected from the plurality of scanning signal wirings. In this case, the driving circuit can be connected to the modulated-signal wirings, and apply a potential for driving the display device by a potential difference from the predetermined potential applied to a scanning signal wiring selected by the scanning circuit.

As the display devices, various devices can be used. For example, electron-emitting devices can be used. In this case, an image can be displayed using light-emitting substances for emitting light by electrons emitted by the electron-emitting devices. EL devices can also be used. As the electron-emitting devices, FE type devices, MIM type devices, surface-conduction emission type devices, and the like can be used.

One aspect of an image display method according to the present invention has the following steps.

An image display method of driving a plurality of display devices by applying signals having different fall timings, comprises causing the signal to fall in a plurality of steps.

Another aspect of the image display method according to the present invention has the following steps.

An image display method of driving a plurality of display devices by applying signals having different fall timings, comprises when the signal is to fall from a predetermined level of a display state to a predetermined level of a non-display state, changing an operation state of a signal fall circuit between the predetermined level of the display state and the predetermined level of the non-display state.

Still another aspect of the image display method according to the present invention has the following steps.

An image display method of driving a plurality of display devices by applying signals having different fall timings, comprises when the signal is to fall, changing operation states of the plurality of charge paths between a predetermined level of a display state and a predetermined level of a non-display state using a plurality of charge paths for changing a signal level from the predetermined level of the display state to the predetermined level of the non-display state.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute part of the specification, illustrate embodiments of the invention and, together with the descriptions, serve to explain the principle of the invention.

FIG. 18 is a block diagram showing a multi-functional image display apparatus using the image display apparatus according to the embodiment of the present invention;

DETAILED DESCRIPTION OF THE PREFERRED EMBODIMENTS

A display device can output a desired beam by applying a driving voltage or driving current and performing pulse width modulation. In addition, a method of applying the driving current or a method of limiting the current in the case of applying the driving voltage can be employed to suppress ringing upon application (rise) of a pulse that is caused by the inductance component of a wiring having a finite length from the driving means to a multi electron source, a capacitance component between adjacent wirings, a stray capacitance component, and the like. At the application end (fall) of a pulse, a switching means can be employed to apply a voltage bias as a low impedance in order to quickly remove electrical charges accumulated in the stray capacitance and shorten the fall time. These means allow driving each device while preventing ringing which exceeds the rated value of an application voltage to the multi electron source.

However, even this arrangement suffers other problems.

Figure 2:
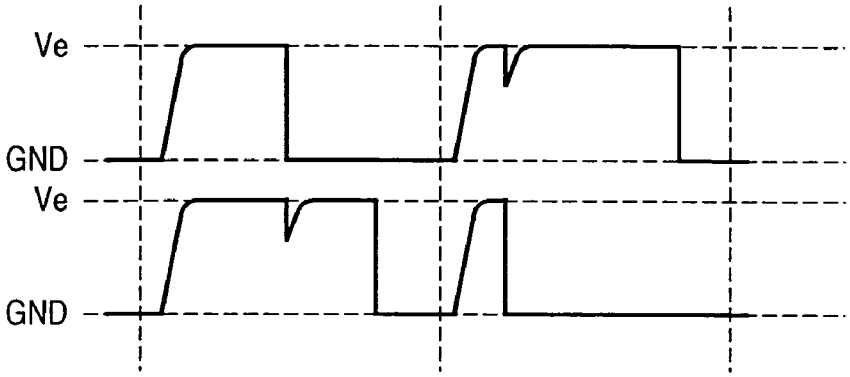
FIG. 2 is a timing chart for explaining the problem of the present invention.

That is, as shown in FIG. 2, when pulse signals having different pulse widths are applied between two (or more) adjacent wirings, a longer-width pulse is influenced by an adjacent pulse signal which falls faster due to an inter-wiring capacitance, and the signal level decreases to reduce the effective application amount. In gradation expression with the pulse width, this phenomenon causes a gradation error under the influence of an adjacent wiring. Particularly when a large-screen panel is to be constituted, the inter-wiring capacitance increases, resulting in a large gradation error.

Before a detailed description of the first embodiment according to the present invention, the first reference example will explained.

FIRST REFERENCE EXAMPLE

Figure 1:
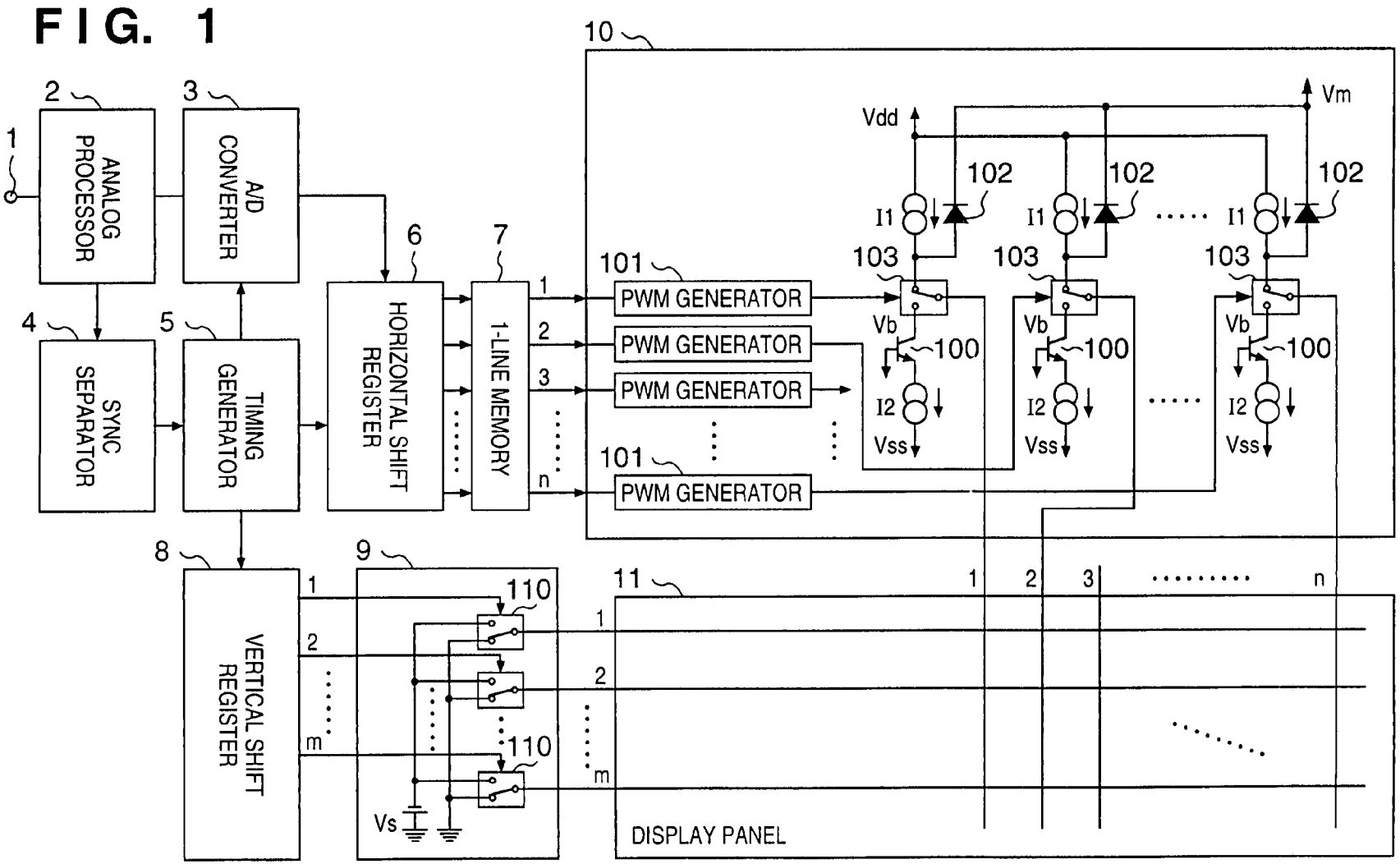
FIG. 1 is a block diagram showing the circuit arrangement of an image display apparatus according to the first reference example of the present invention.
Figure 3:
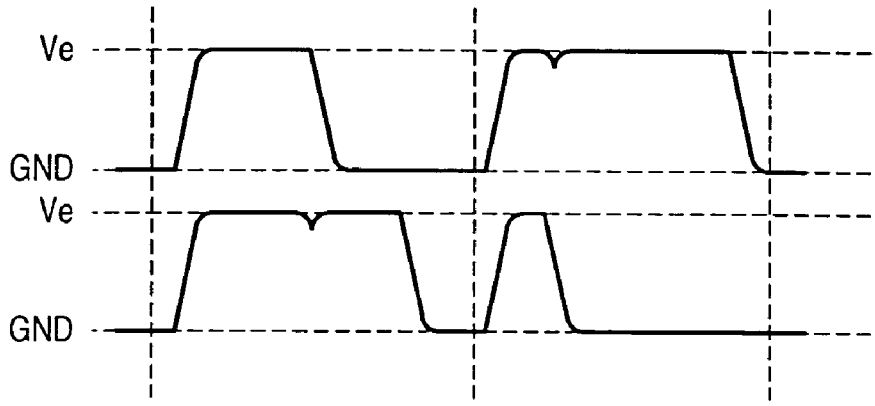
FIG. 3 is a timing chart for explaining operation of the circuit in FIG. 1.
Figure 4:
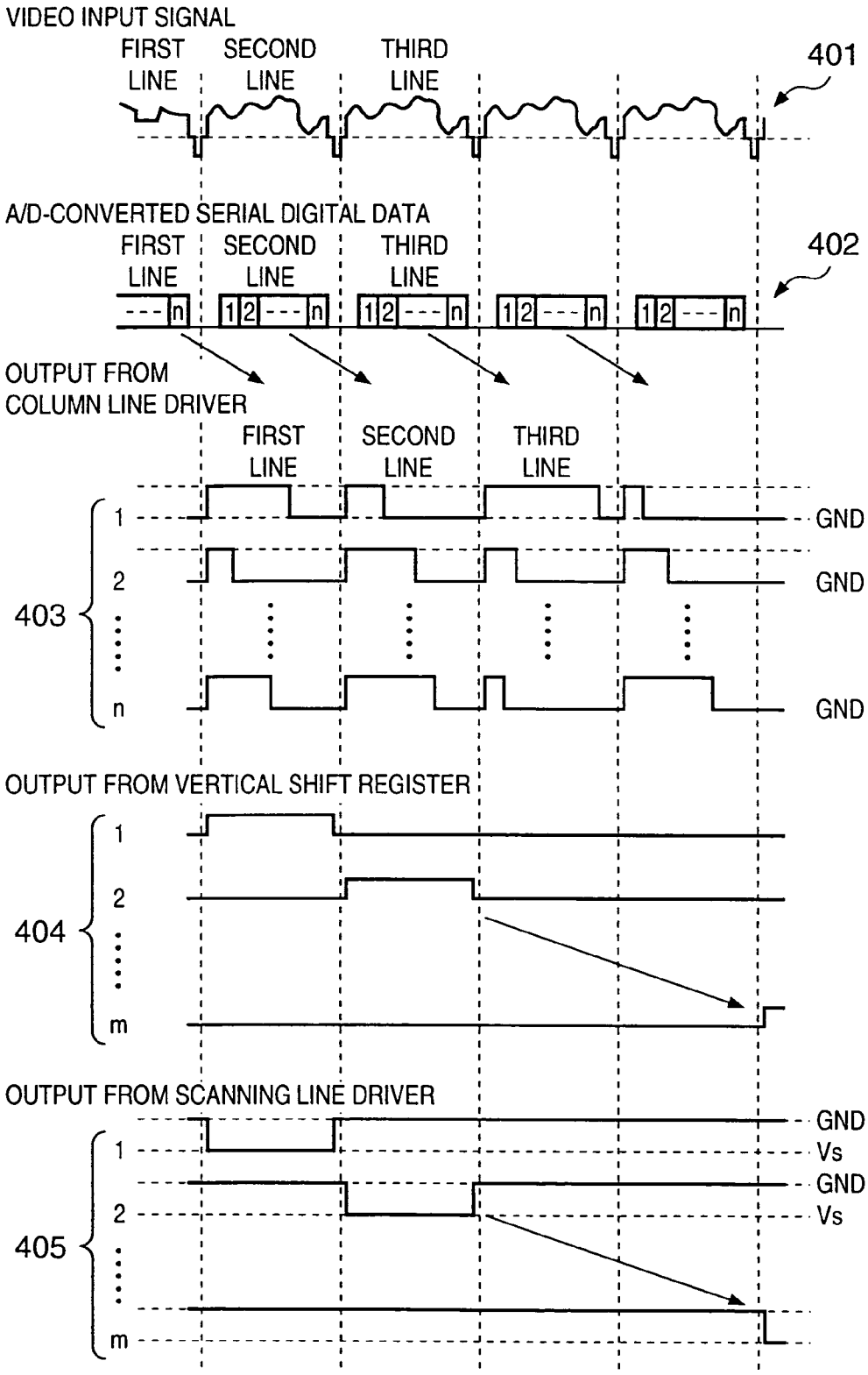
FIG. 4 is a timing chart for explaining the operation timing of an image display apparatus according to each of the first reference example and first embodiment of the present invention.

FIG. 1 is a block diagram showing the circuit arrangement of an image display apparatus according to the first reference example, FIG. 3 is a timing chart for explaining the effects of the circuit in FIG. 1, and FIG. 4 is a waveform chart showing the signal timings of respective parts in FIG. 1.

In FIG. 1, reference numeral 11 denotes a display panel constituted by arranging a plurality of surface-conduction emission type electron-emitting devices having a device voltage vs. emission current characteristic (to be described later) in an m×n matrix; 1, a video signal input terminal for inputting a video signal; 2, an analog signal processor for clamping the black level of an analog video signal, adjusting the amplitude level, and limiting the band in order to digitize a video luminance signal with a predetermined number of gray levels in an A/D converter 3; 4, a sync separator for separating sync signals (horizontal and vertical sync signals, and the like) from an input video signal; and 5, a timing generator for receiving sync signals output from the sync separator 4 and supplying timing signals necessary for the A/D converter 3 and various units.

The A/D converter 3 converts an analog video luminance signal into n serial digital signals per horizontal period, and outputs the digital signals. These digital signals are sent to and held by a horizontal shift register 6 where they are converted into parallel signals, and sent to and stored in a 1-line memory 7. A column wiring driver 10 comprises, in units of column wirings, current sources I1 each for applying a current to a corresponding column wiring via a switching circuit 103 when an output pulse signal from a PWM generator 101 (to be described below) corresponding to input luminance data is ON, transistors 100 each for driving a corresponding column wiring by a current limited by a current source 12 via the switching circuit 103 when luminance data is OFF, and PWM generators (PWM GEN) 101 each for outputting a signal having a pulse width proportional to luminance data for turning on/off the transistor 100. The switching circuit 103 flows a current from the current source I1 to a column wiring when a pulse signal (luminance data) from the PWM generator (PWM GEN) 101 is at high level, and connects the column wiring to the transistor 100 when the pulse signal changes to low level. The column wiring driver 10 also comprises diodes 102 each for clipping a column wiring application potential to Vm, as protection means for preventing a potential applied to the device from exceeding the rated value when luminance data is at high level. Note that a potential Vas connected to the current source 12 of the column wiring driver 10 may be at ground level or about several negative V, and a potential Vdd is almost equal to the potential Ve in FIG. 3.

A row wiring driver 9 has switching circuits 110 each for selecting whether to apply a DC potential bias Vs to a row wiring or to ground the row wiring in units of rows of the display panel 11. The row wiring driver 9 sequentially switches connection of the switching circuits 110 in accordance with output signals from a vertical shift register 8, and sequentially applies the DC potential bias Vs to the respective rows of the display panel 11, thereby sequentially scanning and driving the respective lines of the display panel 11. The vertical shift register receives, e.g., a horizontal sync signal from the timing generator 5, and outputs a signal so as to sequentially switch and select row wirings every time it receives the horizontal sync signal.

On the waveform of a driving potential for the column wiring, a decrease in effective voltage by the stray capacitance between adjacent column wirings is improved by limiting the current, as shown in FIG. 3, when the pulse signal is OFF (falls) as shown in FIG. 2.

Operation of the circuit in FIG. 1 will be described with reference to FIG. 4.

In FIG. 4, reference numeral 401 denotes an analog video signal input to the video signal input terminal 1; 402, digital data for each line which is obtained by A/D-converting an analog video signal and input to the column wiring driver 10 via the horizontal shift register 6 and 1-line memory 7; 403, pulse-width-modulated signals for one line, i.e., output from n pulse width modulation circuits 101, each of which has a pulse width corresponding to the luminance of digital luminance data; 404, output signals from the vertical shift register 8 which sequentially switch and select row wirings every time the shift register 8 receives a horizontal sync signal; and 405, potentials applied to respective row wirings, which represent that the potential Vs is applied to row wirings selected by output signals from the vertical shift register 8.

In this example, the pulse rise time is long owing to driving by the current source I1, The same effects can be attained even for a short driving signal rise time when, for example, the voltage source is used for driving up to a given potential, and then the current source operates.

First Embodiment

The first embodiment of the present invention will be described in detail.

Figure 5:
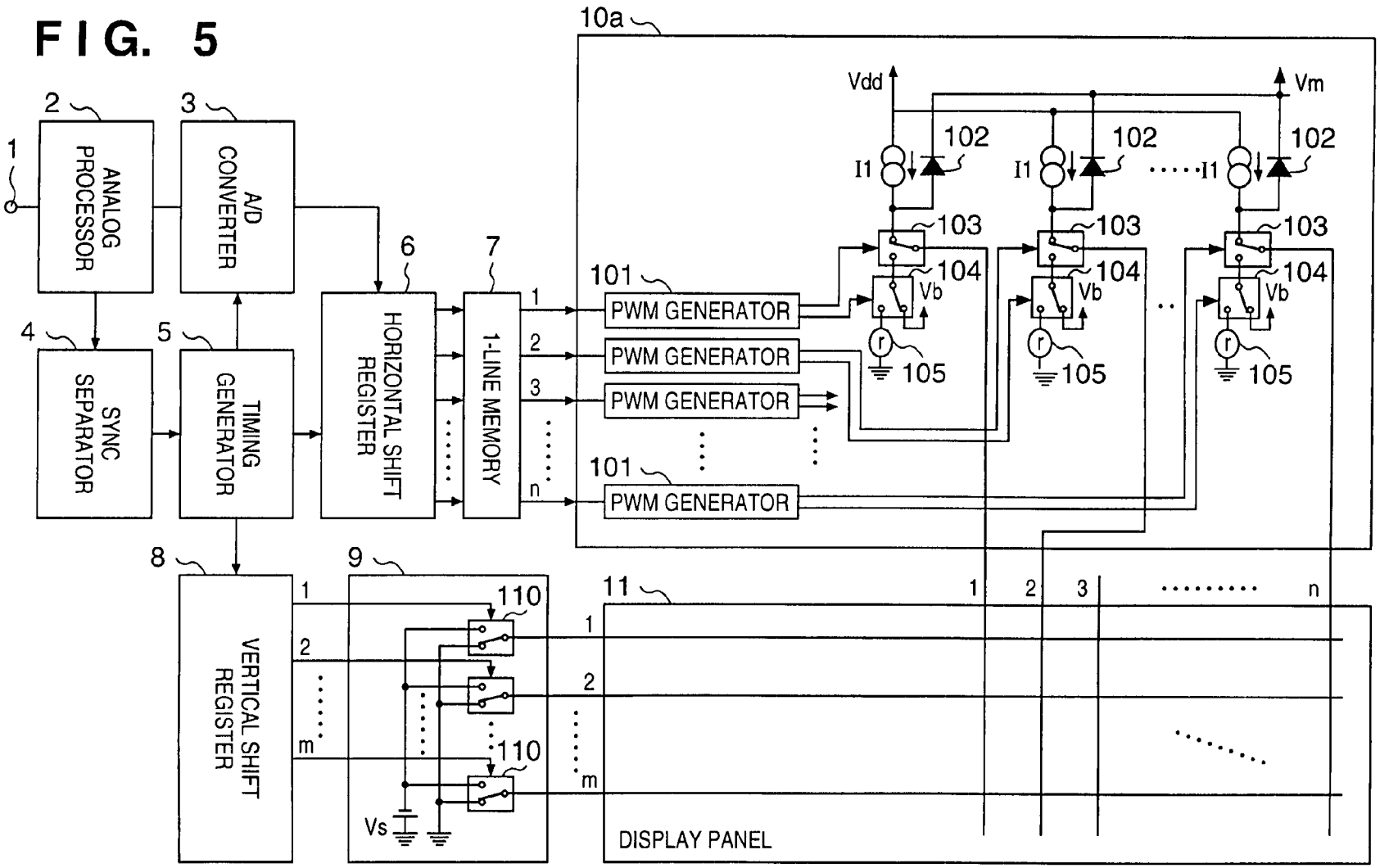
FIG. 5 is a block diagram showing the circuit arrangement of an image display apparatus according to the first embodiment of the present invention.

FIG. 5 is a block diagram showing the circuit arrangement of an image display apparatus according to the first embodiment of the present invention. The same reference numerals as in FIG. 1 denote the same parts, and a description thereof will be omitted.

A column wiring driver 10*a* comprises, in units of column wirings, current sources I1 each for applying a current when luminance data (pulse signal) is ON, and switching circuits 104 each for switching whether to apply a DC bias potential (ground level) current-limited by a resistor 105 (r) or to apply a DC bias Vb when the luminance data is OFF. Each PWM generator (PWM GEN) 101 applies the DC bias Vb in a short period immediately when a pulse signal starts falling, and then applies a current-limited ground-level bias via the resistor 105. Note that the application potential is similarly clipped to Vm by diodes 102 as protection means for preventing a potential applied to the column wiring from exceeding the rated value when the current source I1 supplies a current.

Figure 6:
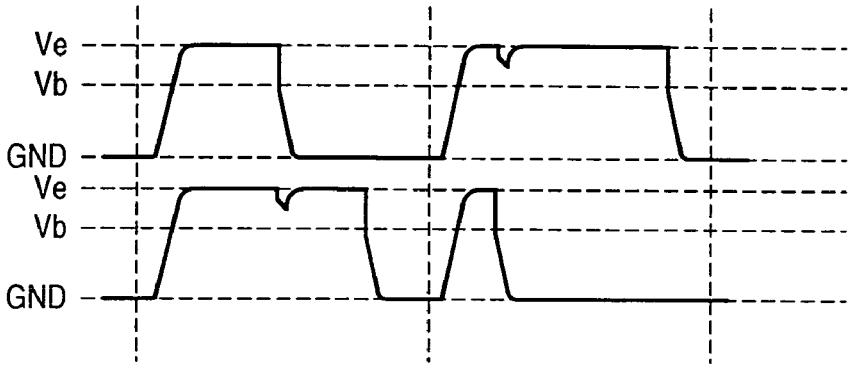
FIG. 6 is a timing chart for explaining the effects of the circuit in FIG. 5.

This arrangement makes a potential waveform applied to the column wiring steeply rise up to the potential Vb and then moderately fall based on a time constant determined by the current limitation resistor 105 and the stray capacitance component of the wiring, as shown in FIG. 6. This effect can reduce a decrease in effective voltage caused by crosstalk as shown in FIG. 2, thereby improving the decrease in effective voltage.

The arrangement of the first embodiment suppresses crosstalk by performing the step of causing a pulse signal to fall to the middle and the step of causing the pulse signal to fall to the reference potential, instead of the step of causing the pulse signal to fall at once. In the first half of the fall of a pulse signal, the pulse signal quickly falls to immediately change the emission state to a low-luminance state or non-emission state. In this case, it is effective to quickly decrease the voltage up to a voltage around the threshold voltage at which the device starts to emit electrons. Such voltage can satisfactorily follow the display luminance even with a small voltage width (Ve−Vb) for a steep fall particularly in a display panel using a surface-conduction emission type electron-emitting device with a steep threshold for the driving voltage vs. emission luminance (device emission current) characteristic (to be described later).

Operation of the circuit in FIG. 5 is the same as in the timing chart of FIG. 4, and a description thereof will be omitted.

<Manufacturing Method and Application of Surface-Conduction Emission Type Electron-Emitting Device Used in Embodiment of Present Invention>

Figure 7:
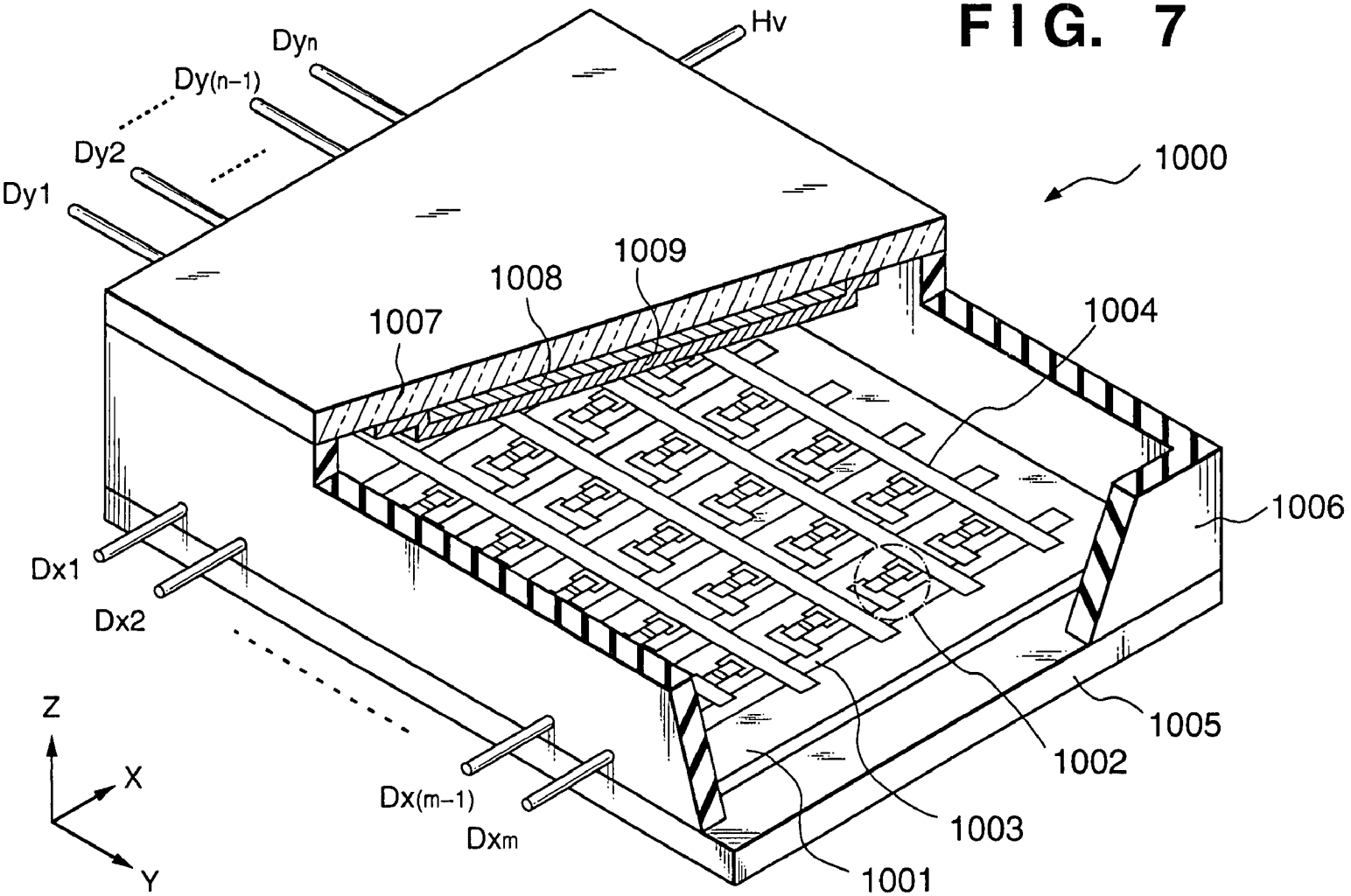
FIG. 7 is a partially cutaway perspective view showing the display panel of an image display apparatus according to the embodiment of the present invention.

FIG. 7 is a partially cutaway outer perspective view of a display panel 1000 used in this embodiment showing the internal structure of the display panel 1000.

In FIG. 7, reference numeral 1005 denotes a rear plate; 1006, a side wall; and 1007, a face plate. These parts 1005 to 1007 constitute an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed thereon, on which N×M surface-conduction emission type electron-emitting devices 1002 are formed (N, M=positive integer equal to 2 or more, properly set in accordance with a desired number of display pixels. For example, in a display apparatus for high-resolution television display, preferably N=3,000 or more, M=1,000 or more. In this embodiment, N=3,072 or more, M=1,024.) The N×M surface-conduction emission type electron-emitting devices 1002 are arranged in a simple matrix with M row-direction wirings 1003 and N column-direction wirings 1004. The portion constituted by the components denoted by references 1001 to 1004 will be referred to as a multi electron source. The manufacturing method and structure of the multi electron source will be described in detail later.

In this embodiment, the substrate 1001 of the multi electron source is fixed to the rear plate 1005 of the airtight container. If, however, the substrate 1001 of the multi electron source has sufficient strength, the substrate 1001 of the multi electron source may also serve as the rear plate of the airtight container.

Figure 8A:
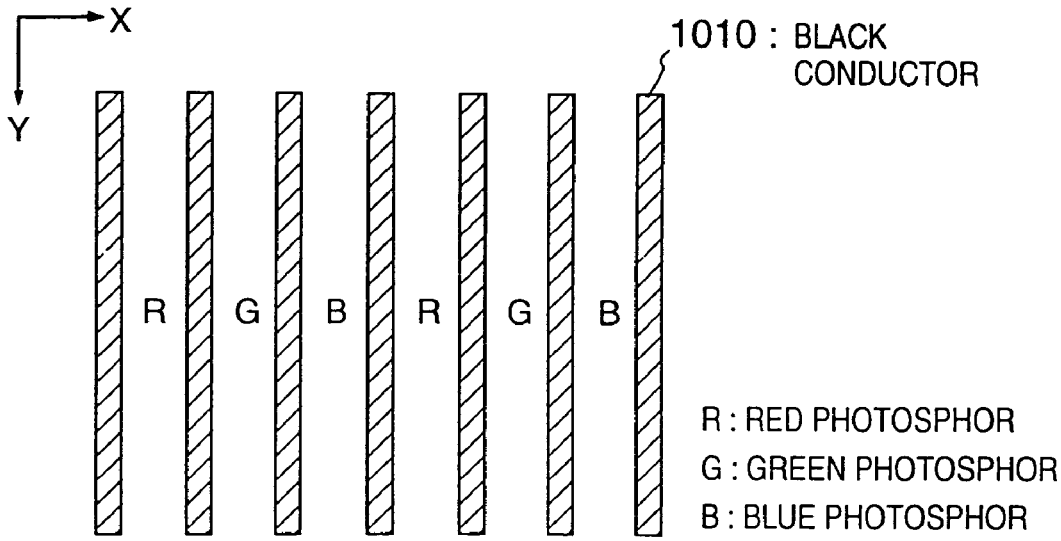
FIGS. 8A and 8B are plan views showing examples of the layout of fluorescent substances on the face plate of the display panel according to this embodiment.

A fluorescent film 1008 is formed on the lower surface of the face plate 1007. As the display panel 1000 of this embodiment is for color display, the fluorescent film 1008 is coated with red (R), green (G), and blue (B) fluorescent substances, i.e., three primary color fluorescent substances used in the CRT field. As shown in FIG. 8A, the respective color fluorescent substances are formed into a striped structure, and black conductive members 1010 are provided between the stripes of the fluorescent substances of the respective color. The purpose of providing the black conductive members 1010 is to prevent display color misregistration even if the electron irradiation position is shifted to some extent, to prevent degradation of display contrast by shutting off reflection of external light, to prevent the charge-up of the fluorescent film by electrons, and the like. As a material for the black conductive members 1010, graphite is used as a main component, but other materials may be used so long as the above purpose is attained.

Figure 8B:
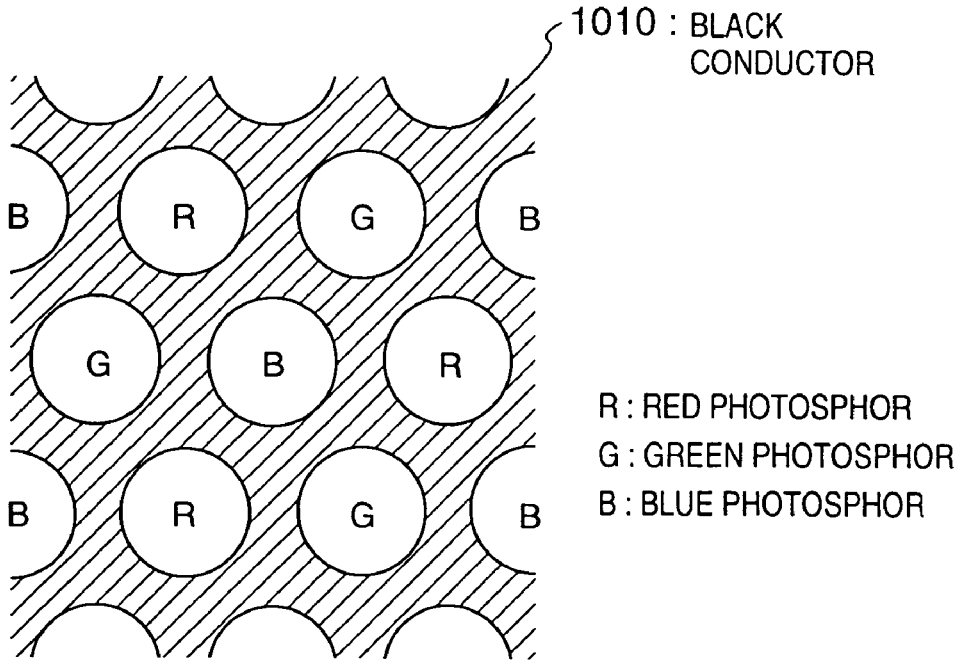

Further, the three primary colors of the fluorescent film are not limited to the stripes as shown in FIG. 8A. For example, delta arrangement as shown in FIG. 8B or any other arrangement may be employed. Note that when a monochrome display panel is formed, a single-color fluorescent substance may be applied to the fluorescent film 1008, and the black conductive member may be omitted.

Furthermore, a metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron accelerating voltage, to be used as a conductive path for electrons which excited the fluorescent film 1008, and the like. The metal back 1009 is formed by forming the fluorescent film 1008 on the face plate substrate 1007, smoothing the front surface on the fluorescent film , and depositing aluminum thereon by vacuum deposition. Note that when fluorescent substances for a low voltage are is used for the fluorescent film 1008, the metal back 1009 is not used.

Furthermore, for application of an accelerating voltage or improvement of the conductivity of the fluorescent film, transparent electrodes made of, e.g., ITO may be provided between the face plate substrate 1007 and the fluorescent film 1008, although such electrodes are not used in this embodiment.

Dx1 to DxM, Dy1 to DyN, and Hv are electric connection terminals for an airtight structure provided to electrically connect the display panel 1000 to an electric circuit (not shown). Dx1 to DxM are electrically connected to the row-direction wirings 1003 of the multi electron source; Dy1 to DyN, to the column-direction wirings 1004 of the multi electron source; and Hv, to the metal back 1009 of the face plate.

To evacuate the airtight container, after forming the airtight container, an exhaust pipe and vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by a heater or RF heating. The suction effect of the getter film maintains a vacuum of $1\times10^{-5}$ or $1\times10^{-7}$ Torr in the airtight container.

The basic arrangement and manufacturing method of the display panel 1000 according to this embodiment of the present invention have been briefly described above.

A method of manufacturing the multi electron source used in the display panel 1000 of this embodiment will be described below. In the multi electron source used in the image display apparatus of this embodiment, any material, shape, and manufacturing method for cold cathode devices may be employed as long as the electron source is constituted by arranging surface-conduction emission type electron-emitting devices in a simple matrix. Therefore, cold cathode devices such as surface-conduction emission type electron-emitting devices, FE type devices, or MIM type devices can be used. However, the present inventors have found that among the surface-conduction emission type electron-emitting devices, an electron source having an electron-emitting portion or its peripheral portion consisting of a fine particle film is excellent in electron-emitting characteristic and can be easily manufactured. Such a device can therefore be most suitably used for the multi electron source of a high-brightness, large-screen image display apparatus. For this reason, in the display panel of this embodiment, surface-conduction emission type electron-emitting devices each having an electron-emitting portion or its peripheral portion made of a fine particle film are used. The basic structure, manufacturing method, and characteristics of the preferred surface-conduction emission type electron-emitting device will be described first. The structure of the multi electron source having many devices arranged in a simple matrix will be described later.

(Preferred Structure and Manufacturing Method of Surface-Conduction Emission Type Electron-Emitting Device)

Typical examples of surface-conduction emission type electron-emitting devices each having an electron-emitting portion or its peripheral portion made of a fine particle film include two types of devices, namely flat and step type devices.

(Flat Surface-Conduction Emission Type Electron-Emitting Device)

Figure 9A:
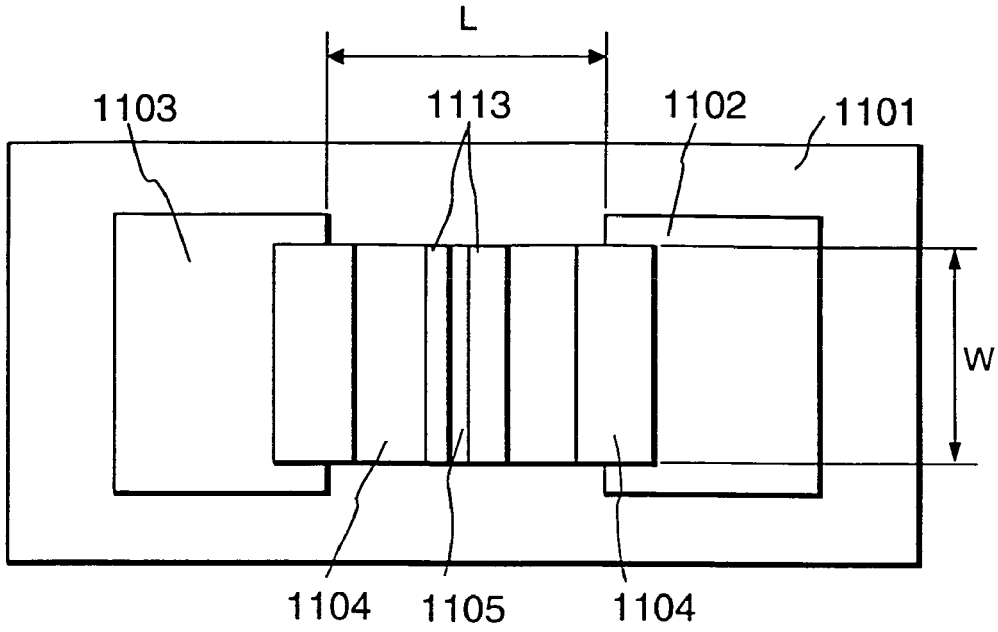
FIG. 9A is a plan view showing a flat surface-conduction emission type electron-emitting device used in this embodiment.
Figure 9B:
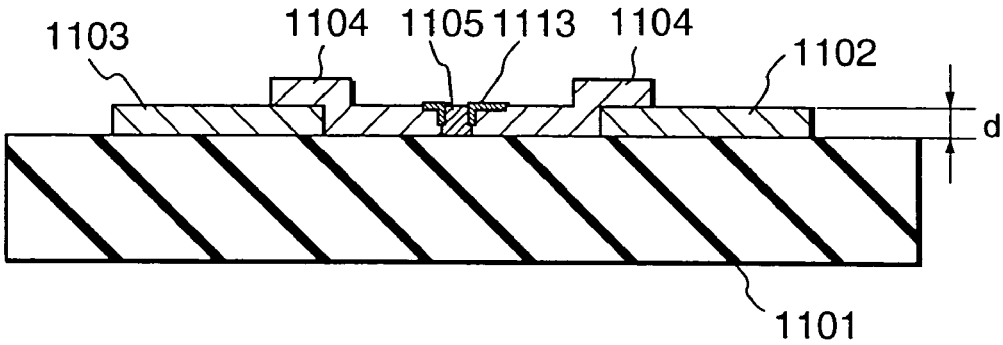
FIG. 9B is a sectional view thereof.

First, the structure and manufacturing method of a flat surface-conduction emission type electron-emitting device will be described. FIG. 9A is a plan view for explaining the structure of the flat surface-conduction emission type electron-emitting device, and FIG. 9B is a sectional view thereof. Referring to FIGS. 9A and 9B, reference numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with, e.g., an $SiO_2$ insulating layer formed thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrode is designed by selecting an appropriate value in a range from hundred Å to hundred μm. Most preferable range for a display apparatus is from several μm to ten μm. As for electrode thickness d, an appropriate value is selected in a range from hundred Å to several μm.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle has a diameter within a range from several Å to thousand Å. Preferably, the diameter is within a range from 10 Å to 200 Å. The thickness of the fine particle film is appropriately set in consideration of conditions as follows. That is, condition necessary for electrical connection to the device electrode 1102 or 1103, condition for the forming processing to be described later, condition for setting electrical resistance of the fine particle film itself to an appropriate value to be described later etc. Specifically, the thickness of the film is set in a range from several Å to thousand Å, more preferably, 10 Å to 500 Å.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIGS. 9A and 9B, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than peripheral conductive thin film. The fissure is formed by the forming processing to be described later on the conductive thin film 1104. In some cases, particles, having a diameter of several Å to hundred Å, are arranged within the fissured portion. As it is difficult to exactly illustrate actual position and shape of the electron-emitting portion, therefore, FIGS. 9A and 9B show the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113, which comprises carbon or carbon compound material, covers the electron-emitting portion 1105 and its peripheral portion. The thin film 1113 is formed by the activation processing to be described later after the forming processing.

The preferred basic structure of the device is described above. In this embodiment, the device has the following constituents. That is, the substrate 1101 comprises a soda-lime glass, and the device electrodes 1102 and 1103, an Ni thin film. The electrode thickness d is 1,000 Å and the electrode interval L is 2 μm.

The main material of the fine particle film is Pd or PdO. The thickness of the fine particle film is about 100 Å, and its width W is 100 μm.

Next, a method of manufacturing a preferred flat surface-conduction emission type electron-emitting device will be described. FIGS. 10A to 10E are sectional views for explaining the manufacturing processes of the surface-conduction emission type electron-emitting device. Note that reference numerals are the same as those in FIGS. 9A and 9B.

Figure 10A:
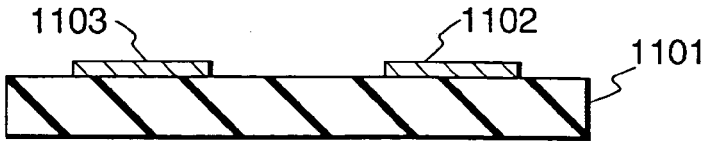
FIGS. 10A to 10E are sectional views showing the steps in manufacturing the flat surface-conduction emission type electron-emitting device.

(1) First, as shown in FIG. 10A, the device electrodes 1102 and 1103 are formed on the substrate 1101. In forming these electrodes, first, the substrate 1101 is fully washed with a detergent, pure water and an organic solvent, then, material of the device electrodes is deposited there. (As a depositing method, a vacuum film-forming technique such as evaporation and sputtering may be used.) Thereafter, patterning using a photolithography etching technique is performed on the deposited electrode material. Thus, the pair of device electrodes (1102 and 1103) shown in FIG. 10A are formed.

Figure 10B:
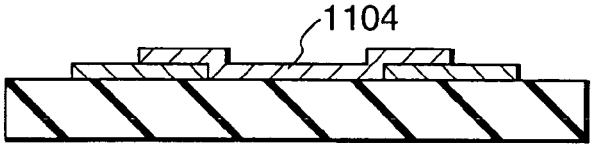

(2) Next, as shown in FIG. 10B, the conductive thin film 1104 is formed. In forming the conductive thin film 1104, first, an organic metal solvent is applied to the substrate in FIG. 10A, then the applied solvent is dried and sintered, thus forming a fine particle film. Thereafter, the fine particle film is patterned into a predetermined shape by the photolithography etching method. The organic metal solvent means a solvent of organic metal compound containing material of fine particles, used for forming the conductive thin film, as a main element. (More specifically, Pd is used as a main element in this embodiment. In this embodiment, application of organic metal solvent is made by dipping, however, any other method such as a spinner method and spraying method may be employed.)

As a film-forming method of the conductive thin film made with the fine particle film, the application of organic metal solvent used in this embodiment can be replaced with any other method such as a vacuum evaporation method, a sputtering method or a chemical vapor-phase accumulation method.

Figure 10C:
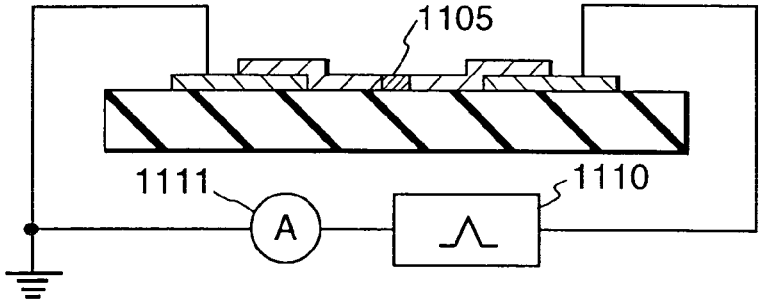

(3) Then, as shown in FIG. 10C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 made of a fine particle film to appropriately destroy, deform, or deteriorate a part of the conductive thin film, thus changing the film to have a structure suitable for electron emission. Of the conductive thin film made of the fine particle film, the portion changed for electron emission (i.e., electron-emitting portion 1105) has an appropriate fissure in the thin film. Comparing the thin film 1104 having the electron-emitting portion 1105 with the thin film before the forming processing, the electrical resistance measured between the device electrodes 1102 and 1103 has greatly increased.

Figure 11:
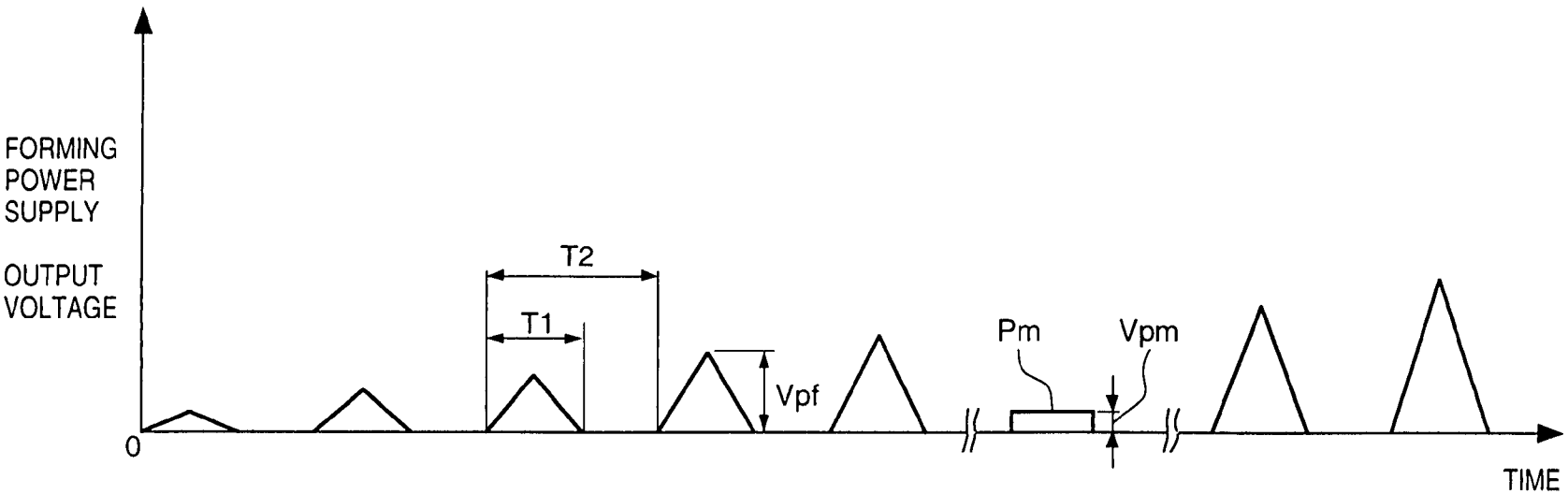
FIG. 11 is a graph showing the application voltage waveform in forming processing.

The electrification method will be explained in more detail with reference to FIG. 11 showing an example of waveform of appropriate voltage applied from the forming power source 1110. Preferably, in case of forming a conductive thin film of a fine particle film, a pulse-like voltage is employed. In this embodiment, as shown in FIG. 11, a triangular-wave pulse having a pulse width T1 is continuously applied at pulse interval of T2. Upon application, a peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electrical resistance between the device electrodes 1102 and 1103 becomes $1\times10^{6}$ Ω, i.e., the current measured by the galvanometer 1111 upon application of monitor pulse becomes $1\times10^{-7}$ A or less, the electrification of the forming processing is terminated.

Note that the above processing method is preferable to the surface-conduction emission type electron-emitting device of this embodiment. In case of changing the design of the surface-conduction emission type electron-emitting device concerning, e.g., the material or thickness of the fine particle film, or the device electrode interval L, the conditions for electrification are preferably changed in accordance with the change of device design.

Figure 10D:
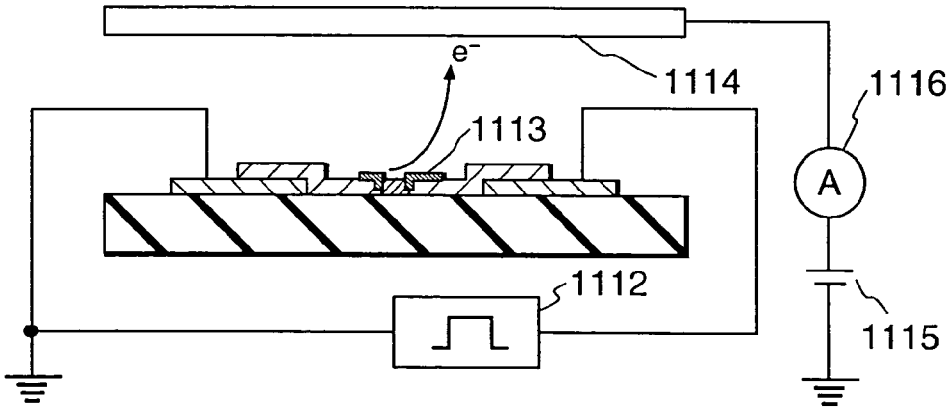

(4) Next, as shown in FIG. 10D, appropriate voltage is applied, from an activation power source 1112, between the device electrodes 1102 and 1103, and the activation processing is performed to improve electron-emitting characteristic. The activation processing here is electrification of the electron-emitting portion 1105 formed by the forming processing, on appropriate condition(s), for depositing carbon or carbon compound around the electron-emitting portion 1105. (In FIG. 10D, the deposited material of carbon or carbon compound is shown as material 1113.) Comparing the electron-emitting portion 1105 with that before the activation processing, the emission current at the same application voltage has become, typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 Å or less, more preferably, 300 Å or less.

Figure 12A:
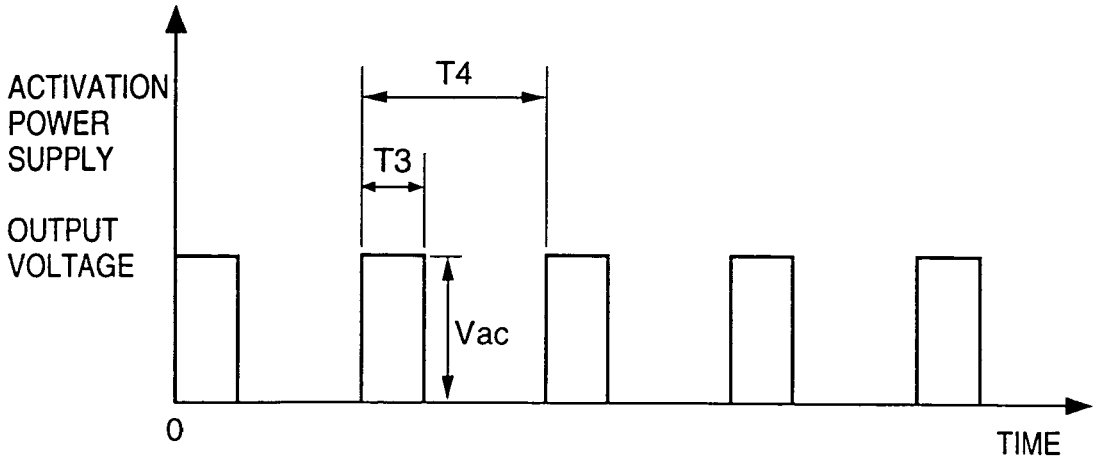
FIG. 12A is a graph showing the application voltage waveform in activation processing.

The electrification method will be described in more detail with reference to FIG. 12A showing an example of waveform of appropriate voltage applied from the activation power source 1112. In this embodiment, the activation processing is performed by periodically applying a rectangular wave at a predetermined voltage. A rectangular-wave voltage Vac is set to 14 V; a pulse width T3, to 1 msec; and a pulse interval T4, to 10 msec. Note that the above electrification conditions are preferable for the surface-conduction emission type electron-emitting device of this embodiment. In the case in which the design of the surface-conduction emission type electron-emitting device is changed, the electrification conditions are preferably changed in accordance with the change of device design.

Figure 12B:
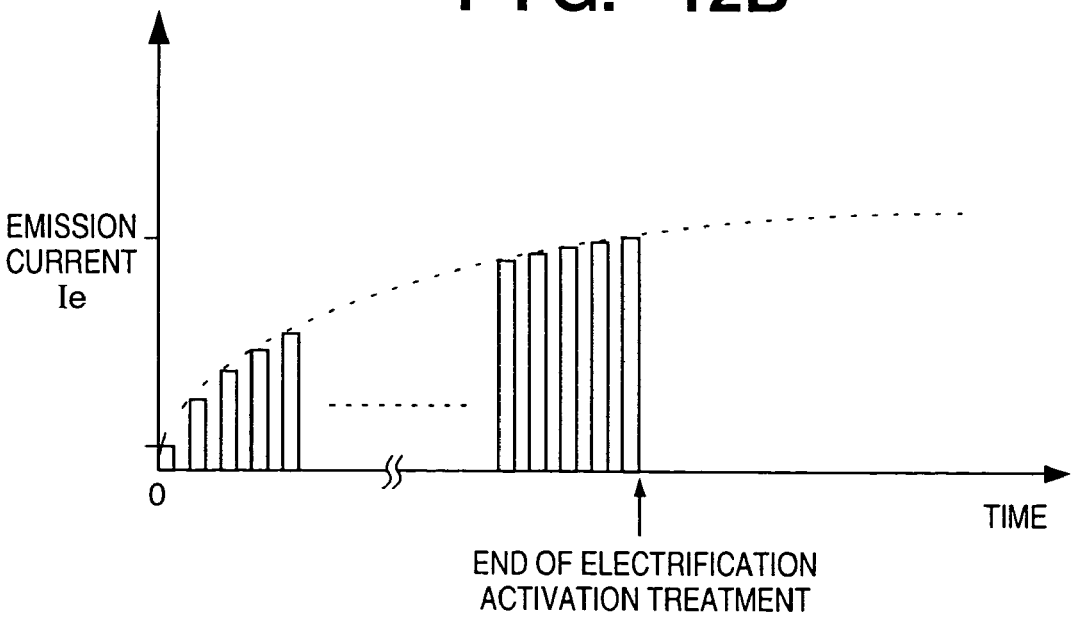
FIG. 12B is a graph showing changes in emission current Ie.

In FIG. 10D, reference numeral 1114 denotes an anode electrode, connected to a DC high-voltage power source 1115 and galvanometer 1116, for capturing emission current Ie emitted from the surface-conduction emission type electron-emitting device. (In the case in which the substrate 1101 is incorporated into the display panel before the activation processing, the fluorescent surface of the display panel is used as the anode electrode 1114.) While applying voltage from the activation power source 1112, the galvanometer 1116 measures the emission current Ie, thus monitoring the progress of activation processing, to control the operation of the activation power source 1112. FIG. 12B shows an example of the emission current Ie measured by the galvanometer 1116. As application of pulse voltage from the activation power source 1112 is started in this manner, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the surface-conduction emission type electron-emitting device of this embodiment. In case of changing the design of the surface-conduction emission type electron-emitting device, the conditions are preferably changed in accordance with the change of device design.

Figure 10E:
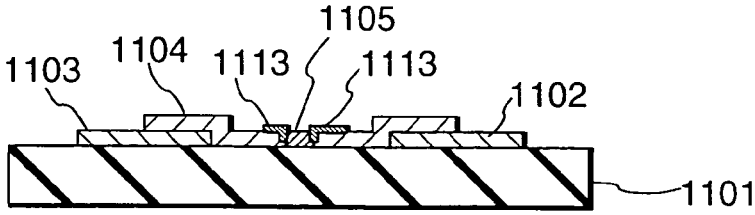

As described above, the surface-conduction emission type electron-emitting device as shown in FIG. 10E is manufactured.

(Step Surface-Conduction Emission Type Electron-Emitting Device)

Next, another typical structure of the surface-conduction emission type electron-emitting device where an electron-emitting portion or its peripheral portion is formed of a fine particle film, i.e., a stepped surface-conduction emission type electron-emitting device will be described.

Figure 13:
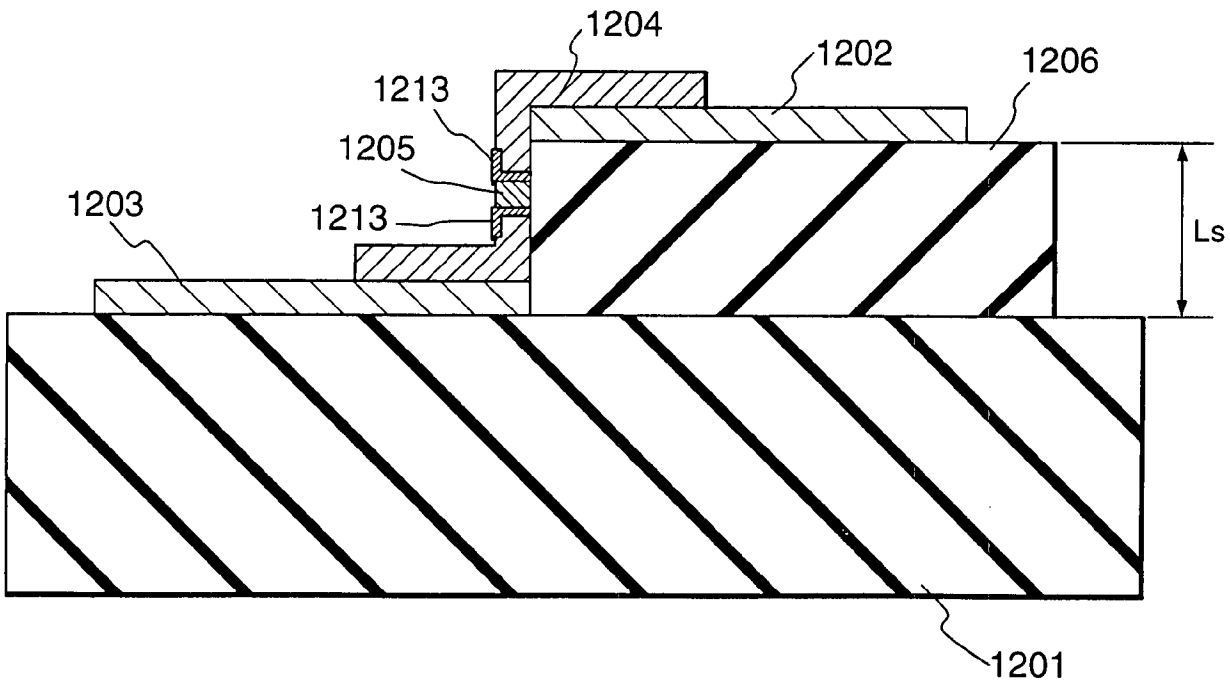
FIG. 13 is a sectional view showing a step surface-conduction emission type electron-emitting device used in this embodiment.

FIG. 13 is a sectional view schematically showing the basic construction of the step surface-conduction emission type electron-emitting device. Referring to FIG. 13, reference numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by the forming processing; and 1213, a thin film formed by the activation processing.

Difference between the step device from the above-described flat device is that one of the device electrodes (1202) is provided on the step-forming member 1206 and the conductive thin film 1204 covers the side surface of the step-forming member 1206. The device interval L in FIG. 9A is set in this structure as a height difference Ls corresponding to the height of the step-forming member 1206. Note that the substrate 1201, device electrodes 1202 and 1203, conductive thin film 1204 using the fine particle film can comprise the materials given in the explanation of the flat surface-conduction emission type electron-emitting device. Further, the step-forming member 1206 comprises electrically insulating material such as $SiO_2$.

Next, a method of manufacturing the stepped surface-conduction emission type electron-emitting device will be described with reference FIGS. 14A to 14F which are sectional views showing the manufacturing processes. In these figures, reference numerals of the respective parts are the same as those in FIG. 13.

Figure 14A:
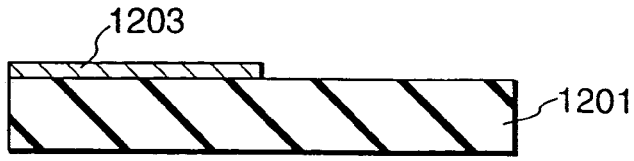
FIGS. 14A to 14F are sectional views showing the steps in manufacturing the step surface-conduction emission type electron-emitting device.

(1) First, as shown in FIG. 14A, the device electrode 1203 is formed on the substrate 1201.

Figure 14B:
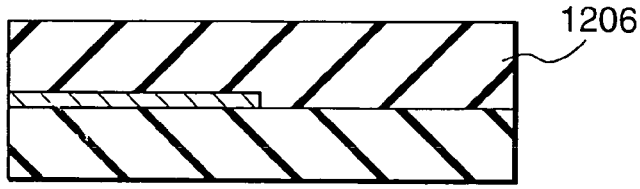

(2) Next, as shown in FIG. 14B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 14C:
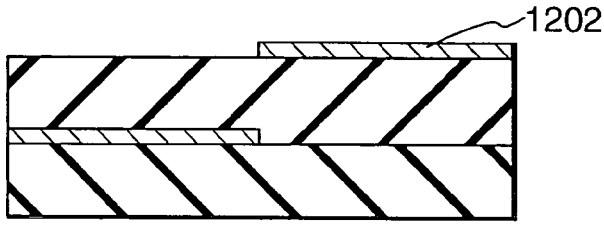

(3) Next, as shown in FIG. 14C, the device electrode 1202 is formed on the insulating layer.

Figure 14D:
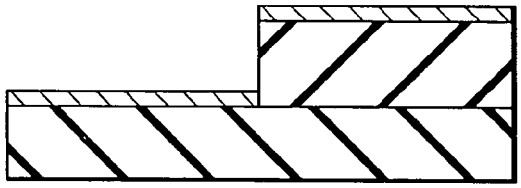

(4) Next, as shown in FIG. 14D, a part of the insulating layer is removed by using, e.g., an etching method, to expose the device electrode 1203.

Figure 14E:
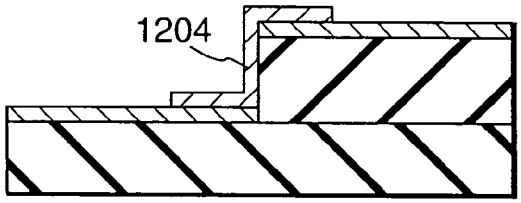

(5) Next, as shown in FIG. 14E, the conductive thin film 1204 using the fine particle film is formed. Upon formation, similar to the above-described flat device structure, a film-forming technique such as an applying method is used.

(6) Next, similar to the flat device structure, the forming processing is performed to form an electron-emitting portion. (The forming processing similar to that explained using FIG. 10C may be performed.)

(7) Next, similar to the flat device structure, the activation processing is performed to deposit carbon or carbon compound around the electron-emitting portion. (Activation processing similar to that explained using FIG. 10D may be performed).

Figure 14F:
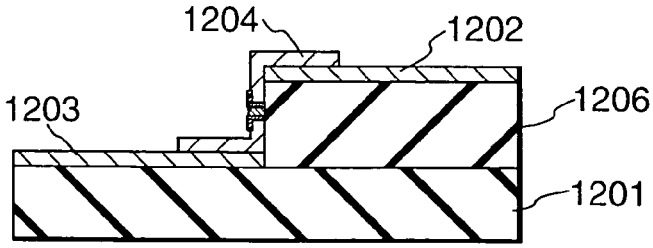

As described above, the stepped surface-conduction emission type electron-emitting device shown in FIG. 14F is manufactured.

(Characteristic of Surface-Conduction Emission Type Electron-Emitting Device Used in Display Apparatus)

The structure and manufacturing method of the flat surface-conduction emission type electron-emitting device and those of the stepped surface-conduction emission type electron-emitting device are as described above. Next, the characteristic of the electron-emitting device used in the display apparatus will be described below.

Figure 15:
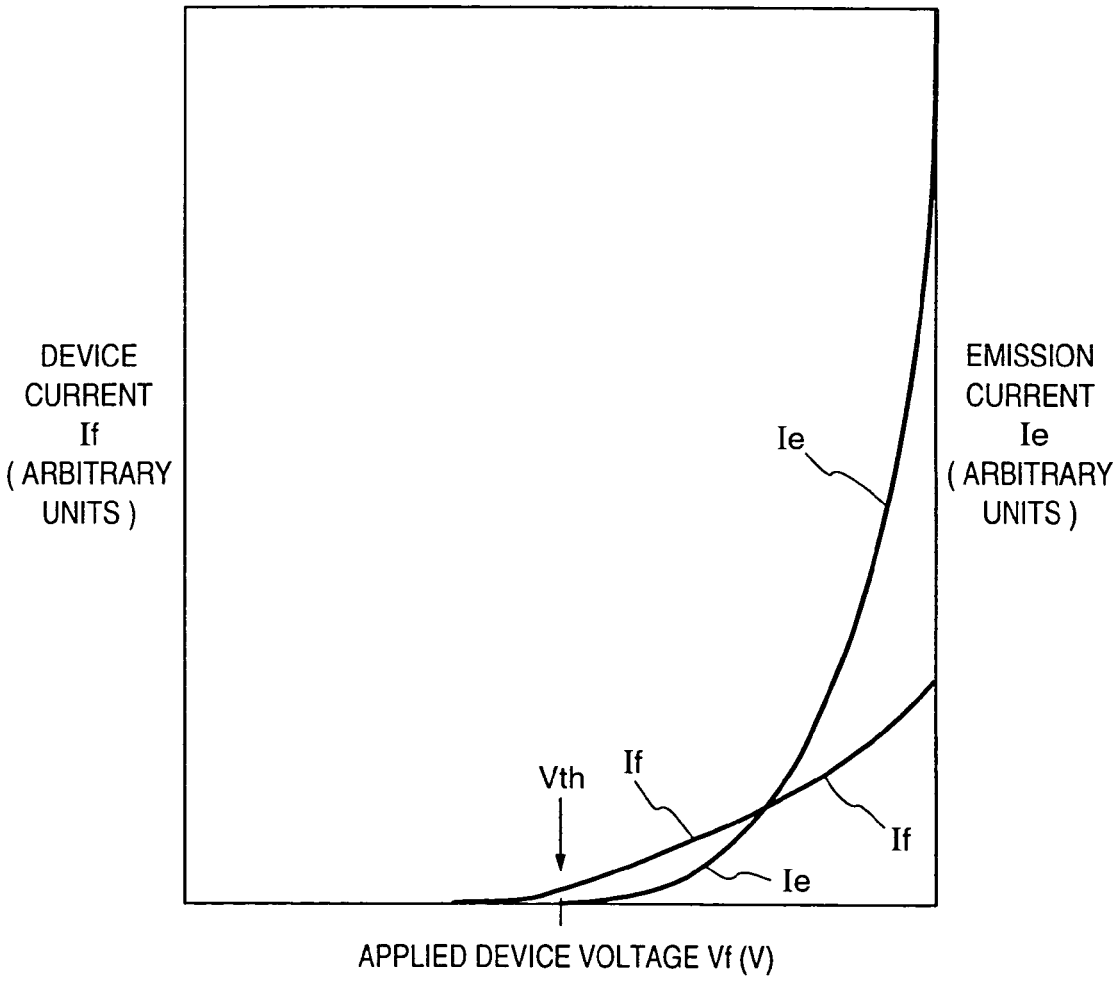
FIG. 15 is a graph showing the typical characteristics of the surface-conduction emission type electron-emitting device in this embodiment.

FIG. 15 shows a typical example of (emission current Ie) to (device application voltage Vf) characteristic and (device current If) to (device application voltage Vf) characteristic of the device used in the display apparatus of this embodiment. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 15 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected. That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the current Ie is output quickly in response to application of the device voltage Vf to the device. Accordingly, an electrical charge amount of electrons to be emitted from the device can be controlled by changing period of application of the device voltage Vf.

The surface-conduction emission type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device in accordance with a desired emission luminance, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

(Structure of Multi Electron Source with Many Devices Arranged in Simple Matrix)

Next, the structure of the multi electron source having the above-described surface-conduction emission type electron-emitting devices arranged on the substrate in a simple matrix will be described below.

Figure 16:
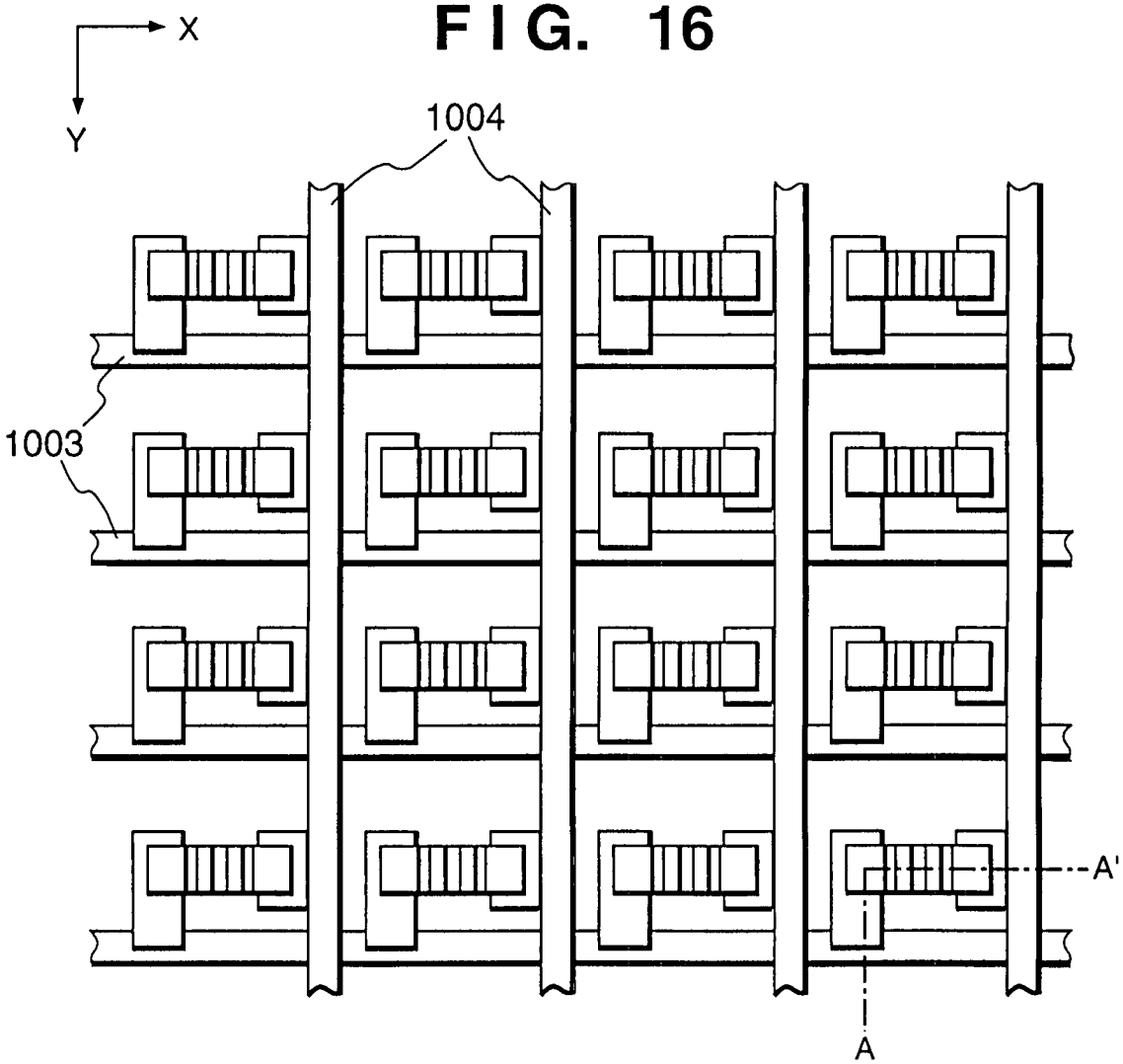
FIG. 16 is a plan view showing the substrate of a multi electron source used in this embodiment.

FIG. 16 is a plan view of the multi electron source used in the display panel 1000 in FIG. 7. There are surface-conduction emission type electron-emitting devices like the one shown in FIGS. 9A and 9B on the substrate 1001. These devices are arranged in a simple matrix with the row- and column-direction wirings 1003 and 1004. At an intersection of the row- and column-direction wirings 1003 and 1004, an insulating layer (not shown) is formed between the wires, to maintain electrical insulation.

Figure 17:
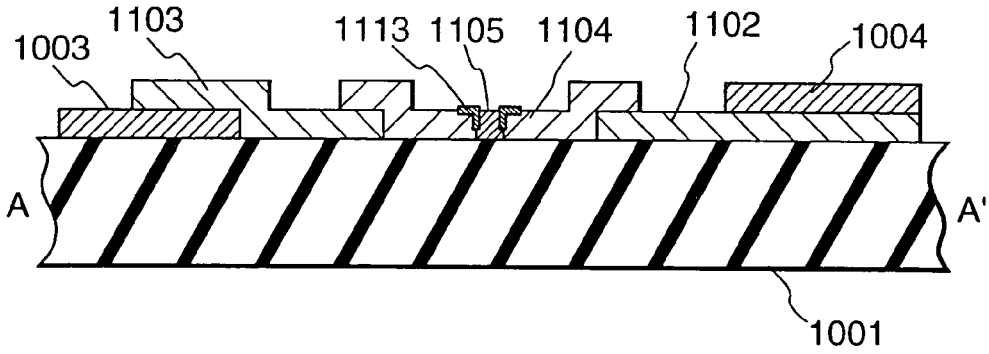
FIG. 17 is a sectional view taken along the line A-A' in FIG. 16.
Figure 19:
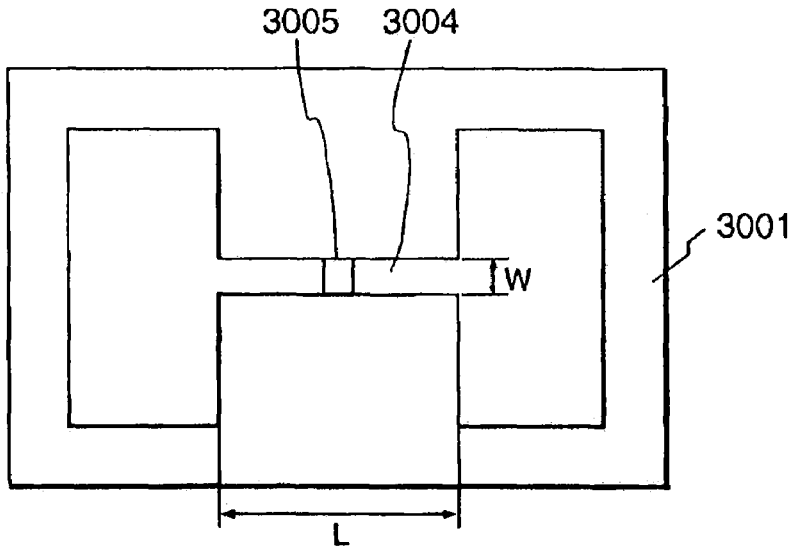
FIG. 19 PRIOR ART
FIG. 19 is a plan view showing an example of a conventionally known surface-conduction emission type electron-emitting device.
Figure 20:
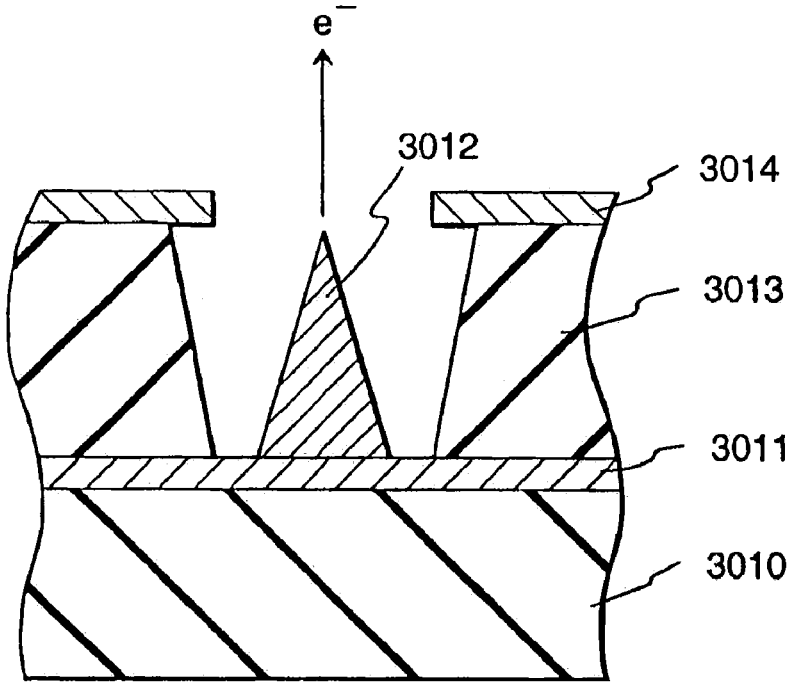
FIG. 20 PRIOR ART
FIG. 20 is a sectional view showing an example of a conventionally known FE type electron-emitting device.
Figure 21:
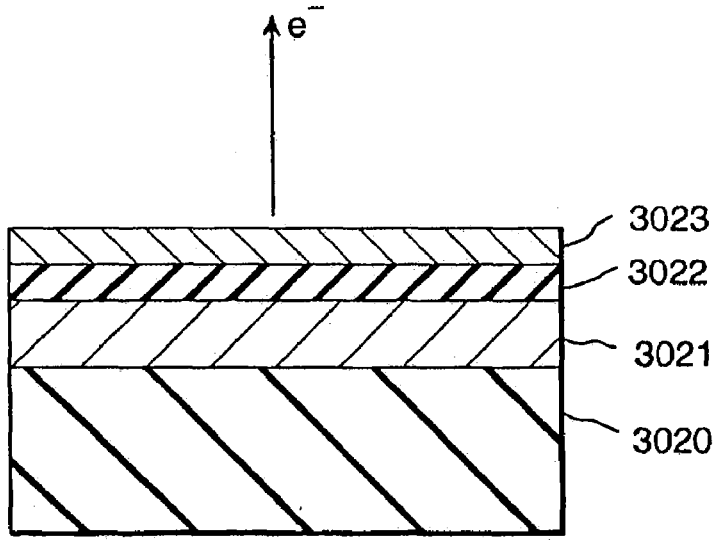
FIG. 21 PRIOR ART
FIG. 21 is a sectional view showing an example of a conventionally known MIM type electron-emitting device.
Figure 22:
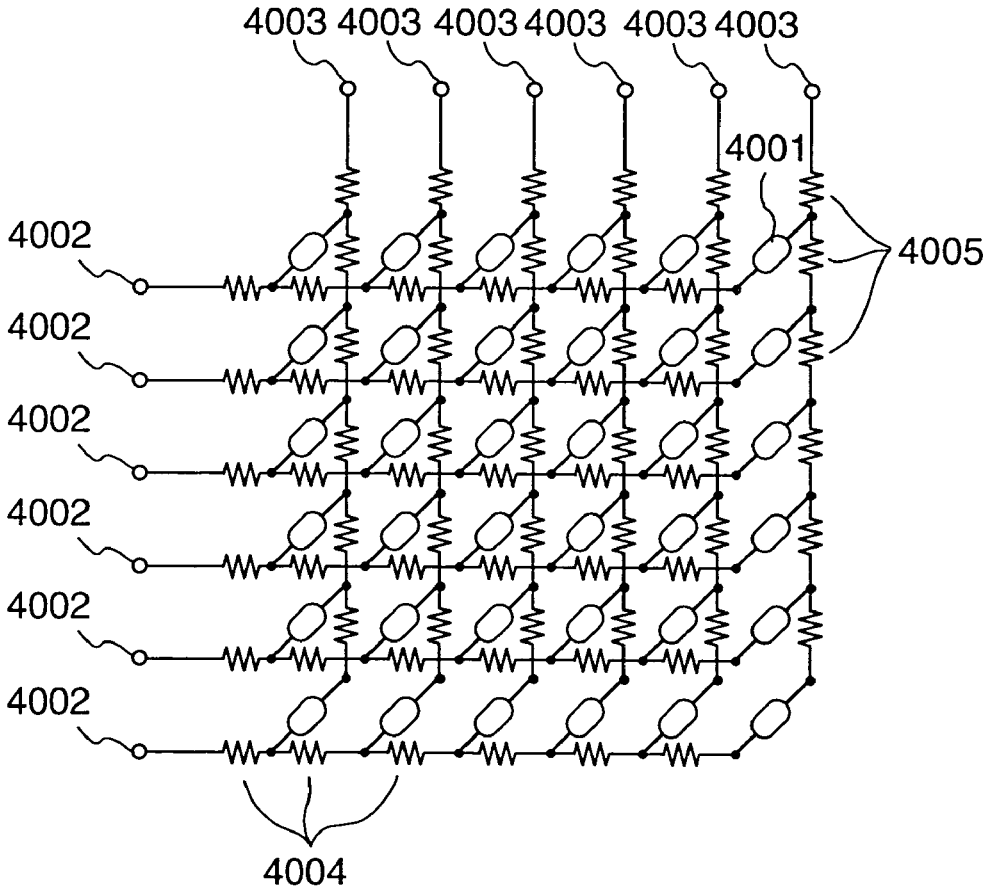
FIG. 22 is a diagram for explaining an electron-emitting device wiring method.

FIG. 17 shows a section taken along the line A-A' in FIG. 16.

Note that a multi electron source having such a structure is manufactured by forming the row- and column-direction wirings 1003 and 1004, the inter-electrode insulating layers (not shown), and the device electrodes and conductive thin films of the surface-conduction emission type electron-emitting devices on the substrate, then supplying electricity to the respective devices via the row- and column-direction wirings 1003 and 1004, thus performing the forming processing and the activation processing.

FIG. 18 is a block diagram showing an example of a multi-functional display apparatus capable of displaying image information provided from various image information sources such as television broadcasting on a display panel using the surface-conduction emission type electron-emitting device of this embodiment as an electron-beam source. Referring to FIG. 18, reference numeral 2100 denotes the above-mentioned display panel; 2101, a driving circuit for the display panel; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit; 2112 and 2113, TV signal reception circuits; and 2114, an input portion.

(Note that in the display apparatus, upon reception of a signal containing both video information and audio information such as a TV signal, the video information is displayed while the audio information is reproduced. A description of a circuit or speaker for reception, division, reproduction, processing, storage, or the like of the audio information, which is not directly related to the features of the present invention, will be omitted.) The functions of the respective parts will be explained in accordance with the flow of an image signal.

The TV signal reception circuit 2113 receives a TV image signal transmitted using a radio transmission system such as radio waves or spatial optical communication. The scheme of the TV signal to be received is not particularly limited, and is the NTSC scheme, the PAL scheme, the SECAM scheme, or the like. A more preferable signal source to take the advantages of the display panel realizing a large area and a large number of pixels is a TV signal (e.g., a so-called high-quality TV of the MUSE scheme or the like) made up of a larger number of scanning lines than that of the TV signal of the above scheme. The TV signal received by the TV signal reception circuit 2113 is output to the decoder 2104.

The TV signal reception circuit 2112 receives a TV image signal transmitted using a wire transmission system such as a coaxial cable or optical fiber. The scheme of the TV signal to be received is not particularly limited, as in the TV signal reception circuit 2113. The TV signal received by the circuit 2112 is also output to the decoder 2104.

The image input interface circuit 2111 receives an image signal supplied from an image input device such as a TV camera or image read scanner, and outputs it to the decoder 2104.

The image memory interface circuit 2110 receives an image signal stored in a video tape recorder (to be briefly referred to as a VTR hereinafter), and outputs it to the decoder 2104.

The image memory interface circuit 2109 receives an image signal stored in a video disk, and outputs it to the decoder 2104.

The image memory interface circuit 2108 receives an image signal from a device storing still image data such as a so-called still image disk, and outputs the received still image data to the decoder 2104.

The I/O interface circuit 2105 connects the display apparatus to an external computer, computer network, or output device such as a printer. The I/O interface circuit 2105 allows inputting/outputting image data, character data, and graphic information, and in some cases inputting/outputting a control signal and numerical data between the CPU 2106 of the display apparatus and an external device.

The image generation circuit 2107 generates display image data on the basis of image data or character/graphic information externally input via the I/O interface circuit 2105, or image data or character/graphic information output from the CPU 2106. This circuit 2107 incorporates circuits necessary to generate images such as a programmable memory for storing image data and character/graphic information, a read-only memory storing image patterns corresponding to character codes, and a processor for performing image processing. Display image data generated by the circuit 2107 is output to the decoder 2104. In some cases, display image data can also be input/output from/to an external computer network or printer via the I/O interface circuit 2105.

The CPU 2106 mainly performs control of operation of this display apparatus, and operations about generation, selection, and editing of display images.

For example, the CPU 2106 outputs a control signal to the multiplexer 2103 to properly select or combine image signals to be displayed on the display panel. At this time, the CPU 2106 generates a control signal to the display panel controller 2102 in accordance with the image signals to be displayed, and appropriately controls operation of the display apparatus in terms of the screen display frequency, the scanning method (e.g., interlaced or non-interlaced scanning), the number of scanning lines for one frame, and the like.

The CPU 2106 directly outputs image data or character/graphic information to the image generation circuit 2107. In addition, the CPU 2106 accesses an external computer or memory via the I/O interface circuit 2105 to input image data or character/graphic information.

The CPU 2106 may also be concerned with operations for other purposes. For example, the CPU 2106 can be directly concerned with the function of generating and processing information, like a personal computer or wordprocessor.

Alternatively, the CPU 2106 may be connected to an external computer network via the I/O interface circuit 2105 to perform operations such as numerical calculation in cooperation with the external device.

The input portion 2114 allows the user to input an instruction, program, or data to the CPU 2106. As the input portion 2114, various input devices such as a joystick, bar code reader, and speech recognition device are available in addition to a keyboard and mouse.

The decoder 2104 inversely converts various image signals input from the circuits 2107 to 2113 into three primary color signals, or a luminance signal and I and Q signals. As is indicated by the dotted line in FIG. 18, the decoder 2104 desirably incorporates an image memory in order to process a TV signal of the MUSE scheme or the like which requires an image memory in inverse conversion. This image memory advantageously facilitates display of a still image, or image processing and editing such as thinning, interpolation, enlargement, reduction, and synthesis of images in cooperation with the image generation circuit 2107 and CPU 2106.

The multiplexer 2103 appropriately selects a display image on the basis of a control signal input from the CPU 2106. More specifically, the multiplexer 2103 selects a desired one of the inversely converted image signals input from the decoder 2104, and outputs the selected image signal to the driving circuit 2101. In this case, the image signals can be selectively switched within a 1-frame display time to display different images in a plurality of areas of one frame, like a so-called multiwindow television.

The display panel controller 2102 controls operation of the driving circuit 2101 on the basis of a control signal input from the CPU 2106.

As for the basic operation of the display panel, the display panel controller 2102 outputs, e.g., a signal for controlling the operation sequence of a driving power source (not shown) of the display panel to the driving circuit 2101. As for the method of driving the display panel, the display panel controller 2102 outputs, e.g., a signal for controlling the screen display frequency or scanning method (e.g., interlaced or non-interlaced scanning) to the driving circuit 2101.

In some cases, the display panel controller 2102 outputs to the driving circuit 2101 a control signal about adjustment of the image quality such as the brightness, contrast, color tone, or sharpness of a display image.

The driving circuit 2101 generates a driving signal to be applied to the display panel 2100, and operates based on an image signal input from the multiplexer 2103 and a control signal input from the display panel controller 2102.

The functions of the respective parts have been described. The arrangement of the display apparatus shown in FIG. 18 makes it possible to display image information input from various image information sources on the display panel 2100. More specifically, various image signals such as television broadcasting image signals are inversely converted by the decoder 2104, appropriately selected by the multiplexer 2103, and supplied to the driving circuit 2101. On the other hand, the display controller 2102 generates a control signal for controlling operation of the driving circuit 2101 in accordance with an image signal to be displayed. The driving circuit 2101 applies a driving signal to the display panel 2100 on the basis of the image signal and control signal. As a result, the image is displayed on the display panel 2100. A series of operations are systematically controlled by the CPU 2106.

In the display apparatus, the image memory incorporated in the decoder 2104, the image generation circuit 2107, and the CPU 2106 can cooperate with each other to simply display selected ones of a plurality of pieces of image information and to perform, for the image information to be displayed, image processing such as enlargement, reduction, rotation, movement, edge emphasis, thinning, interpolation, color conversion, and conversion of the aspect ratio of an image, and image editing such as synthesis, erasure, connection, exchange, and pasting. Although not described in this embodiment, an audio circuit for processing and editing audio information may be arranged, similar to the image processing and the image editing.

The display apparatus can therefore function as a display device for television broadcasting, a terminal device for video conferences, an image editing device for processing still and dynamic images, a terminal device for a computer, an office terminal device such as a wordprocessor, a game device, and the like. This display apparatus is useful for industrial and business purposes and can be variously applied.

FIG. 18 merely shows an example of the arrangement of the display apparatus using the display panel having the surface-conduction emission type electron-emitting device as an electron source. The present invention is not limited to this, as a matter of course. For example, among the constituents in FIG. 18, a circuit associated with a function unnecessary for the application purpose can be eliminated from the display apparatus. To the contrary, another constituent can be added to the display apparatus in accordance with the application purpose. For example, when the display apparatus is used as a television telephone set, transmission and reception circuits including a television camera, audio microphone, lighting, and modem are preferably added as constituents.

In the display apparatus, since particularly the display panel using the surface-conduction emission type electron-emitting device as an electron source can be easily made thin, the width of the whole display apparatus can be decreased. In addition to this, the display panel using the surface-conduction emission type electron-emitting device as an electron source is easily increased in screen size and has a high brightness and a wide view angle. This display apparatus can therefore display an impressive image with reality and high visibility.

The present invention may be applied to a system constituted by a plurality of devices (e.g., a host computer, interface device, reader, and printer) or an apparatus comprising a single device (e.g., a copying machine or facsimile apparatus).

The object of the present invention is realized even by supplying a storage medium storing software program codes for realizing the functions of the above-described embodiment to a system or apparatus, and causing the computer (or a CPU or MPU) of the system or apparatus to read out and execute the program codes stored in the storage medium.

In this case, the program codes read out from the storage medium realize the functions of the above-described embodiment by themselves, and the storage medium storing the program codes constitutes the present invention.

As a storage medium for supplying the program codes, a floppy disk, hard disk, optical disk, magnetooptical disk, CD-ROM, CD-R, magnetic tape, nonvolatile memory card, ROM, or the like can be used.

The functions of the above-described embodiment are realized not only when the readout program codes are executed by the computer but also when the OS (Operating System) running on the computer performs part or all of actual processing on the basis of the instructions of the program codes.

The functions of the above-described embodiment are also realized when the program codes readout from the storage medium are written in the memory of a function expansion board inserted into the computer or a function expansion unit connected to the computer, and the CPU of the function expansion board or function expansion unit performs part or all of actual processing on the basis of the instructions of the program codes.

As described above, the first embodiment can suppress a decrease in effective application voltage to a selected/driven wiring arising from crosstalk between adjacent wirings, and can display an image having a good gradation characteristic in the display panel using surface-conduction emission type electron-emitting devices arranged in an (m×n) matrix driven by pulse width modulation.

The first embodiment can suppress variations in signal level arising from the stray capacitance between adjacent wirings and can exactly reproduce a predetermined luminance to display an image.

The first embodiment can minimize variations in signal level on a signal line arising from the fall of a signal on an adjacent signal line, and can make variations in luminance of a display image inconspicuous.

Second Embodiment

Figure 23:
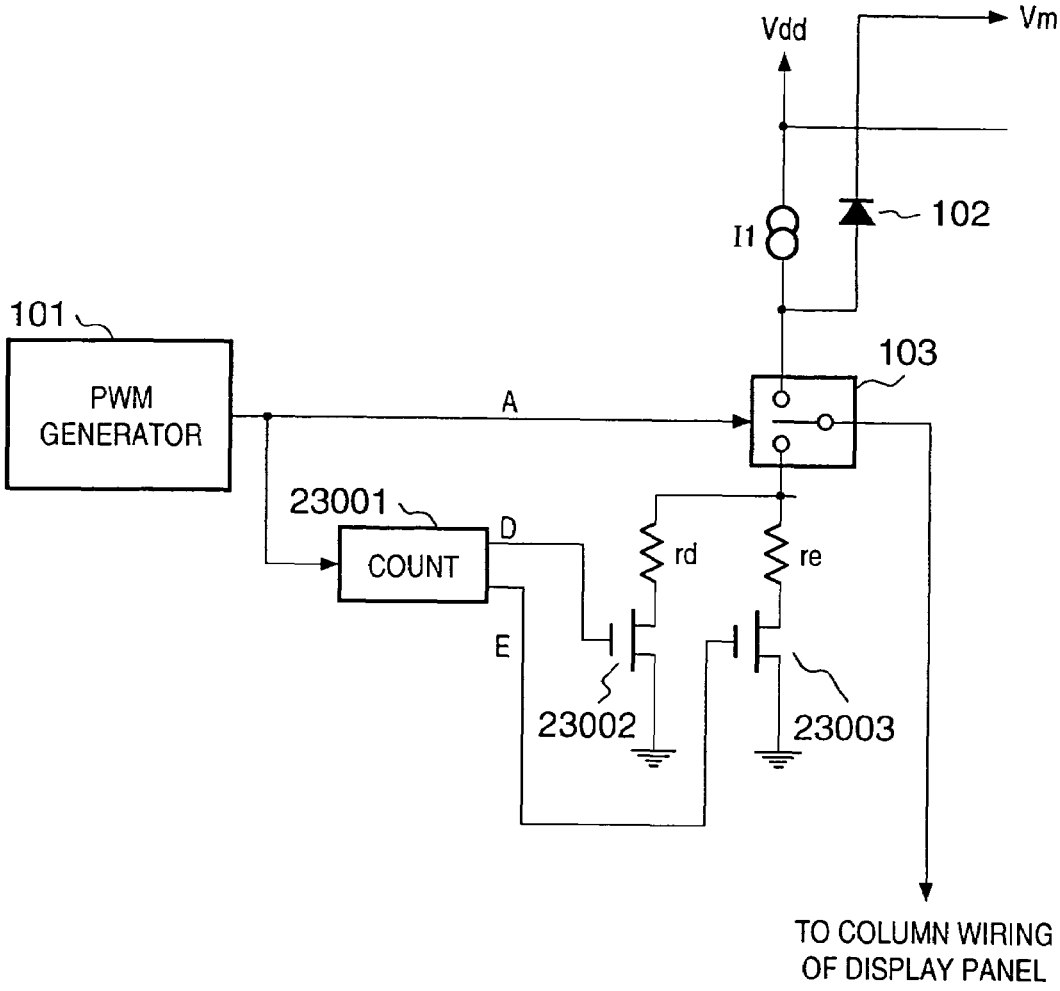
FIG. 23 is a circuit diagram showing the circuit arrangement of a column wiring driving circuit according to the second embodiment of the present invention.

The second embodiment will exemplify a modification of the circuit arrangement for the fall of a pulse signal used in the first embodiment of the present invention. FIG. 23 is a circuit diagram showing a circuit corresponding to a part of the column wiring driver 10*a* for one column wiring in FIG. 5 used in the first embodiment. The same reference numerals denote the same parts.

In FIG. 23, reference numerals 23002 and 23003 denote transistors controlled by a controller 23001.

The fall operation of a pulse signal in the second embodiment will be explained.

When the controller 23001 detects the fall of a pulse signal from a signal from a pulse-width-modulated signal generator (PWM GEN) 101, it turns on both the transistors 23002 and 23003. Then, resistors rd and re are connected parallel, and the column wiring potential falls immediately. Upon the lapse of a predetermined time, the controller 23001 controls to turn on one transistor and off the other (t2). A current value flowing from the column wiring to GND decreases, and the potential of the column wiring falls more moderately than the first half of the fall of the pulse signal in which the resistors rd and re are connected parallel. After t2, the controller 23001 turns on both the transistors 23002 and 23003 again.

Figure 24:
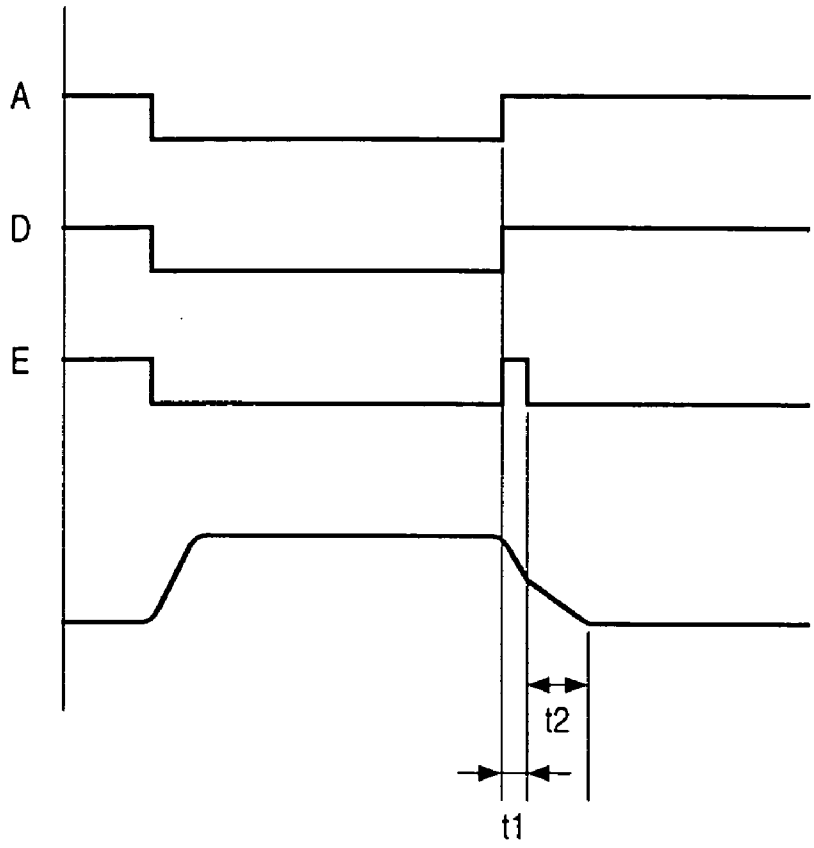
FIG. 24 is a timing chart showing a signal waveform and control signal in the circuit of FIG. 23.

FIG. 24 is a timing chart showing a signal A from the pulse-width-modulated signal generator 101 in FIG. 23, signals D and E from the controller 23001 to the transistors, and the pulse signal waveform of the column wiring.

In FIG. 23, since the resistors rd and re are connected parallel during the time t1, a current value flowing into GND increases to cause the waveform fall immediately.

Third Embodiment

The third embodiment will exemplify another modification.

Figure 25:
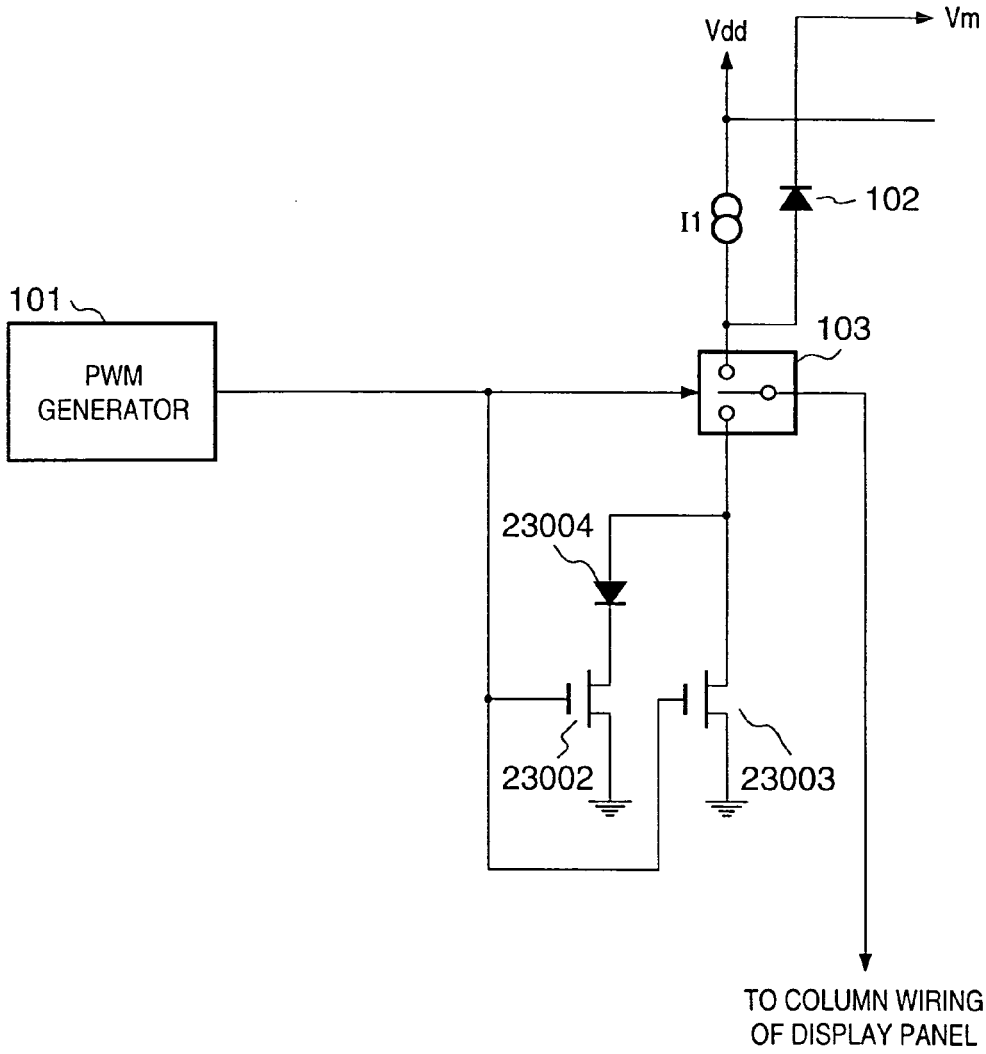
FIG. 25 is a circuit diagram showing the arrangement of a column wiring driving circuit according to the third embodiment of the present invention.

FIG. 25 is a circuit diagram corresponding to FIG. 23 in the second embodiment. The third embodiment adopts a diode 23004 to set different operation threshold potentials for a switching circuit made up of a transistor 23003 and a switching circuit made up of a transistor 23002 and diode 23004. That is, when the fall of a pulse signal is detected from a signal from a pulse-width-modulated signal generator 101, the pulse-width-modulated signal generator 101 turns on both the transistors 23002 and 23003 to quickly bring the column wiring potential close to a reference potential (GND). When the difference between the column wiring potential and reference potential reaches about 0.6 V, the transistor 23002 is turned off, and only the transistor 23003 is kept on. Accordingly, the column wiring potential moderately comes close to the reference potential.

In this way, the third embodiment can preferably modulate the pulse width with a simple circuit. Although FIG. 25 shows one diode 23004, the diode 23004 can be constituted by a plurality of series-connected diodes or a Zener diode to control an output voltage for turning off the transistor 23002.

Fourth Embodiment

The following embodiments control the fall of a pulse signal in accordance with the potential state of a neighboring wiring such as an adjacent wiring.

Figure 26:
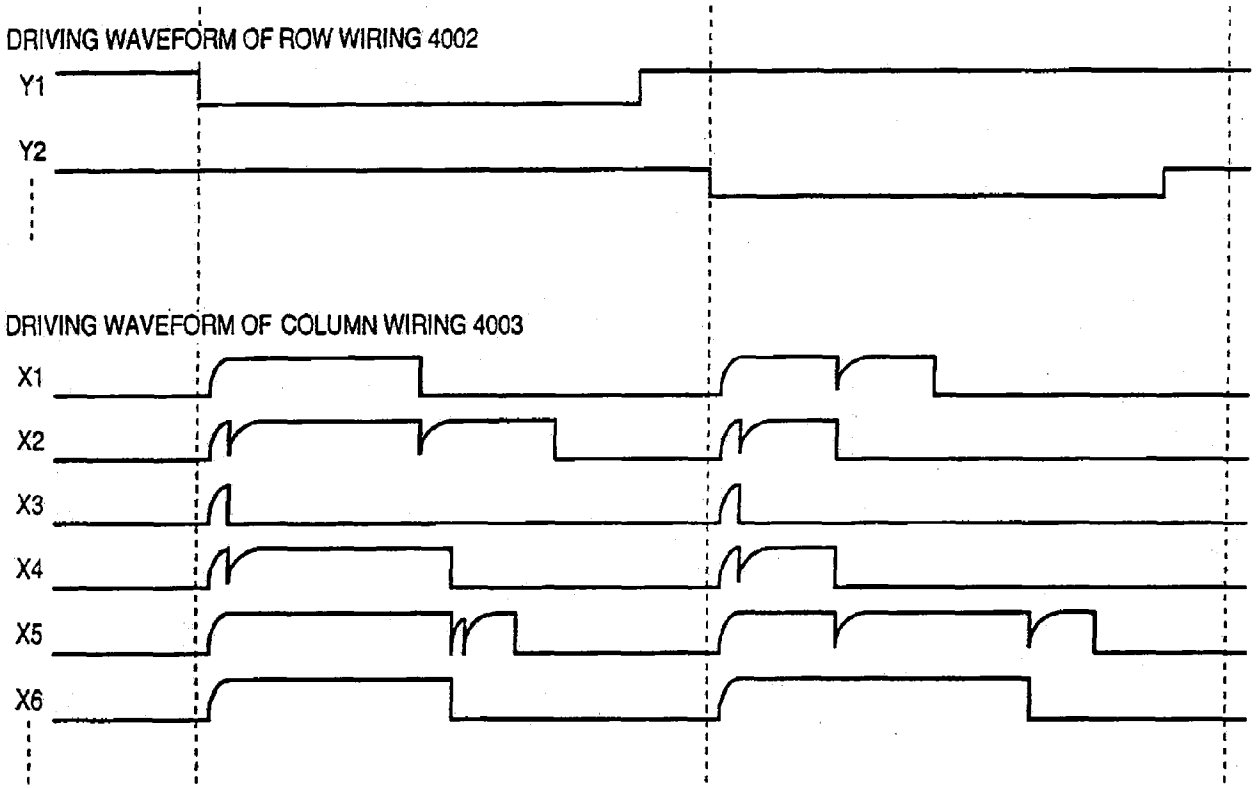
FIG. 26 is a timing chart showing an example of generation of crosstalk on six column wirings.

FIG. 26 is a timing chart showing an example of generation of crosstalk on six column wirings.

As described above, the driving voltage drops (crosstalk) under the influence of the wiring capacitance between adjacent wirings such that when a row wiring Y1 is selected, the driving waveforms of signals X2 and X5 change to low level due to the fall of a signal X on an adjacent column wiring and the fall of signals X4 and X6 on adjacent column wirings. This varies a driving voltage for an electron-emitting device driven by the difference voltage between a potential applied to the column wiring and a potential applied to the row wiring, and the gradation of a display image degrades under the influence of variations. Particularly on a large-screen display panel, the numbers of row wirings and column wirings increase, the interval between the wirings decreases, the inter-wiring capacitance increases, and a decrease (crosstalk) in driving voltage along with variations in potentials of adjacent wirings more easily occurs. As a result, the gradation of a display image degrades.

Even in voltage driving, the wiring cannot be driven by an ideal potential as an output from the voltage source owing to a protection resistance, wiring resistance, and the like. For this reason, the driving voltage drops under the influence of the wiring capacitance, and the gradation of a display image degrades.

The above-described embodiments realize a preferable luminance level by causing a pulse signal to fall in a plurality of steps. At this time, the fall of the pulse signal is controlled regardless of the potential of a neighboring wiring. The following embodiments do not cause the pulse signal to fall in a plurality of steps if not needed in accordance with the potential of a neighboring wiring.

Similar to the above embodiments, a matrix type display panel used in an image display apparatus according to the following embodiments basically comprises, in a low-profile airtight container, a multi electron source constituted by arranging many electron sources, e.g., many cold cathode devices in a matrix on a substrate, and an image forming member which faces the multi electron source and forms an image by irradiation of electrons from the multi electron source.

These cold cathode devices can be formed on a substrate at a high alignment precision using a manufacturing technique such as photolithography etching, so that many devices can be laid out at a small interval. The cold cathode device or its peripheral portion can be driven at a lower temperature than a hot cathode device conventionally used in a CRT and the like, and thus the cold cathode device can easily realize a multi electron source having a smaller layout pitch. Note that the structure and manufacturing method of the matrix type display panel are the same as in the first embodiment.

The features of the following embodiments will be explained with reference to FIG. 27.

Figure 27:
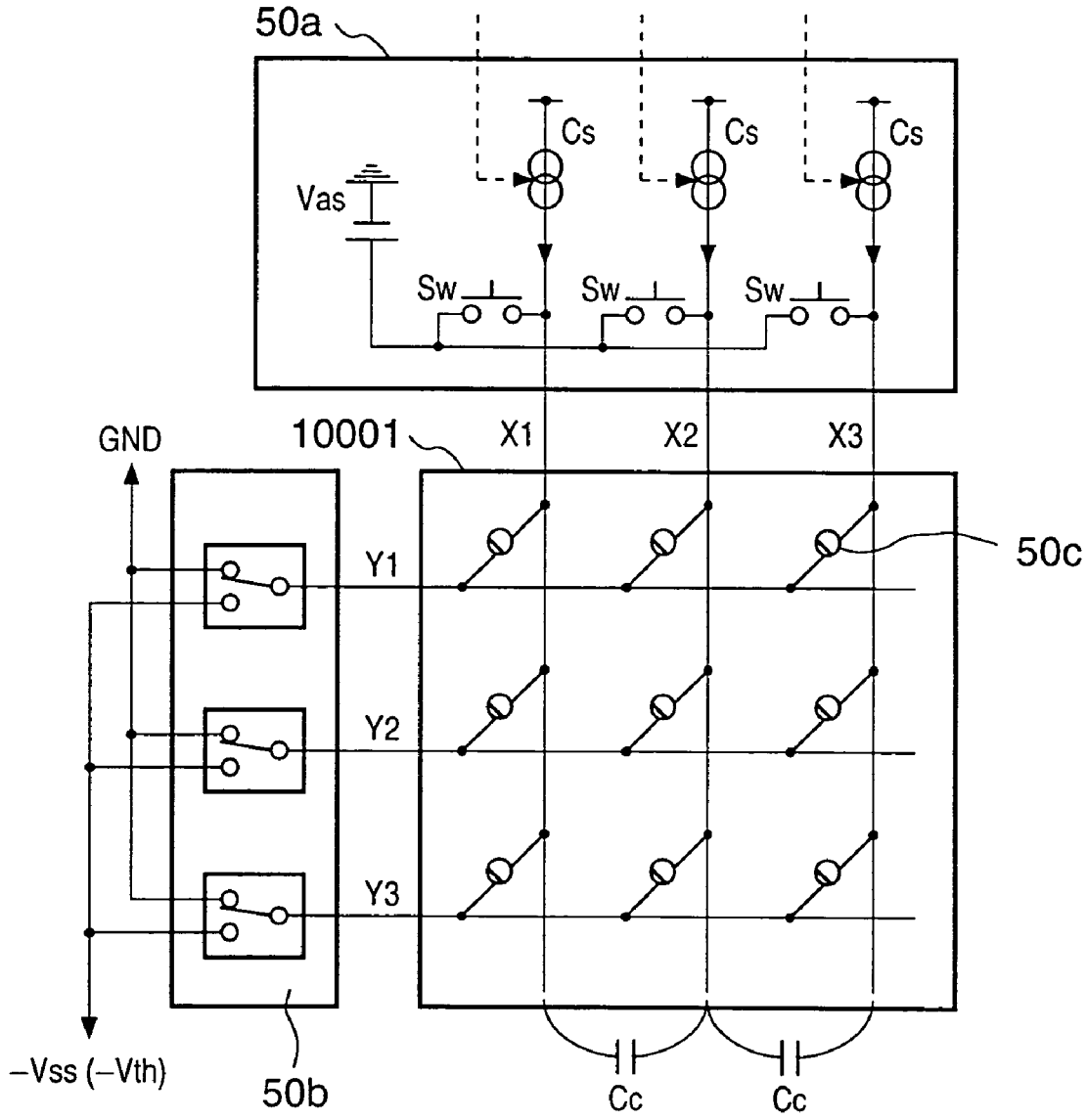
FIG. 27 is a circuit diagram for explaining the concept of a display driving method according to the embodiment of the present invention.

FIG. 27 is a circuit diagram for explaining the concept of a display driving method according to the following embodiments, and showing a circuit for driving the multi electron source. For descriptive convenience, a matrix type display panel 10001 uses an electron source constituted by arranging 3×3 cold cathode devices in a matrix, and the wiring resistances of wirings connecting these cold cathode devices are not illustrated. In FIG. 27, reference symbol 50*c* denotes a cold cathode device; and Cc, a capacitance between column wirings.

In FIG. 27, in order to drive the cold cathode devices 50*c*, a switching circuit 50*b* applies a potential −Vss in the order from the row wiring Y1 in synchronism with a horizontal sync signal of an image, grounds the remaining row wirings, and performs scanning driving. Reference symbol 50*a* denotes a column driver which has controllable constant current sources Cs. Each of the constant current sources Cs outputs a current for driving the cold cathode device 50*c* in accordance with a pulse signal (pulse-width-modulated signal) having a pulse width corresponding to a display image signal. Reference symbol Sw denotes a switching circuit; and Vas, a voltage source for outputting a potential Vas [V]. Each switching circuit Sw controls whether to apply a potential from the voltage source Vas to a modulated-signal wiring which flows a current from the constant current source Cs to the device 50*c*. Switching operation of the switching circuit Sw is controlled by a control circuit (not shown). Regarding the line of a modulated signal X1, if a signal X2 has been input to an adjacent wiring when the signal X1 falls, the switch Sw connected to the signal X1 is turned on (closed). The signal X1 falls to not GND level but only the potential Vas. Thus, potential variations in signal X2 along with the capacitance between adjacent modulated-signal wirings can be minimized. This operation similarly applies to wirings receiving other modulated signals X2 and X3.

Figure 28:
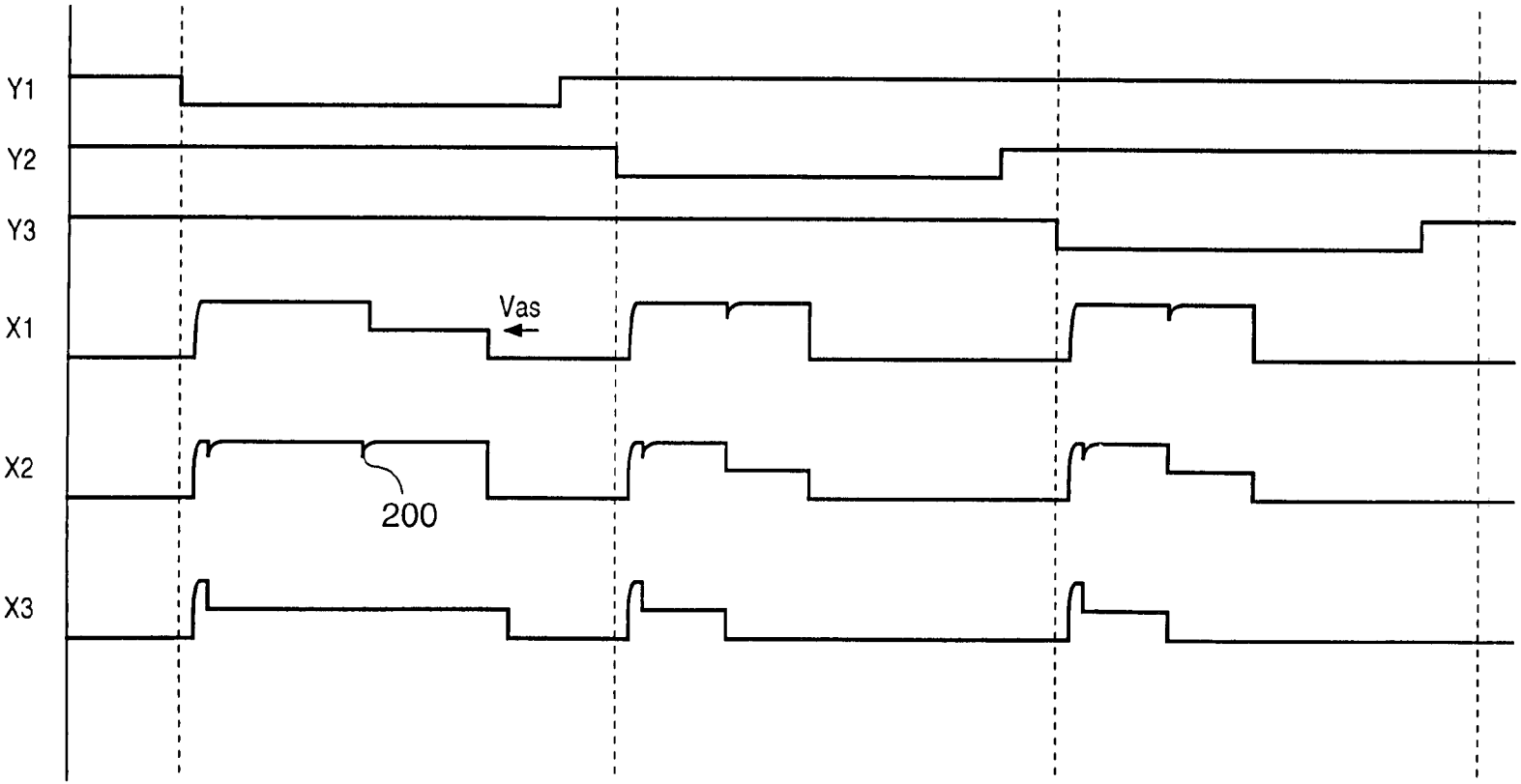
FIG. 28 is a driving waveform chart for generally explaining operation of the circuit in FIG. 27.

FIG. 28 is a driving waveform chart for generally explaining operation of the circuit in FIG. 27.

In FIG. 28, reference numeral 200 denotes crosstalk to the column wiring X2 along with a change in signal level on the column wiring X1. Even in the fourth embodiment, as is apparent, the fall of a signal on the column wiring X1 generates slight crosstalk on the column wiring X2, but this crosstalk is smaller than crosstalk in FIG. 26. This is because the potential of the column wiring X1 does not fall to GND in the fourth embodiment. That is, since the potential of the column wiring X1 falls to only Vas [V] on the driving waveform of the column wiring X1 in FIG. 28, the fall potential hardly changes and rarely influences the adjacent column wiring X2. Note that the potential Vas [V] is preferably determined such that a voltage (Vas+Vss) applied to the cold cathode device 50*c* becomes close to a value close to a threshold voltage (Vth in the following description) at which the cold cathode device 50*c* starts emitting electrons. If an output potential from the voltage source Vas is low, crosstalk may be hardly removed; if the output potential is high, the cold cathode device 50*c* may emit electrons in a non-driving state to decrease the image contrast.

The following embodiments will be described in detail with reference to the accompanying drawings.

For descriptive convenience, the arrangement of a display driving circuit in an image display apparatus according to the fourth embodiment will be explained with reference to FIG. 29.

Figure 29:
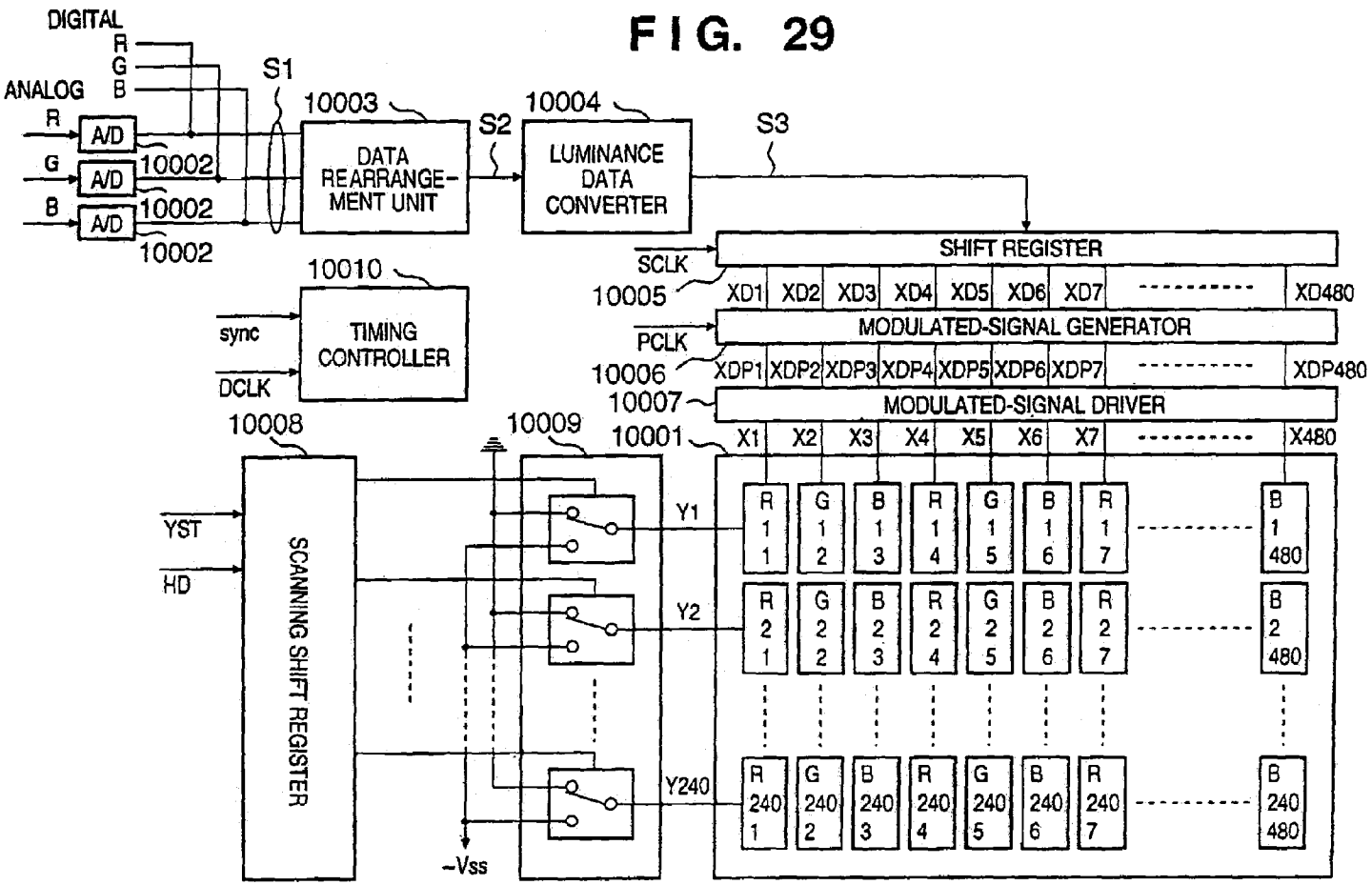
FIG. 29 is a block diagram showing the arrangement of a driving circuit in an image display apparatus according to the fourth embodiment of the present invention.

FIG. 29 is a block diagram showing the arrangement of a display driving circuit in an image display apparatus according to the fourth embodiment.

In FIG. 29, reference numeral 10001 denotes a display panel having a multi electron source constituted by arranging many electron sources, e.g., many cold cathode devices in a matrix on a substrate within a low-profile airtight container. As shown in FIG. 29, 480 devices, i.e., 160 pixels×3 (R, G, and B), and 240 devices are respectively arranged in the horizontal and vertical directions. Although the fourth embodiment exemplifies the display panel 10001 having 480 devices×240 devices, the number of cold cathode devices is not limited to this and can be determined by an intended product application if necessary. The cold cathode devices of the matrix type display panel 10001 are laid out in accordance with image display colors (colors of corresponding fluorescent substances) with Rmn (m=1 to 240, n=1, 4, 7, . . . ), Gmn (m=1 to 240, n=2, 5, 8, . . . ), and Bmn (m=1 to 240, n=3, 6, 9, . . . ) As shown in FIG. 29, R, G, and B fluorescent substances are laid out in the order of R, G, and B on the display panel 10001.

Reference numerals 10002 denote analog-to-digital converters (A/D converters) which convert analog R, G, and B signals decoded from, e.g., an NTSC signal, into 8-bit digital R, G, and B signals; 10003, a data rearrangement unit having a function of receiving digital R, G, and B signals (signal S1) from the A/D converters 10002, computer, or the like, and rearranging and outputting them (signal S2) in accordance with the pixel layout of the matrix type display panel 10001; 10004, a luminance data converter for converting digital data input from the data rearrangement unit 10003 into a desired luminance characteristic (signal S3) using, e.g., a gamma conversion table; 10005, a shift register for sequentially shifting and transferring serial data (signal S3) sent from the luminance data converter 10004 in synchronism with a shift clock (SCLK), and generating parallel digital data (XD1 to XD480) corresponding to the respective devices of the display panel 10001; 10006, a modulated-signal generator for determining pulse widths based on a PWM clock (PCLK) in correspondence with digital data values from the shift register 10005, and outputting pulse signals (XDP1 to XDP480); and 10007, a modulated-signal driver for outputting driving signals X1 to X480 for driving the modulated-signal lines of the display panel 10001 in accordance with pulse signals output from the modulated-signal generator 10006.

Reference numeral 10008 denotes a scanning shift register for receiving a horizontal scanning sync signal (HD) as a shift clock, and generating signals for sequentially selecting the scanning wirings of the display panel 10001 corresponding to the scanning wirings of an input image; 10009, a scanning driver for applying a potential (−Vss) to a scanning wiring selected in accordance with an output from the scanning shift register 10008, connecting (grounding) unselected scanning wirings to GND, and sequentially selecting and driving the scanning wirings of the display panel 10001; and 10010, a timing controller for generating and outputting various timing signals to be supplied to respective functional blocks on the basis of a sync signal (sync) and sampling clock (DCLK) input together with an image signal.

Figure 31:
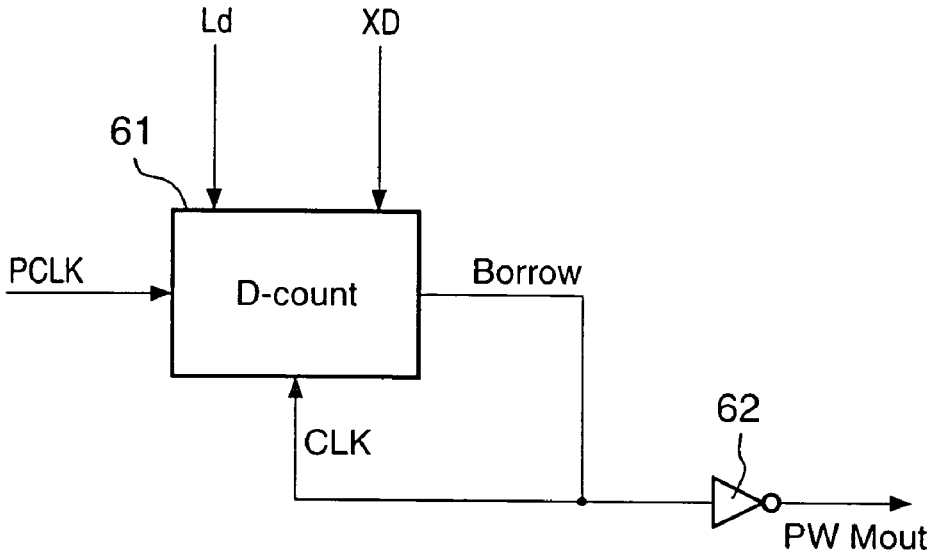
FIG. 31 is a circuit diagram for explaining the arrangement of a modulated-signal generator according to the fourth embodiment.

FIG. 31 is a circuit diagram showing the arrangement of a modulated-signal generation circuit for one digital data (XD) in the modulated-signal generator 10006 according to the fourth embodiment.

In FIG. 31, reference numeral 61 denotes a down counter; and 62, an inverter. The down counter 61 loads, e.g., 8-bit digital data (each of XD1 to XD480) as an output from the shift register 10005 at the timing of a load signal (Ld), and counts down every time it receives a PWM clock (PCLK). The inverter 62 inverts, e.g., a borrow output from the down counter 61 into a pulse-width-modulated output. The borrow output changes to low level at the load timing of the load signal, and to high level when the down counter 61 counts the number of PCLKs corresponding to a loaded data value. That is, the inverter 62 outputs a pulse signal having a pulse width determined by "loaded data (setting value)"×"clock (PCLK) period".

Figure 32:
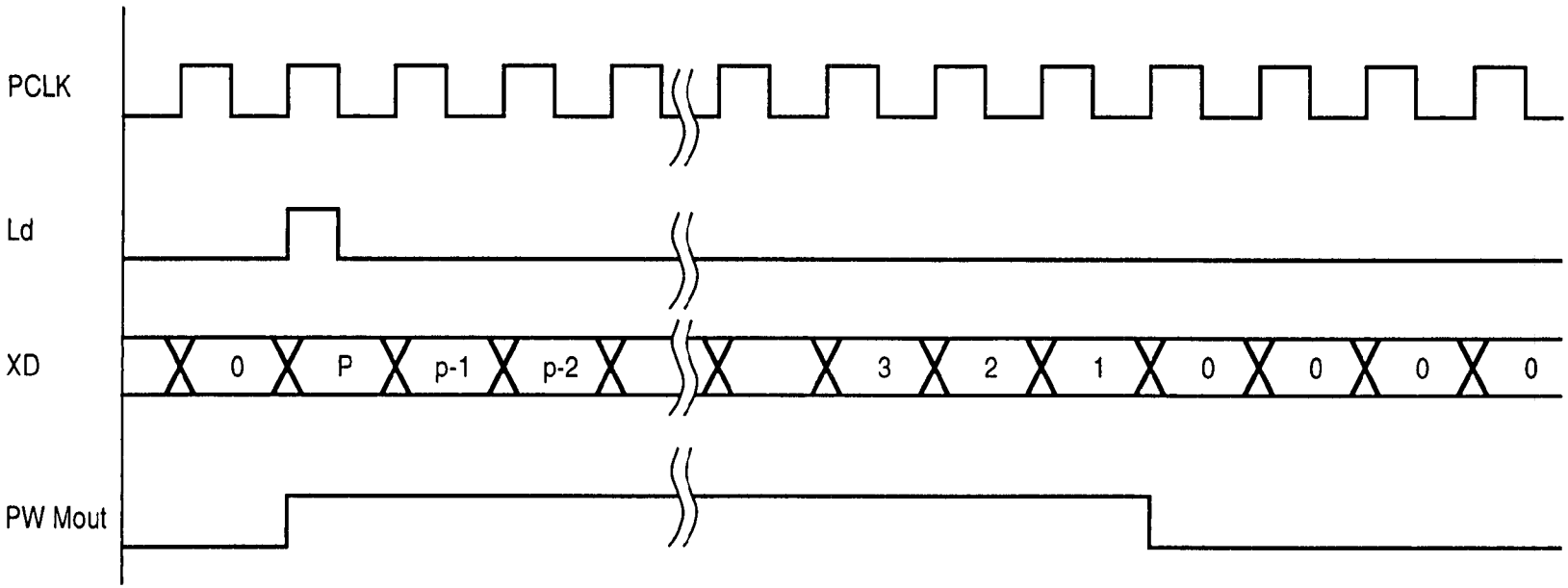
FIG. 32 is a waveform chart for explaining operation of the modulated-signal generator according to the fourth embodiment.

FIG. 32 is a timing chart showing operation of the circuit in FIG. 31.

In FIG. 32, "p" is set in the down counter 61 at the rise of the load signal Ld. When the down counter 61 counts the number of clocks PCLKs corresponding to "p", the borrow output changes to low level, and the inverter 62 outputs high-level PWMout.

Figure 30:
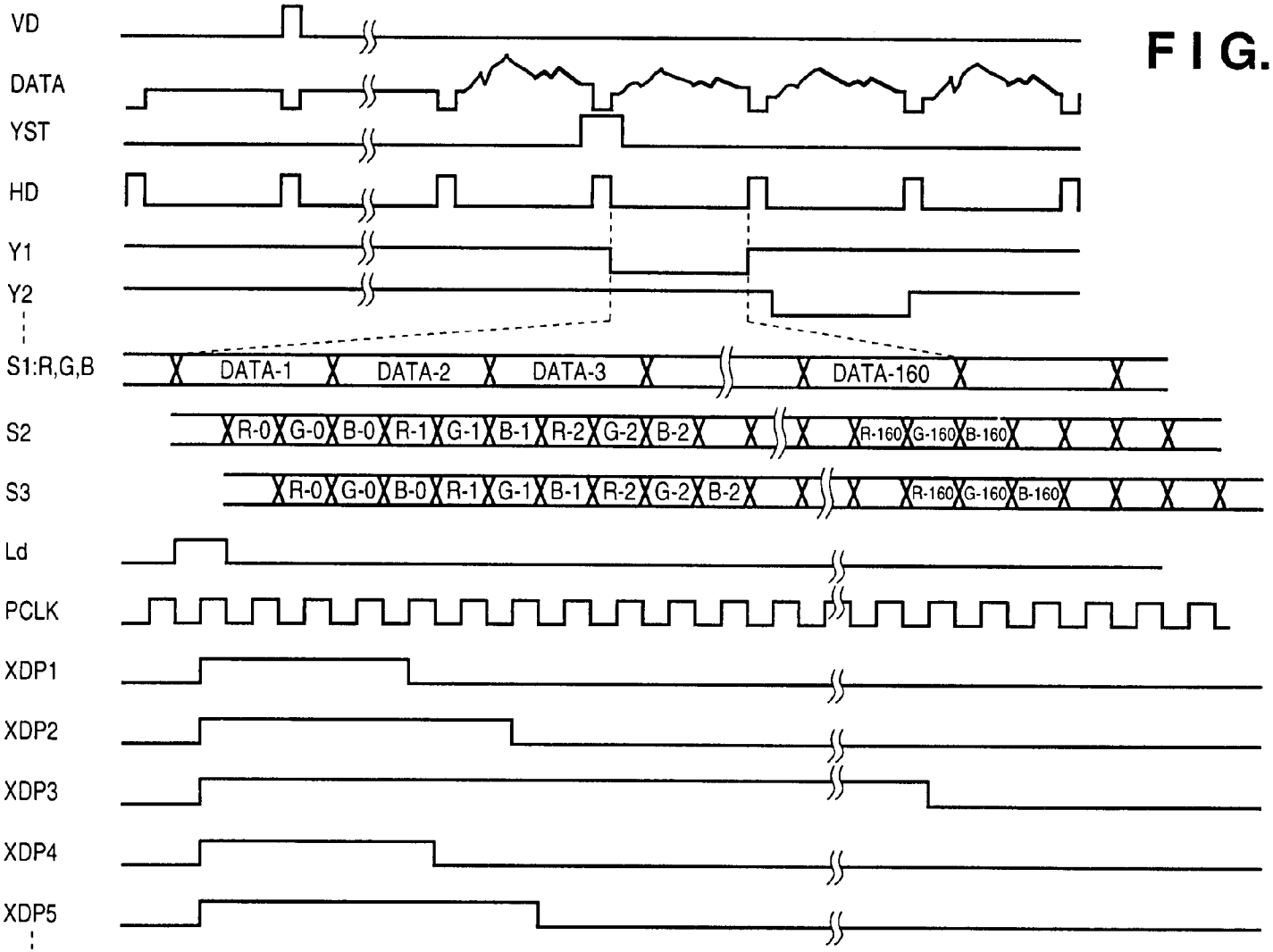
FIG. 30 is a timing chart for explaining operation of the circuit in FIG. 29.

FIG. 30 is a timing chart for explaining operation of the display driving circuit in the image display apparatus according to the fourth embodiment.

Operation of the image display apparatus according to the following embodiments will be described with reference to FIGS. 29 and 30.

In FIG. 29, analog R, G, and B signals decoded from, e.g., an NTSC signal by a decoder (not shown) are input and converted into 8-bit digital R, G, and B signals by the A/D converters 10002. The data rearrangement unit 10003 receives the digital R, G, and B signals (S1) from the A/D converters 10002, computer, or the like. At this time, processing can be simplified by determining the number of data for one scanning line (1H) by the number of pixels on the modulated-signal line side of the matrix type display panel 10001. In the fourth embodiment, the number of pixels on the modulated-signal line side of the display panel 10001 is "160". The digital R, G, and B signals (S1) from the A/D converters 10002, computer, or the like are output in synchronism with a data sampling clock (DCLK). As shown in FIG. 30, the R, G, and B parallel signals of the input signal (S1) are switched by the data rearrangement unit 10003 at the timing of a shift clock (SCLK) as a clock having a frequency triple the frequency of the data sampling clock (DCLK), and sequentially output in accordance with the layout of R, G, and B pixels on the display panel 10001.

An output signal (S2) from the data rearrangement unit 10003 is input to the luminance data converter 10004. The luminance data converter 10004 converts the output signal (S2) from the data rearrangement unit 10003 into a signal having a luminance characteristic complying with, e.g., a CRT gamma characteristic using a conversion table (ROM) (not shown) storing predetermined conversion data in advance.

An output signal S3 from the luminance data converter 10004 is sent to the shift register 10005, and the shift register 10005 sequentially shifts and transfers serial data in synchronism with a shift clock (SCLK), and outputs them as parallel digital data (XD1 to XD480) corresponding to the respective devices of the display panel 10001 to the modulated-signal generator 10006 in units of horizontal scanning times. In this case, e.g., 8-bit digital data (XD1 to XD480) are input to the modulated-signal generator 10006. As described above, the modulated-signal generator 10006 determines the pulse width of a pulse signal output to each device in response to digital data ("setting value") and the PWM clock (PCLK). In other words, the modulated-signal generator 10006 outputs a pulse signal (pulse-width-modulated signal) having a pulse width determined by a time required for "the number of PWM clocks (PCLK)" to reach "the setting value". The modulated-signal driver 10007 applies a modulated signal to the column wiring of the display panel 10001 to drive devices during the time determined by the pulse width of the pulse signal output from the modulated-signal generator 10006.

In the fourth embodiment, 480 of 485 interlaced effective scanning lines are driven to overwrite signals on the display panel 10001 in units of fields in order to display NTSC signals on the display panel 10001 having 240 scanning lines. One field of the NTSC signal is processed as one frame on the display panel 10001. That is, the display panel 10001 is driven with a frame frequency of 60 Hz and image signals for the 240 scanning lines.

The time necessary for display of one scanning line is about 63.5 μsec for the NTSC signal, and about 56.5 μsec of this time is determined as the maximum time of a driving pulse (X1 to X480). Since digital data ("setting value") is made of 8 bits, the frequency of the PWM clock (PCLK) is selected to about 56.5 μsec when the number of pulses of the PWM clock (PCLK) is 256. That is, the pulse width of one pulse is a clock of about 220 nsec, and a clock having a frequency of about 4.5 MHz is used as the PWM clock (PCLK).

Figure 33:
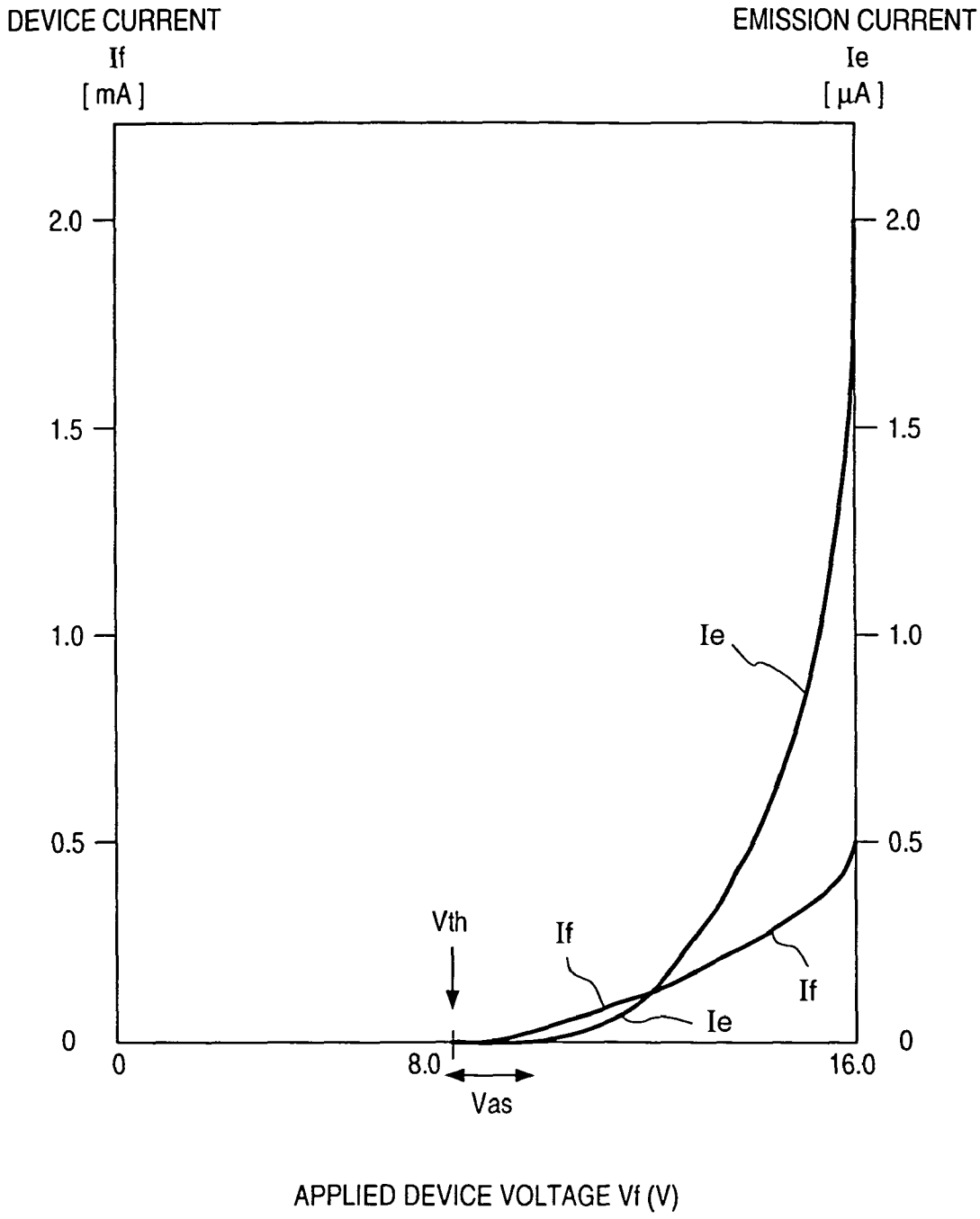
FIG. 33 is a graph for explaining the characteristics of a cold cathode device used in the fourth embodiment.

The scanning shift register 10008 receives a horizontal scanning sync signal (HD) as a shift clock, and outputs scanning signals by sequentially transferring signals (YST) for determining the scanning start time in response to the horizontal scanning sync signal (HD), as shown in FIG. 30. The scanning driver 10009 sequentially selects scanning wirings from the first wiring in accordance with scanning signals output from the scanning shift register 10008, applies a potential −Vss (e.g., −8 V) to a selected scanning wiring (row wiring) while applying 0 V to the remaining wirings, and scans and drives devices. Accordingly, a voltage of about 16 V is applied between the electrodes of cold cathode devices connected to modulated-signal wirings (column wirings) which are connected to the scanning wiring (−Vss=−8 V) selected by the scanning driver 10009 and receive the driving potential (about +8 V) from the modulated-signal driver 10007. These cold cathode devices emit electrons. A voltage of about 8 V is applied to cold cathode devices which receive the driving potential of +8 V from the modulated-signal driver 10007 and are connected to scanning wirings (0 V) not selected by the scanning driver 10009. However, as is apparent from FIG. 33, this voltage is equal to or less than the emission start voltage of the cold cathode device. Even if cold cathode devices are connected to wirings which receive the driving potential (about +8 V) from the modulated-signal driver 10007, they do not emit any electrons so long as they are connected to a scanning wiring not selected by the scanning driver 10009, and fluorescent substances of the display panel 10001 corresponding to these devices do not emit any light.

To the contrary, a voltage of about 8 V is applied to cold cathode devices which are connected to modulated-signal wirings receiving a non-driving output (0 V) from the modulated-signal driver 10007 and connected to a selected scanning wiring (−8 V). However, as is apparent from FIG. 33, since the voltage applied to these cold cathode devices is equal to or less than the threshold voltage, the devices do not emit any electrons, and fluorescent substances (phosphors) corresponding to these devices do not emit any light.

In this fashion, electrons are emitted from cold cathode devices which are connected to a scanning wiring selected by the scanning driver 10009 and receive an output from the modulated-signal driver 10007 with a pulse width proportional to a desired luminance. This display driving is sequentially executed to display an image on the display panel 10001.

The arrangement of the modulated-signal driver 10007 for preventing crosstalk with changes in potential on an adjacent column wiring according to the fourth embodiment of the present invention will be described.

Figure 34:
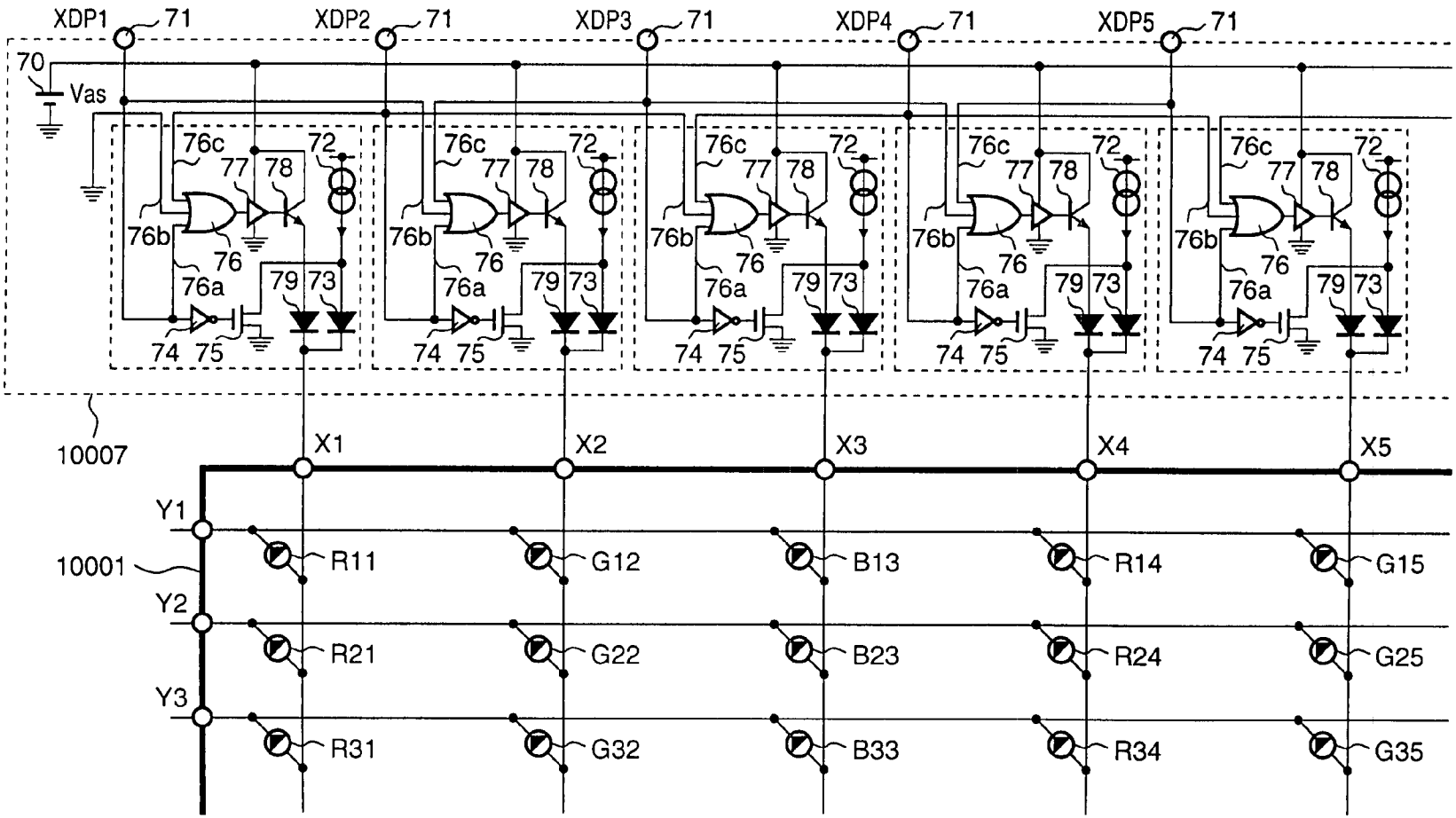
FIG. 34 is a block diagram showing the arrangement of a modulated-signal driver according to the fourth embodiment of the present invention.

FIG. 34 is a block diagram showing the circuit arrangement of the modulated-signal driver 10007 according to the fourth embodiment of the present invention.

In FIG. 34, reference numeral 70 denotes a voltage source for outputting the potential Vas [V]; 71, an input terminal for inputting a modulated signal (XDPJ: j=1 to 480) from the modulated-signal generator 10006; 72, a current source for driving the cold cathode device of the matrix type display panel 10001 and displaying an image; 73, a diode; 74, an inverter circuit; 75, a transistor such as a MOSFET for controlling whether or not to supply a driving current from the current source 72 to the display panel 10001; 76, a 3-input OR circuit; 77, a level shift circuit; 78, an NPN transistor for controlling whether or not to apply the potential Vas to the modulated-signal wiring of the display panel 10001; and 79, a diode.

The arrangement in FIG. 34 operates as follows. For descriptive convenience, the fourth embodiment will exemplify driving of the jth modulated-signal line (column wiring). This also applies to another modulated-signal line.

An output from the modulated-signal generator 10006 is a pulse-width-modulated signal (XDPj) modulated to a pulse width corresponding to a luminance signal value. The modulated signal is input to the input terminal 71. The modulated signal is inverted by the inverter circuit 74 and input to the base of the transistor 75 such as a MOSFET to ON/OFF-control the transistor 75. When the modulated signal (XDPj) is at high level, an output from the current source 72 is supplied to a modulated-signal wiring via the diode 73; when the modulated signal is at low level, the transistor 75 is turned on to flow a current from the current source 72 through the transistor 75 so as not to supply any current to the modulated-signal wiring. Note that the driving current output from the current source 72 is determined to a current value enough for the cold cathode device to emit electrons. For example, in FIG. 33, the driving current is determined to the device current If for a device voltage of 16V.

The modulated signal input to the input terminal 71 is also input to the first input terminal (76*a*) of the 3-input OR circuit 76. The second input terminal (76*b*) and third input terminal (76*c*) of the 3-input OR circuit 76 respectively receive the (j−1)th (left) and (j+1)th (right) modulated signals. The second or third input terminal of a 3-input OR circuit 76 not having a left or right modulated signal is connected to GND, like 3-input OR circuits 76 for modulated-signal wirings on the two ends which receive, e.g., signals X1 and X480. An output from the 3-input OR circuit 76 is level-converted by the level shift circuit 77, and output at GND or potential Vas [V]. An output from the level shift circuit 77 is input to the gate of the NPN transistor 78 which supplies a driving potential from the emitter to a modulated-signal wiring via the diode 79. For descriptive convenience, the voltage drop between the base and emitter of the NPN transistor 78 and the forward voltage drop of the diode 79 are ignored (these voltage drops are about 0.6 V in an actual circuit). An output potential from the power source 70 is set higher than a desired output potential (driving potential: Vas [V]) by about 1.2 V.

In this arrangement, when a modulated signal is applied to the jth modulated-signal wiring, an output from the current source 72 is output via the diode 73 to drive the jth modulated-signal wiring. If another modulated signal is output to either the right (j+1) or left (j−1) modulated-signal wiring, an output from the NPN transistor 78 is output via the diode 79. Hence, even if the jth modulated signal falls, the potential of the jth modulated-signal wiring falls to only Vas.

Figure 35:
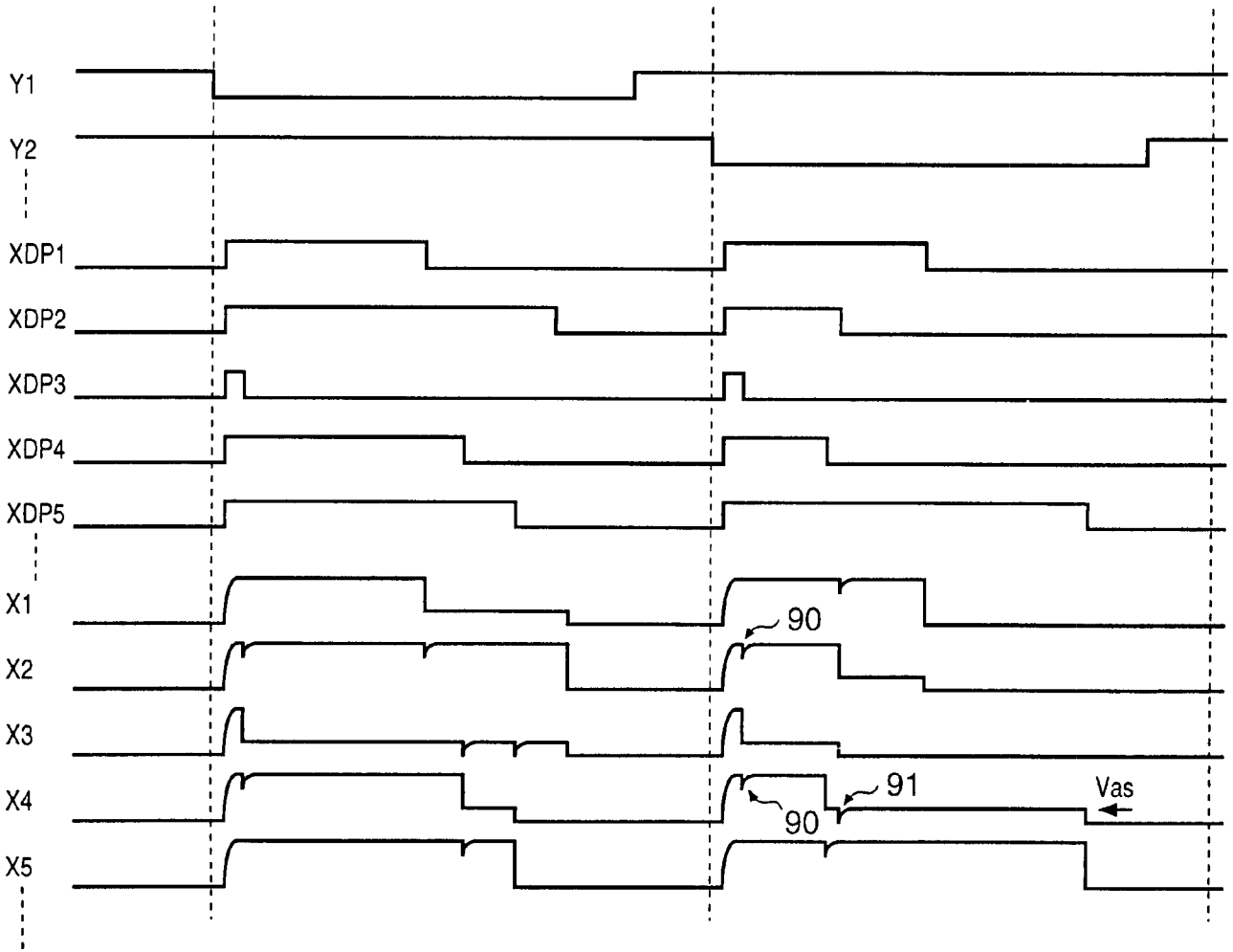
FIG. 35 is a waveform chart showing an example of the waveform of a modulated signal according to the fourth embodiment.

FIG. 35 is a waveform chart for explaining the driving waveforms of modulated signals (XDP1, XDP2, . . . ) according to the fourth embodiment and modulated signals (X1, X2, . . . ) actually supplied to the display panel 10001.

In FIG. 35, the effect of removing crosstalk on the driving waveform of a signal (X4) on the fourth modulated-signal wiring will be described. This also applies to the effect of removing crosstalk on the driving waveform of another modulated-signal wiring.

In FIG. 35, since the second and fourth adjacent modulated signals are output at high level at the fall of a signal (X3) on the third modulated-signal wiring, the signal X3 falls to not GND level but a potential almost equal to Vas. The second and fourth modulated signals (X2 and X4) are hardly influenced by inter-wiring capacitances along with the fall of the signal (X3) on the third adjacent modulated-signal wiring, and only slightly decrease in signal level. Therefore, potential changes in the signals X2 and X4 are smaller than crosstalk shown in FIG. 26.

A portion 91 of the modulated signal X4 represents crosstalk generated when the potential of the modulated signal X3 falls from Vas [V] to 0 V after modulated signals on the two adjacent modulated-signal wirings fall. At this time, since cold cathode devices receiving the modulated signal X4 are in a non-emission state, ever potential changes in the modulated signal X4 do not influence image display. In addition, since the potential difference of the modulated signal X3 between Vas [V] and 0 V is small, the absolute amount of potential changes in the modulated signal X4 is also small.

As described with reference to FIG. 27, since the voltage Vas [V] is the threshold voltage (Vth) at which the cold cathode device starts emitting electrons, degradation of the image contrast can also be minimized. Only while a modulated signal is applied to a modulated-signal wiring adjacent to a given modulated-signal wiring, the potential Vas [V] is applied to the modulated-signal line, and the modulated-signal line adjacent to the driven modulated-signal line necessarily falls to only Vas [V]. Further, only while a modulated signal on an adjacent modulated-signal wiring is ORed, the potential Vas [V] is applied to the modulated-signal line, and no potential (Vas+Vss) [V] is applied to devices not driven by the modulated-signal wiring. For this reason, no cold cathode devices are driven by the potential (Vas+Vss) [V] for an unnecessary time, and degradation of the image contrast can be minimized. As a result, the driving circuit capable of driving the display panel while reducing crosstalk between adjacent wirings even with the capacitance between adjacent modulated-signal lines can be provided. This display panel can display an image having a good gradation characteristic.

Fifth Embodiment

Figure 36:
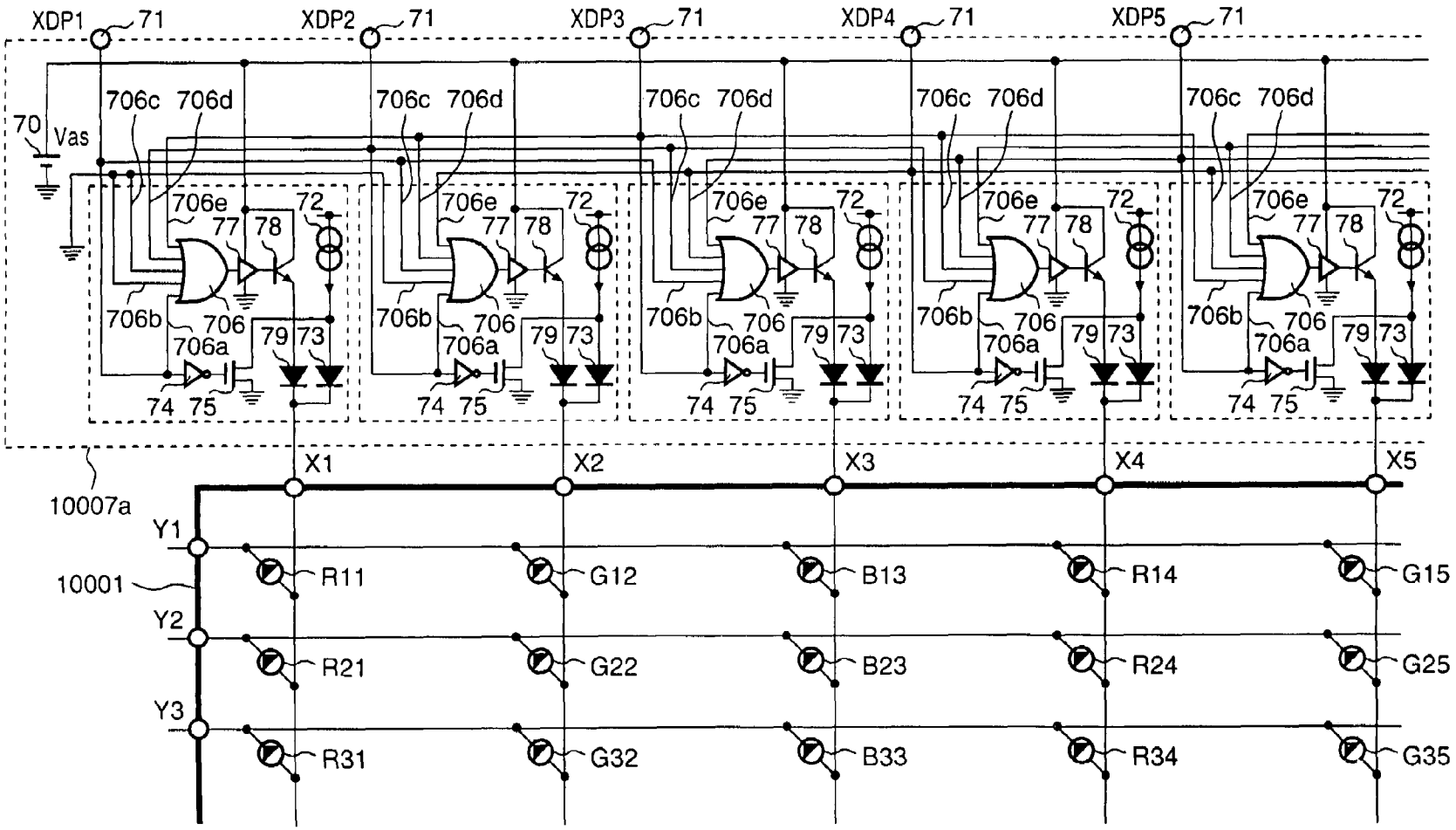
FIG. 36 is a block diagram showing the arrangement of a modulated-signal driver according to the fifth embodiment of the present invention.

FIG. 36 is a block diagram showing the arrangement of a modulated-signal driver 10007*a* according to the fifth embodiment of the present invention. The same reference numerals as in FIG. 34 denote the same parts, and a description thereof will be omitted.

In FIG. 36, reference numeral 706 denotes a 5-input OR circuit. The remaining arrangement is the same as in the above-described fourth embodiment, and a description thereof will be omitted. For descriptive convenience, the fifth embodiment will also exemplify driving of the jth modulated-signal line. This also applies to another modulated-signal line.

An output from a modulated-signal generator 10006 is a pulse-width-modulated signal (XDPj) modulated to a pulse width corresponding to a luminance signal value. The modulated signal is input to an input terminal 71. The modulated signal is inverted by an inverter circuit 74, and drives a transistor 75 such as a MOSFET to determine whether to flow an output current from a current source 72 to a modulated-signal wiring. When the modulated signal is at high level, the driving current is supplied to the modulated-signal wiring via a diode 73. This driving current is determined to a current enough for the cold cathode device to emit electrons. For example, in FIG. 33, the driving current is determined to the device current If for a device voltage of 16 V.

The modulated signal (XDPj) input to the input terminal 71 is also input to the first input terminal (706*a*) of the 5-input OR circuit 706. The second input terminal (706*b*) and third input terminal (706*c*) of the 5-input OR circuit 706 respectively receive the (j−2)th (second left) and (j−1)th (left) modulated signals. The fourth input terminal (706*d*) and fifth input terminal (706*e*) of the 5-input OR circuit 706 respectively receive the (j+1)th (right) and (j+2)th (second right) modulated signals.

Similar to the fourth embodiment, the second and third input terminals of a 5-input OR circuit 706 and the fourth and fifth input terminals of a 5-input OR circuit 706 for modulated-signal wirings on the two ends are set to low level, and the second input terminal of a 5-input OR circuit 706 and the fifth input terminal of a 5-input OR circuit 706 and the fifth input terminal of a 5-input OR circuit 705 for the second modulated-signal wirings from the two ends are also set to low level. Outputs from the 5-input OR circuits 706 are level-converted by level shift circuits 77, input to the bases of NPN transistors 78 which supply driving potentials to modulated-signal wirings via diodes 79 by emitter followers, respectively.

Accordingly, the fifth embodiment can eliminate the influence of crosstalk caused by the fall of modulated signals on alternate modulated-signal wirings in addition to right and left adjacent modulated-signal wirings. A detailed description of this is the same as in the fourth embodiment and will be omitted.

Needless to say, the number of inputs of the 5-input OR circuit 706 may be increased to prevent generation of crosstalk caused by the fall of modulated signals on, e.g., every third modulated-signal wiring.

As described above, the fifth embodiment can prevent generation of crosstalk caused by capacitances with next and alternate modulated-signal wirings.

Sixth Embodiment

Figure 37:
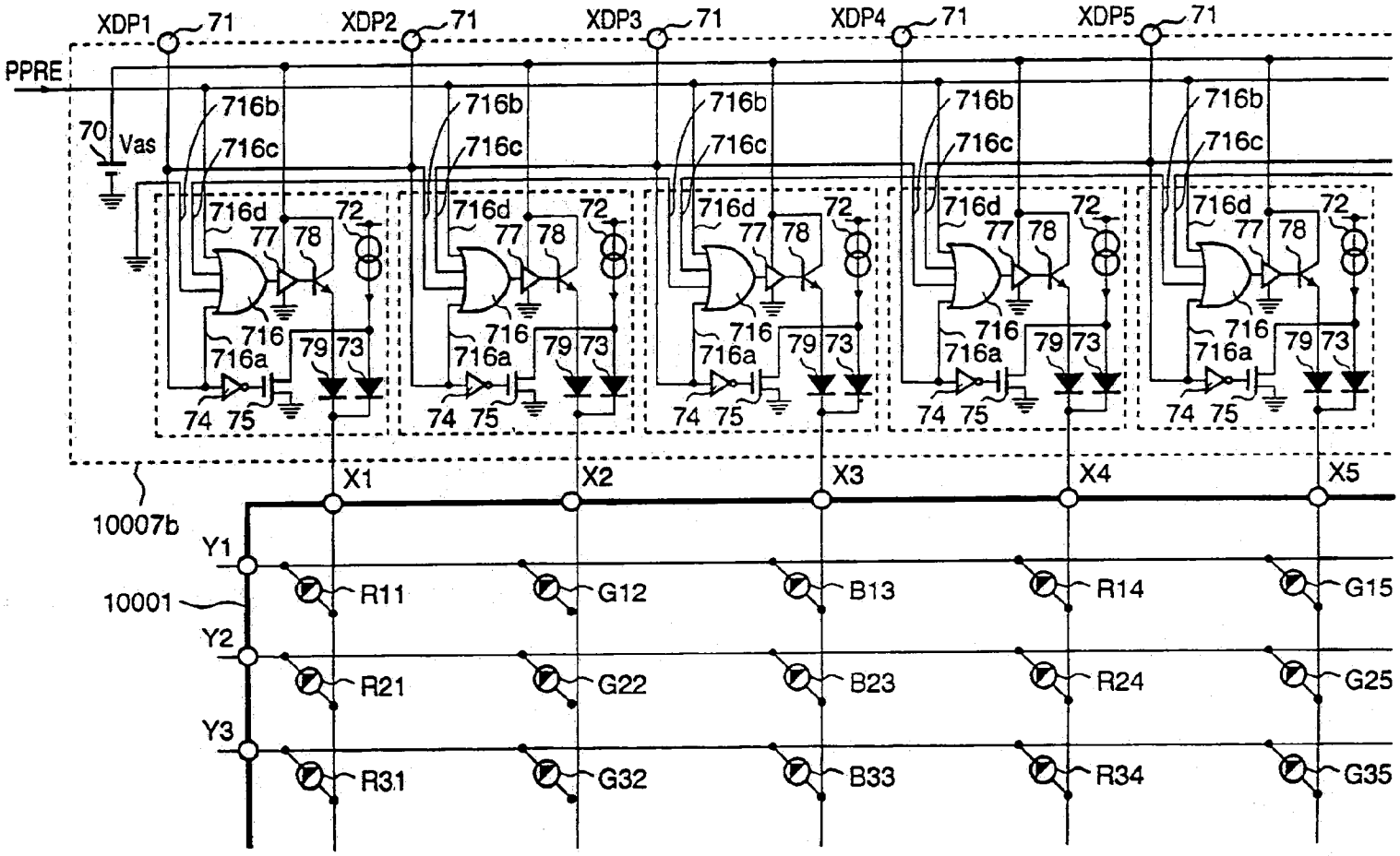
FIG. 37 is a block diagram showing the arrangement of a modulated-signal driver according to the sixth embodiment of the present invention.

FIG. 37 is a block diagram showing the arrangement of a modulated-signal driver 10007*b* according to the sixth embodiment of the present invention. The same reference numerals as in FIGS. 34 and 36 denote the same parts, and a description thereof will be omitted.

In FIG. 37, reference numeral 716 denotes a 4-input OR circuit. The remaining arrangement is the same as in the fourth embodiment. For descriptive convenience, the sixth embodiment will also exemplify driving of the jth modulated-signal line. This also applies to another modulated-signal line.

A modulated signal (XDPj) input to an input terminal 71 is input to the first input terminal (716*a*) of the 4-input OR circuit 716. The second input terminal 716(*b*) and third input terminal (716*c*) of the 4-input OR circuit 716 respectively receive the (j−1)th (left) and (j+1)th (right) modulated signals. Similar to the fourth and fifth embodiments, the input terminals of 4-input OR circuit 716 for modulated-signal wirings on the two ends, i.e., 4-input OR circuits 716 not having corresponding adjacent modulated signals are set to low level. Further, in the sixth embodiment, the fourth input terminals (716*d*) of respective 4-input OR circuits 716 are commonly connected and receive a signal PPRE.

Figure 38:
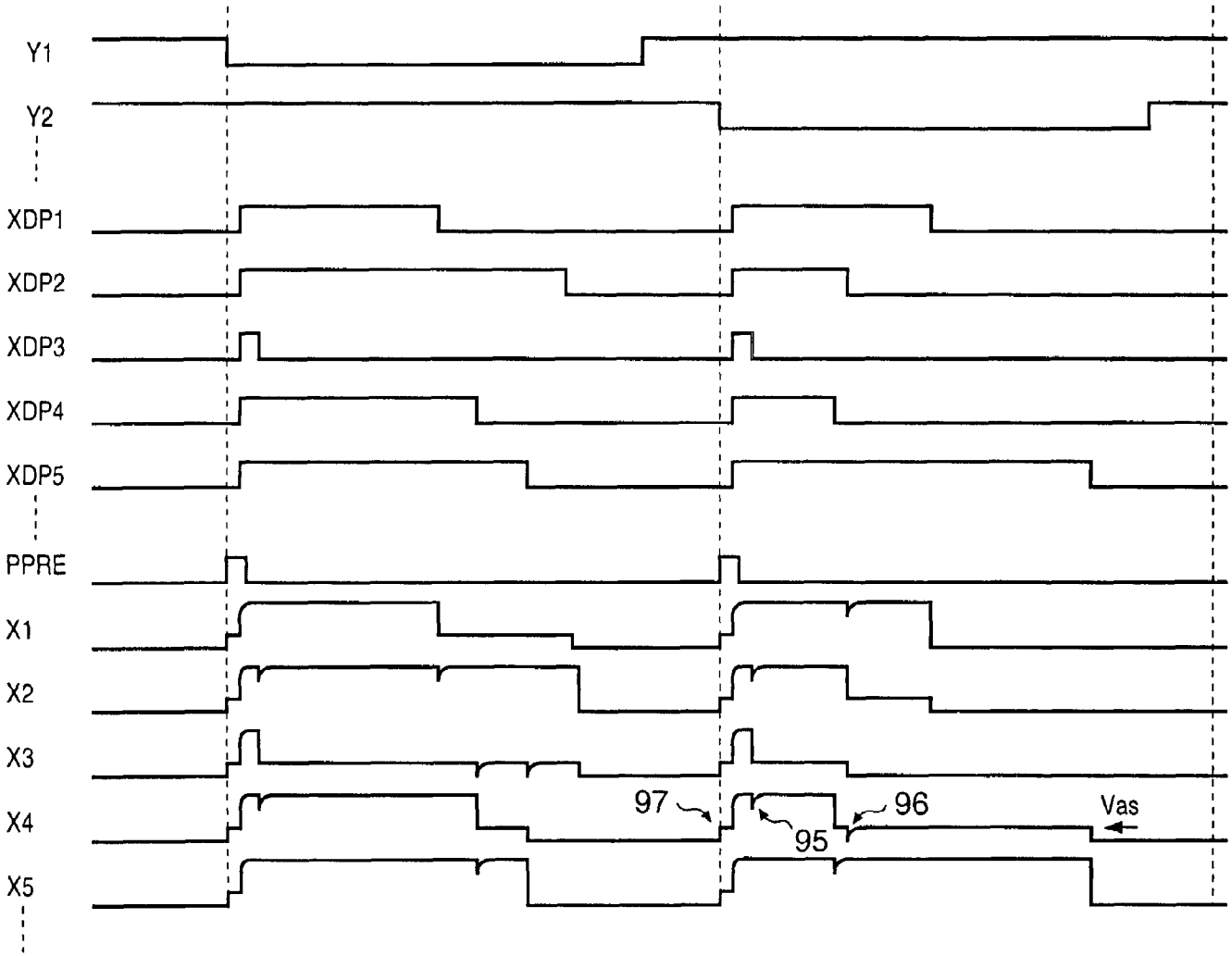
FIG. 38 is a waveform chart showing an example of the waveform of a modulated signal according to the sixth embodiment.

As shown in FIG. 38, the signal PPRE changes to high level immediately before a modulated signal (XDPj) rises to high level (active), i.e., at the start of the horizontal scanning period, and falls to low level simultaneously when the modulated signal reaches high level. For example, the signal PPRE rises 1 μsec before the modulated signal reaches high level, and falls to low level simultaneously when the modulated signal reaches high level. In FIG. 38, reference numeral 95 denotes crosstalk of the modulated signal X4 to the potential Vas; 96, crosstalk of the modulated signal X4 arising from the fall of the modulated signal X3 from the potential Vas to GND (which are the same as in the fourth and fifth embodiments); and 97, a state in which the potential of a modulated-signal wiring rises to the potential Vas before the modulated signal X4 arises.

Similar to the fourth and fifth embodiments, a modulated signal falls to the potential Vas if modulated signals are applied to right and left wirings adjacent to a modulated-signal wiring being driven. However, the modulated signal rises after the potential rises to the potential Vas. Accordingly, the rise time of the modulated-signal wiring can be shortened, i.e., the gradation characteristic in pulse width modulation can be improved.

An image can be displayed by driving the respective devices of the display panel almost free from crosstalk even with the capacitance between neighboring modulated-signal wirings. Consequently, an image display apparatus having a good gradation characteristic can be provided.

The sixth embodiment drives the respective devices of the display panel 10001 by a current from the current source 72. If this circuit is integrated into an IC, the respective devices may be driven using a voltage source (in this case, the internal resistance is relatively high due to a protection resistor or the like). The above-described arrangement of the sixth embodiment can similarly reduce crosstalk even with the use of the voltage source.

The present invention employs the cold cathode type electron-emitting device in each embodiment, but can also be applied to an EL device or any other electron-emitting device. For example, a cold cathode type electron source constituted by surface-conduction emission type electron-emitting devices, FE type electron-emitting devices, or MIM type electron-emitting devices can be satisfactorily applied to each embodiment.

The image display apparatus according to each embodiment of the present invention basically comprises, in a low-profile airtight container, a multi electron source constituted by arranging many electron sources, e.g., many cold cathode devices on a substrate, and an image forming member (fluorescent substance) which faces the multi electron source and forms an image by irradiation of electrons from the electron source.

These cold cathode devices can be formed on a substrate at a high alignment precision using a manufacturing technique such as photolithography etching, so that many devices can be laid out at a small interval. The cold cathode device or its peripheral portion can be driven at a lower temperature than a hot cathode device conventionally used in a CRT and the like, and thus the cold cathode device can easily realize a multi electron source having a smaller layout pitch.

Of cold cathode devices, the surface-conduction emission type electron-emitting device (SCE) is especially preferable. That is, of cold cathode devices, an MIM type device must be relatively precisely controlled in the thicknesses of an insulating layer and upper electrode, and an FE type device must be precisely controlled in the distal end shape of a needle-like electron-emitting portion. For this reason, these devices are relatively high in manufacturing cost and are difficult to manufacture a large-area display owing to limitations on manufacturing process. To the contrary, the SCE has a simple structure, can be easily manufactured, and can easily realize a large-area display. Under recent circumstances where inexpensive, large-screen display apparatuses are required, the cold cathode device is especially preferable.

Seventh Embodiment

The seventh, eighth, and ninth embodiments are modifications of the fourth, fifth, and sixth embodiments.

Figure 39:
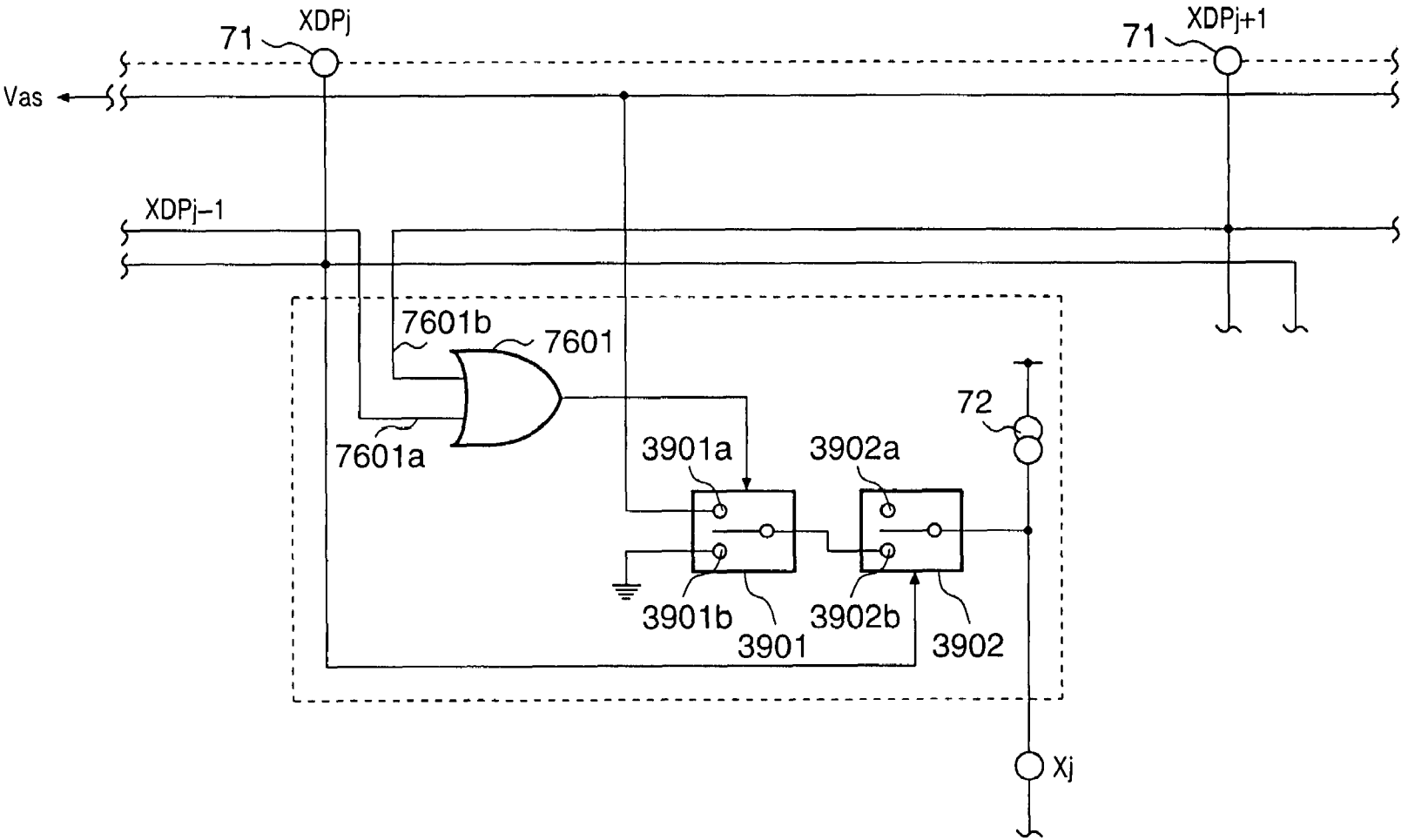
FIG. 39 is a block diagram showing the arrangement of a column wiring driving circuit according to the seventh embodiment of the present invention.

FIG. 39 is a block diagram showing a column wiring driving circuit used in the seventh embodiment that corresponds to one block surrounded by a dotted line in the modulated-signal driver 10007 in FIG. 34. The same reference numerals as in FIG. 34 denote the same parts.

In FIG. 39, reference numeral 3902 denotes a switch for receiving a modulated signal and switching the output depending on the logic level of an input terminal 71; 3901, a switch for switching the output depending on an output from an OR circuit 7601; and 7601, a 2-input OR circuit.

The arrangement in FIG. 39 operates as follows. For descriptive convenience, the seventh embodiment will exemplify driving of the jth modulated-signal line (column wiring). This also applies to another modulated-signal line.

An output from a modulated-signal generator 10006 is a pulse-width-modulated signal (XDPj) modulated to a pulse width corresponding to a luminance signal value. The modulated signal is input to the input terminal 71. The modulated signal is input to the control terminal of the switch 3902 to control the switch 3902. When the modulated signal (XDPi) is at high level, the switch 3902 selects a node 3902*a* to supply an output from a current source 72 to a modulated-signal wiring; when the modulated signal is at low level, the switch 3902 selects a node 3902*b* to supply the potential GND as a reference potential or the potential Vas to the modulated-signal wiring. Note that the driving current output from the current source 72 is determined to a current value enough for the cold cathode device to emit electrons. For example, in FIG. 33, the driving current is determined to the device current If for a device voltage of 16 V.

The first input terminal (7601*a*) and second input terminal (7601*b*) of the 2-input OR circuit 76 7601 respectively receive the (j−1)th (left) and (j+1)th (right) modulated signals. The first or second input terminal of a 2-input OR circuit 7601 not having a left or right modulated signal is connected to GND, like 2-input OR circuits 7601 for modulated-signal wirings on the two ends which receive, e.g., signals X1 and X480. An output from the output terminal of the 2-input OR circuit 7601 is input to the control terminal of the switch 3901. When the control terminal of the switch 3901 is at high level, the switch 3901 is connected to a node 3901*a*; when the control terminal is at low level, the switch 3901 is connected to a node 3901*b*.

In this arrangement, if a modulated signal is applied to the jth modulated-signal wiring, the switch 3902 selects the node 3902*a* to output an output from the current source 72 to the modulated-signal wiring, thereby driving the jth modulated-signal wiring. If a modulated signal is output to either the right (j+1) or left (j−1) modulated-signal wiring, the jth modulated signal rises because the switch 3901 selects the node 3901*a*. The switch 3902 selects the node 3902*b*, and the potential of the jth modulated-signal wiring falls to only Vas. Only when both modulated signals (potentials) on adjacent wirings are at low level, the switch 3901 selects the node 3901*b*. If the jth modulated signal changes to low level, the potential of the jth modulated signal wiring is set to the potential GND as a reference potential.

Eighth Embodiment

Figure 40:
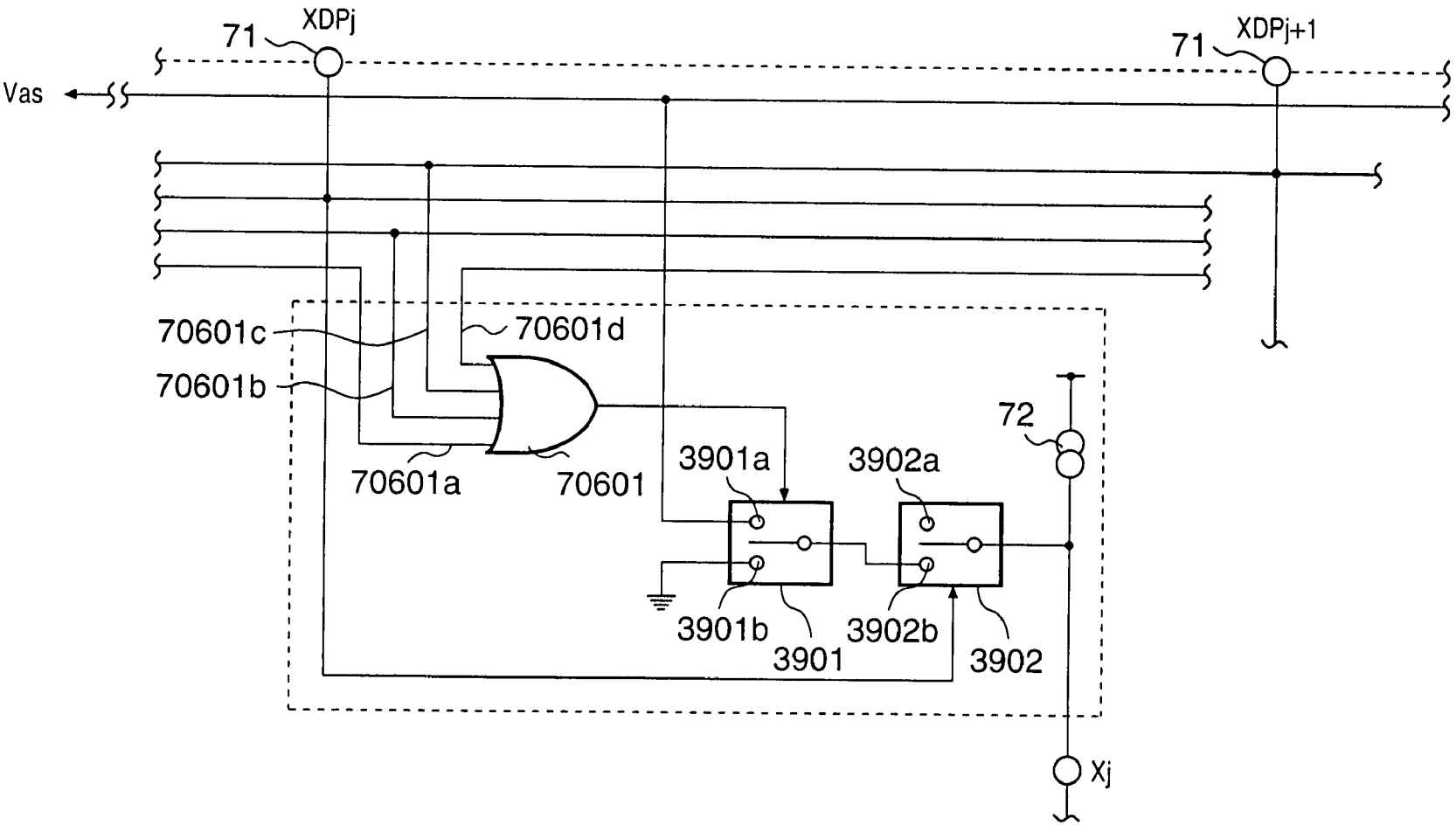
FIG. 40 is a block diagram showing the arrangement of a column wiring driving circuit according to the eighth embodiment of the present invention.

FIG. 40 is a block diagram showing a column wiring driving circuit used in the eighth embodiment that corresponds to one block surrounded by a dotted line in the modulated-signal driver 10007*a* in FIG. 36. The same reference numerals as in FIG. 36 denote the same parts.

In FIG. 40, reference numeral 70601 denotes a 4-input OR switch. The remaining arrangement is the same as in the seventh embodiment, and a description thereof will be omitted. For descriptive convenience, the eighth embodiment will exemplify driving of the jth modulated-signal line. This also applies to another modulated-signal line.

An output from a modulated-signal generator 10006 is a pulse-width-modulated signal (XDPj) modulated to a pulse width corresponding to a luminance signal value. The modulated signal is input to an input terminal 71. The modulated signal is input to the control terminal of a switch 3902 to control the switch 3902. When the modulated signal is at high level, the switch 3902 selects a node 3902*a* to supply an output from a current source 72 as a driving current to a modulated-signal wiring. Note that the driving current is determined to a current enough for the cold cathode device to emit electrons. For example, in FIG. 33, the driving current is determined to the device current If for a device voltage of 16 V.

The first input terminal (70601*a*) and second input terminal (70601*b*) of the 4-input OR circuit 70601 respectively receive the (j−2)th (second left) and (j−1)th (left) modulated signals. The third input terminal (70601*c*) and fourth input terminal (70601*d*) of the 4-input OR circuit 70601 respectively receive the (j+1)th (right) and (j+2)th (second right) modulated signals.

Similar to the above embodiment, the first and second input terminals of a 4-input OR circuit 70601 and the third and fourth input terminals of a 4-input OR circuit 70601 for modulated-signal wirings on the two ends are set to low level, and the first input terminal of a 4-input OR circuit 70601 and the fourth input terminal of a 4-input OR circuit 706010 for the second modulated-signal wirings from the two ends are also set to low level. An output from the 4-input OR circuit 70601 is input to the control terminal of a switch 3901. When the control input terminal of the switch 3901 is at high level, the switch 3901 is connected to a node 3901*a;* when the control input terminal is at low level, the switch 3901 is connected to a node 3901*b*.

Accordingly, the eighth embodiment can eliminate the influence of crosstalk caused by the fall of modulated signals on alternate modulated-signal wirings in addition to right and left adjacent modulated-signal wirings. A detailed description of this is the same as in the seventh embodiment and will be omitted.

The number of inputs of the 4-input OR circuit 70601 may be increased to prevent generation of crosstalk caused by the fall of modulated signals on every third modulated-signal wiring.

As described above, the eighth embodiment can prevent generation of crosstalk caused by capacitances with next and alternate modulated-signal wirings.

Ninth Embodiment

Figure 41:
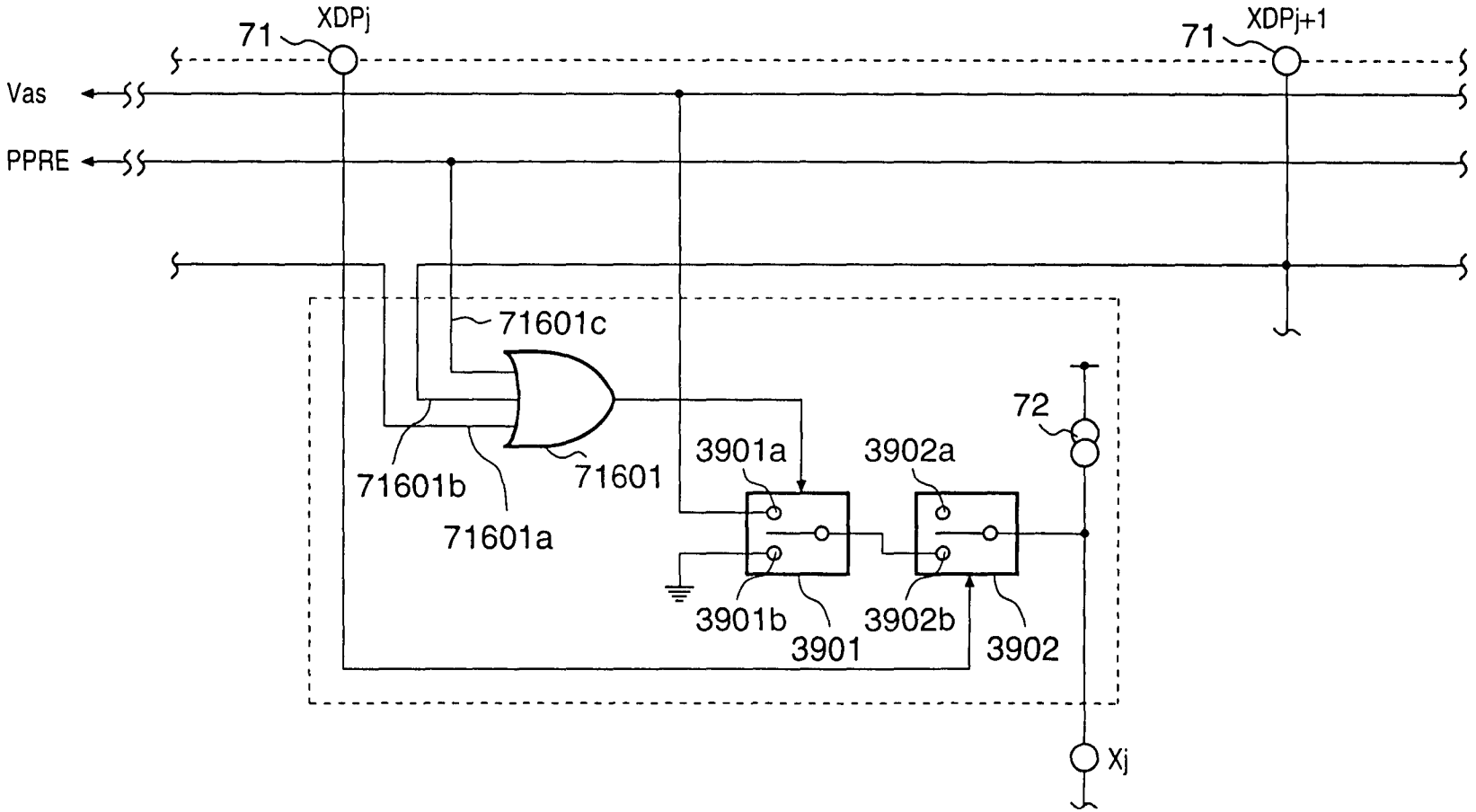
FIG. 41 is a block diagram showing the arrangement of a column wiring driving circuit according to the ninth embodiment of the present invention.

FIG. 41 is a block diagram showing a column wiring driving circuit used in the ninth embodiment that corresponds to one block surrounded by a dotted line in the modulated-signal driver 10007*b* in FIG. 37. The same reference numerals as in FIG. 37 denote the same parts.

In FIG. 41, reference numeral 71601 denotes a 3-input OR switch. The remaining arrangement is the same as in the seventh embodiment. For descriptive convenience, the ninth embodiment will exemplify driving of the jth modulated-signal line. This also applies to another modulated-signal line.

The first input terminal (716*b*) and second input terminal (716*d*) of the 3-input OR circuit 71601 respectively receive the (j−1)th (left) and (j+1)th (right) modulated signals. Similar to the above embodiments, the input terminals of 3-input OR circuits 71601 for modulated-signal wirings on the two ends, i.e., 3-input OR circuits 71601 not having corresponding adjacent modulated signals are set to low level. Further, in the ninth embodiment, the third input terminals (716*d*) of respective 3-input OR circuits 71601 are commonly connected and receive a signal PPRE. Operation by the signal PPRE is the same as in the sixth embodiment.

The above-described embodiments can be variously combined.

As has been described above, the present invention according to the present specification can realize a preferable image display.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus comprising:

a plurality of display devices wired in a matrix through a plurality of scanning signal wirings and a plurality of modulated signal wirings; and a driving circuit configured to apply a modulated signal having a modulated pulsewidth to each of said plurality of modulated signal wirings, wherein said driving circuit has a plurality of transistors connected in parallel to one of the plurality of modulated signal wirings, wherein the plurality of transistors include a first transistor and a second transistor, and a duration of a time period in which the first transistor is in an on state and a duration of a time period in which the second transistor is in an on state are different from each other, and at least a part of the time period in which the first transistor is in the on state and at least a part of the time period in which the second transistor is in the on state overlap.

2. The apparatus according to claim 1, wherein at least one of the plurality of transistors is connected to a predetermined potential.

3. The apparatus according to claim 1, further comprising a circuit for determining the operation states of the plurality of transistors.

4. The apparatus according to claim 1, wherein said driving circuit comprises a rise circuit for raising the signal level of the modulated signal and a fall circuit for causing the signal level of the modulated signal to fall.

5. The apparatus according to claim 1, wherein each said display device comprises an electron-emitting device.

6. An apparatus according to claim 1, wherein the time period in which the first transistor is in the on state partially overlaps the time period in which the second transistor is in the on state.

* * * * *

UNITED STATES PATENT AND TRADEMARK OFFICE

CERTIFICATE OF CORRECTION

PATENT NO. : 7,397,459 B2
APPLICATION NO. : 10/629801
DATED : July 8, 2008
INVENTOR(S) : Naoto Abe et al.

It is certified that error appears in the above-identified patent and that said Letters Patent is hereby corrected as shown below:

TITLE PAGE ITEM [75] INVENTORS:

"Naoto Abe, Kanagawa-ken (JP); Tatsuro Yamazaki, Tokyo (JP)" should read --Naoto Abe, Yokohama (JP); Tatsuro Yamazaki, Machida (JP)--.

COLUMN 2:

Line 17, "molybdenium"," should read --molybdenium cones,"--.

COLUMN 9:

Line 54, "source 12" should read --source I2--.
Line 67, "Vas" should read --Vss--.

COLUMN 10:

Line 1, "source 12" should read --source I2--.
Line 39, "source I1," should read --source I1.--.

COLUMN 12:

Line 35, "is" should be deleted.

COLUMN 13:

Line 61, "electrode" should read --electrodes--.

COLUMN 14:

Line 6, "thousand Å." should read --1000 Å.--.
Line 14, "thousand Å," should read --1000 Å,--.
Lines 45-49, should be deleted.
Line 54, "forming processing." should read --forming processing.
¶ The thin film 1113 is preferably graphite monocrystalline, graphite polycrystalline, amorphous carbon, or mixture thereof, and its thickness is 500 Å or less, more preferably, 300 Å or less. As it is difficult to exactly illustrate actual position or shape of the thin film 1113, Figs. 9A and 9B show the film schematically. Fig. 9A shows the device where a part of the thin film 1113 is removed.--.

UNITED STATES PATENT AND TRADEMARK OFFICE

CERTIFICATE OF CORRECTION

PATENT NO. : 7,397,459 B2
APPLICATION NO. : 10/629801
DATED : July 8, 2008
INVENTOR(S) : Naoto Abe et al.

It is certified that error appears in the above-identified patent and that said Letters Patent is hereby corrected as shown below:

COLUMN 30:

Line 16, "ever" should read --even--.

COLUMN 31:

Line 54, "input terminal 716(b)" should read --input terminal (716b)--.

COLUMN 32:

Line 2, "1 μsec" should read --1 μ sec--.

COLUMN 33:

Line 41, "circuit 76 7601" should read --circuit 7601--.

Signed and Sealed this

Twenty-third Day of June, 2009

John Doll

JOHN DOLL
*Acting Director of the United States Patent and Trademark Office*